US010262567B2

(12) United States Patent
Cok et al.

(10) Patent No.: US 10,262,567 B2
(45) Date of Patent: Apr. 16, 2019

(54) TWO-TERMINAL STORE-AND-CONTROL CIRCUIT

(71) Applicant: X-Celeprint Limited, Cork (IE)

(72) Inventors: Ronald S. Cok, Rochester, NY (US); Robert R. Rotzoll, Colorado Springs, CO (US)

(73) Assignee: X-Celeprint Limited, Cork (IE)

( * ) Notice: Subject to any disclaimer, the term of this patent is extended or adjusted under 35 U.S.C. 154(b) by 0 days.

(21) Appl. No.: 14/757,722

(22) Filed: Dec. 23, 2015

(65) Prior Publication Data

US 2017/0188427 A1 Jun. 29, 2017

(51) Int. Cl.
*G09G 3/20* (2006.01)
*G09G 3/3208* (2016.01)
(Continued)

(52) U.S. Cl.
CPC ..... *G09G 3/2003* (2013.01); *F21K 9/90* (2013.01); *G09G 3/2022* (2013.01); *G09G 3/32* (2013.01); *G09G 3/3208* (2013.01); *H05B 33/0842* (2013.01); *G09G 2300/0408* (2013.01); *G09G 2300/0452* (2013.01); *G09G 2300/0465* (2013.01); *G09G 2300/0819* (2013.01);
(Continued)

(58) Field of Classification Search
CPC ..... F21K 9/90; G09G 3/32; G09G 3/2003; G09G 3/2022; G09G 3/3208; G09G 2300/0408; G09G 2330/028; G09G 2300/0857; G09G 2300/0465; G09G 2320/0666; G09G 2320/0247; G09G 2300/0819; G09G 2310/0294; G09G 2310/08; G09G 2300/0452; G09G 2360/12; G09G 2310/0286; G09G 2310/027; H05B 33/0842
See application file for complete search history.

(56) References Cited

U.S. PATENT DOCUMENTS 5,550,066 A 8/1996 Tang et al.
5,621,555 A 4/1997 Park
(Continued)

FOREIGN PATENT DOCUMENTS

WO WO-2006/027730 A1 3/2006
WO WO-2006/099741 A1 9/2006
(Continued)

OTHER PUBLICATIONS

U.S. Appl. No. 14/822,866, filed Aug. 10, 2015, Bower et al.
(Continued)

*Primary Examiner* — Jonathan A Boyd
(74) *Attorney, Agent, or Firm* — William R. Haulbrook; Michael D. Schmitt; Choate, Hall & Stewart LLP

(57) ABSTRACT

A two-terminal store-and-control circuit includes a power circuit for receiving a modulated first signal, for receiving a second signal, for providing a power signal, and for providing a V− signal. A voltage comparator receives the modulated first signal and the V+ signal and provides a data signal that is extracted from the modulated first signal and the power signal. A data storage circuit receives and stores the data signal and provides a stored data signal. The circuit can be provided in a two-terminal store-and-control surface-mount device and employed to make a display.

20 Claims, 41 Drawing Sheets

(51) Int. Cl.
*F21K 9/90* (2016.01)
*G09G 3/32* (2016.01)
*H05B 33/08* (2006.01)

(52) U.S. Cl.
CPC ..... *G09G 2300/0857* (2013.01); *G09G 2310/027* (2013.01); *G09G 2310/0286* (2013.01); *G09G 2310/0294* (2013.01); *G09G 2310/08* (2013.01); *G09G 2320/0247* (2013.01); *G09G 2320/0666* (2013.01); *G09G 2330/028* (2013.01); *G09G 2360/12* (2013.01)

(56) References Cited

U.S. PATENT DOCUMENTS 5,731,802 A 3/1998 Aras et al.
5,815,303 A 9/1998 Berlin
5,912,712 A 6/1999 Doherty
5,994,722 A 11/1999 Averbeck et al.
6,084,579 A 7/2000 Hirano
6,142,358 A 11/2000 Cohn et al.
6,184,477 B1 2/2001 Tanahashi
6,278,242 B1 8/2001 Cok et al.
6,392,340 B2 5/2002 Yoneda et al.
6,448,718 B1 9/2002 Battersby
6,466,281 B1 10/2002 Huang et al.
6,577,367 B2 6/2003 Kim
6,660,457 B1 12/2003 Imai et al.
6,717,560 B2 4/2004 Cok et al.
6,756,576 B1 6/2004 McElroy et al.
6,812,637 B2 11/2004 Cok et al.
6,933,532 B2 8/2005 Arnold et al.
7,012,382 B2 3/2006 Cheang et al.
7,091,523 B2 8/2006 Cok et al.
7,129,457 B2 10/2006 McElroy et al.
7,195,733 B2 3/2007 Rogers et al.
7,288,753 B2 10/2007 Cok
7,402,951 B2 7/2008 Cok
7,420,221 B2 9/2008 Nagai
7,443,438 B2 10/2008 Kakumoto et al.
7,466,075 B2 12/2008 Cok et al.
7,521,292 B2 4/2009 Rogers et al.
7,557,367 B2 7/2009 Rogers et al.
7,586,497 B2 9/2009 Boroson et al.
7,622,367 B1 11/2009 Nuzzo et al.
7,662,545 B2 2/2010 Nuzzo et al.
7,687,812 B2 3/2010 Louwsma et al.
7,704,684 B2 4/2010 Rogers et al.
7,738,001 B2 6/2010 Routley et al.
7,791,271 B2 9/2010 Cok et al.
7,799,699 B2 9/2010 Nuzzo et al.
7,816,856 B2 10/2010 Cok et al.
7,834,541 B2 11/2010 Cok
7,893,612 B2 2/2011 Cok
7,919,342 B2 4/2011 Cok
7,927,976 B2 4/2011 Menard
7,932,123 B2 4/2011 Rogers et al.
7,943,491 B2 5/2011 Nuzzo et al.
7,969,085 B2 6/2011 Cok
7,972,875 B2 7/2011 Rogers et al.
7,982,296 B2 7/2011 Nuzzo et al.
7,990,058 B2 8/2011 Cok et al.
7,999,454 B2 8/2011 Winters et al.
8,029,139 B2 10/2011 Ellinger et al.
8,039,847 B2 10/2011 Nuzzo et al.
8,115,380 B2 2/2012 Cok et al.
8,198,621 B2 6/2012 Rogers et al.
8,207,547 B2 6/2012 Lin
8,207,635 B2 * 6/2012 Covaro ..... H04B 3/542 307/112
8,243,027 B2 8/2012 Hotelling et al.
8,261,660 B2 9/2012 Menard
8,334,545 B2 12/2012 Levermore et al.
8,394,706 B2 3/2013 Nuzzo et al.
8,421,791 B2 4/2013 Harada
8,440,546 B2 5/2013 Nuzzo et al.
8,450,927 B2 5/2013 Lenk et al.
8,470,701 B2 6/2013 Rogers et al.
8,502,192 B2 8/2013 Kwak et al.
8,506,867 B2 8/2013 Menard
8,558,243 B2 10/2013 Bibl et al.
8,664,699 B2 3/2014 Nuzzo et al.
8,686,447 B2 4/2014 Tomoda et al.
8,722,458 B2 5/2014 Rogers et al.
8,754,396 B2 6/2014 Rogers et al.
8,766,970 B2 7/2014 Chien et al.
8,791,474 B1 7/2014 Bibl et al.
8,794,501 B2 8/2014 Bibl et al.
8,803,857 B2 8/2014 Cok
8,817,369 B2 8/2014 Daiku
8,835,940 B2 9/2014 Hu et al.
8,854,294 B2 10/2014 Sakariya
8,877,648 B2 11/2014 Bower et al.
8,889,485 B2 11/2014 Bower
8,895,406 B2 11/2014 Rogers et al.
8,941,215 B2 1/2015 Hu et al.
8,987,765 B2 3/2015 Bibl et al.
9,105,714 B2 8/2015 Hu et al.
9,153,171 B2 10/2015 Sakariya et al.
9,161,448 B2 10/2015 Menard et al.
9,166,114 B2 10/2015 Hu et al.
9,178,123 B2 11/2015 Sakariya et al.
9,202,996 B2 12/2015 Orsley et al.
9,217,541 B2 12/2015 Bathurst et al.
9,358,775 B2 6/2016 Bower et al.
9,478,583 B2 10/2016 Hu et al.
9,484,504 B2 11/2016 Bibl et al.
9,520,537 B2 12/2016 Bower et al.
9,555,644 B2 1/2017 Rogers et al.
9,570,532 B2 2/2017 Huangfu et al.
9,601,356 B2 3/2017 Bower et al.
9,626,908 B2 4/2017 Sakariya et al.
9,640,108 B2 5/2017 Cok et al.
9,640,715 B2 5/2017 Bower et al.
9,660,008 B2 5/2017 Bower et al.
9,761,754 B2 9/2017 Bower et al.
9,765,934 B2 9/2017 Rogers et al.
9,786,646 B2 10/2017 Cok et al.
9,818,725 B2 11/2017 Bower et al.
9,865,832 B2 1/2018 Bibl et al.
9,923,133 B2 3/2018 Bower et al.
9,928,771 B2 3/2018 Cok
9,929,053 B2 3/2018 Bower et al.
9,930,277 B2 3/2018 Cok
10,091,446 B2 10/2018 Cok et al.
10,157,563 B2 12/2018 Cok et al.
2001/0022564 A1 9/2001 Youngquist et al.
2002/0078559 A1 6/2002 Buchwalter et al.
2002/0096994 A1 7/2002 Iwafuchi et al.
2002/0154101 A1 10/2002 Abe et al.
2003/0062545 A1 4/2003 Yamazaki et al.
2003/0189829 A1 * 10/2003 Shimizu ..... F21L 4/00 362/240
2003/0201986 A1 10/2003 Willis et al.
2003/0223275 A1 * 12/2003 Abe ..... G11C 5/147 365/189.09
2004/0140763 A1 7/2004 Buchwalter et al.
2004/0212296 A1 10/2004 Nakamura et al.
2004/0227704 A1 11/2004 Wang et al.
2004/0252933 A1 12/2004 Sylvester et al.
2005/0012076 A1 1/2005 Morioka
2005/0040754 A1 2/2005 Sakurai
2005/0104833 A1 5/2005 Ochi et al.
2005/0116621 A1 6/2005 Bellmann et al.
2005/0140275 A1 6/2005 Park
2005/0168987 A1 8/2005 Tamaoki et al.
2005/0253159 A1 11/2005 Creswick et al.
2005/0275615 A1 12/2005 Kahen et al.
2006/0063309 A1 3/2006 Sugiyama et al.
2006/0170623 A1 8/2006 Naugler et al.
2007/0035340 A1 2/2007 Kimura
2007/0077349 A1 4/2007 Newman et al.
2007/0132674 A1 6/2007 Tsuge
2007/0201056 A1 8/2007 Cok et al.
2007/0216610 A1 9/2007 Smith

(56) References Cited

U.S. PATENT DOCUMENTS

2008/0180381 A1 7/2008 Jeong et al.
2008/0259019 A1 10/2008 Ng
2009/0096742 A1 4/2009 Huang
2009/0147033 A1 6/2009 Arai et al.
2009/0273303 A1* 11/2009 Peng ..... H05B 33/0818 315/297
2009/0289559 A1 11/2009 Tanaka et al.
2009/0315054 A1 12/2009 Kim et al.
2010/0045690 A1 2/2010 Handschy et al.
2010/0078670 A1 4/2010 Kim et al.
2010/0085295 A1 4/2010 Zhao et al.
2010/0123268 A1 5/2010 Menard
2010/0156766 A1 6/2010 Levey et al.
2010/0207852 A1 8/2010 Cok
2010/0214247 A1 8/2010 Tang et al.
2010/0248484 A1 9/2010 Bower et al.
2010/0258710 A1 10/2010 Wiese et al.
2010/0317132 A1 12/2010 Rogers et al.
2011/0057861 A1 3/2011 Cok et al.
2011/0084993 A1 4/2011 Kawabe
2011/0199011 A1* 8/2011 Nakazawa ..... G09G 3/342 315/193
2011/0211348 A1 9/2011 Kim
2012/0126229 A1 5/2012 Bower
2012/0206421 A1 8/2012 Cok et al.
2012/0206499 A1 8/2012 Cok
2012/0228669 A1 9/2012 Bower et al.
2012/0307123 A1 12/2012 Cok et al.
2012/0314388 A1 12/2012 Bower et al.
2013/0015483 A1 1/2013 Shimokawa et al.
2013/0069275 A1 3/2013 Menard et al.
2013/0088416 A1 4/2013 Smith et al.
2013/0141469 A1 6/2013 Xu
2013/0153277 A1 6/2013 Menard et al.
2013/0196474 A1 8/2013 Meitl et al.
2013/0207964 A1 8/2013 Fleck et al.
2013/0221355 A1 8/2013 Bower et al.
2013/0273695 A1 10/2013 Menard et al.
2014/0055654 A1 2/2014 Borthakur et al.
2014/0104243 A1 4/2014 Sakariya et al.
2014/0159043 A1 6/2014 Sakariya et al.
2014/0184667 A1 7/2014 Xu
2014/0217448 A1 8/2014 Kim et al.
2014/0264763 A1 9/2014 Meitl et al.
2014/0267683 A1 9/2014 Bibl et al.
2014/0306248 A1 10/2014 Ahn et al.
2014/0367633 A1 12/2014 Bibl et al.
2014/0367705 A1 12/2014 Bibl et al.
2015/0135525 A1 5/2015 Bower
2015/0137153 A1 5/2015 Bibl et al.
2015/0169011 A1 6/2015 Bibl et al.
2015/0181148 A1 6/2015 Slovick et al.
2015/0263066 A1 9/2015 Hu et al.
2015/0280066 A1 10/2015 Fujimura et al.
2015/0280089 A1 10/2015 Obata et al.
2015/0302795 A1 10/2015 Genoe
2015/0362165 A1 12/2015 Chu et al.
2015/0371585 A1 12/2015 Bower et al.
2015/0371591 A1 12/2015 Suzuki et al.
2015/0371974 A1 12/2015 Bower et al.
2015/0372051 A1 12/2015 Bower et al.
2015/0372052 A1 12/2015 Bower et al.
2015/0372053 A1 12/2015 Bower et al.
2015/0373793 A1 12/2015 Bower et al.
2016/0005721 A1 1/2016 Bower et al.
2016/0018094 A1 1/2016 Bower et al.
2016/0064363 A1 3/2016 Bower et al.
2016/0093600 A1 3/2016 Bower et al.
2016/0118026 A1 4/2016 Loo et al.
2016/0119565 A1 4/2016 Fujita et al.
2016/0127668 A1 5/2016 Fujita et al.
2016/0163253 A1 6/2016 Chaji et al.
2016/0212361 A1 7/2016 Suzuki
2016/0276326 A1 9/2016 Natarajan et al.
2016/0343771 A1* 11/2016 Bower ..... H01L 21/77
2017/0040371 A1 2/2017 Izuhara
2017/0047393 A1 2/2017 Bower et al.
2017/0061867 A1 3/2017 Cok et al.
2017/0084671 A1 3/2017 Hack et al.
2017/0154819 A1 6/2017 Bower et al.
2017/0186356 A1 6/2017 Cok
2017/0187976 A1 6/2017 Cok
2017/0206820 A1 7/2017 Cok et al.
2017/0206845 A1 7/2017 Sakariya et al.
2017/0330509 A1 11/2017 Cok et al.
2017/0338374 A1 11/2017 Zou et al.
2017/0352647 A1 12/2017 Raymond et al.
2018/0131886 A1 5/2018 Cok
2018/0166512 A1 6/2018 Hack et al.
2018/0197471 A1 7/2018 Rotzoll et al.
2018/0315793 A1 11/2018 Zhu et al.
2018/0342191 A1 11/2018 Cok et al.

FOREIGN PATENT DOCUMENTS

WO WO-2008/103931 A2 8/2008
WO WO-2010/032603 A1 3/2010
WO WO-2010/132552 A1 11/2010
WO WO-2013/064800 A1 5/2013
WO WO-2014/121635 A1 8/2014
WO WO-2014/149864 A1 9/2014

OTHER PUBLICATIONS

U.S. Appl. No. 14/835,282, filed Aug. 25, 2015, Cok et al.
Lee, S. H. etal, Laser Lift-Offof GaN Thin Film and its Application to the Flexible Light Emitting Diodes, Proc. of SPIE 8460:846011-1-846011-6 (2012).
Roscher, H., VCSEL Arrays with Redundant Pixel Designs for 10Gbits/s 2-D Space-Parallel MMF Transmission, Annual Report, optoelectronics Department, (2005).
Yaniv et al., A 640×480 Pixel Computer Display Using Pin Diodes with Device Redundancy, 1988 International Display Research Conference, IEEE, CH-2678-1/88:152-154 (1988).
Bower, C. A. et al., Transfer Printing: An Approach for Massively Parallel Assembly of Microscale Devices, IEE, Electronic Components and Technology Conference, (2008).
Cok, R. S. et al., 60.3: AMOLED Displays Using Transfer-Printed Integrated Circuits, Society for Information Display, 10:902-904, (2010).
Feng, X. et al., Competing Fracture in Kinetically Controlled Transfer Printing, Langmuir, 23(25):12555-12560, (2007).
Gent, A.N., Adhesion and Strength of Viscoelastic Solids. Is There a Relationship between Adhesion and Bulk Properties?, American Chemical Society, Langmuir, 12(19):4492-4496, (1996).
Kim, Dae-Hyeong et al., Optimized Structural Designs for Stretchable Silicon Integrated Circuits, Small, 5(24):2841-2847, (2009).
Kim, Dae-Hyeong et al., Stretchable and Foldable Silicon Integrated Circuits, Science, 320:507-511, (2008).
Kim, S. et al., Microstructured elastomeric surfaces with reversible adhesion and examples of their use in deterministic assembly by transfer printing, PNAS, 107(40):17095-17100, (2010).
Kim, T. et al., Kinetically controlled, adhesiveless transfer printing using microstructured stamps, Applied Physics Letters, 94(11):113502-1-113502-3, (2009).
Meitl, M. A. et al., Transfer printing by kinetic control of adhesion to an elastomeric stamp, Nature Material, 5:33-38, (2006).
Michel, B. et al., Printing meets lithography: Soft approaches to high-resolution patterning, J. Res. & Dev. 45(5):697-708, (2001).
Trindade, A.J. et al., Precision transfer printing of ultra-thin AlInGaN micron-size light-emitting diodes, Crown, pp. 217-218, (2012).
Cok, R. S. et al., AMOLED displays with transfer-printed integrated circuits, Journal of SID 19/(4):335-341(2011).
Hamer et al., 63.2: AMOLED Displays Using Transfer-Printed Integrated Circuits, SID 09 Digest, 40(2):947-950 (2009).

* cited by examiner

TWO-TERMINAL STORE-AND-CONTROL CIRCUIT

CROSS REFERENCE TO RELATED APPLICATIONS

This application is related to commonly assigned U.S. patent application Ser. No. 14/835,282 filed Aug. 25, 2015, entitled Bit-Plane Pulse-Width Modulated Display System, by Cok et al. and to commonly assigned U.S. patent application Ser. No. 14/822,866 filed Aug. 10, 2015, entitled Display Tile Structure and Tiled Display, by Bower et al. which are hereby incorporated by reference in their entirety.

FIELD OF THE INVENTION

The present invention relates to a control circuit providing stored data in a two-terminal surface-mount device.

BACKGROUND OF THE INVENTION

Flat-panel displays are widely used in computing devices, in portable devices, and for entertainment devices such as televisions. Such displays typically employ a plurality of pixels distributed in an array over a display substrate to display images, graphics, or text. For example, liquid-crystal displays (LCDs) employ liquid crystals to block or transmit light from a backlight behind the liquid crystals. Organic light-emitting diode (OLED) displays rely on passing current through a layer of organic material that glows in response to the electrical current. Each pixel usually includes three or more sub-pixels emitting light of different colors, for example red, green, and blue.

Displays are typically controlled with either a passive-matrix (PM) control employing electronic circuitry external to the display substrate or an active-matrix (AM) control employing electronic circuitry formed directly on the display substrate and storing data associated with each light-emitting element. Both OLED displays and LCDs using passive-matrix control and active-matrix control are available. An example of such an AM OLED display device is disclosed in U.S. Pat. No. 5,550,066.

Typically, in an active-matrix-controlled display each display sub-pixel is controlled by one control element, and each control element includes at least one transistor. For example, in a simple active-matrix OLED display, each control element includes two transistors (a select transistor and a drive transistor) and one capacitor for storing a charge specifying the desired luminance of the sub-pixel. Each OLED element employs an independent control electrode connected to the power transistor and a common electrode. In contrast, an LCD typically uses a single-transistor circuit. Control of the light-emitting elements is usually provided through a data signal line, a select signal line, a power connection and a ground connection. Active-matrix elements are not necessarily limited to displays and can be distributed over a substrate and employed in other applications requiring spatially distributed control.

Active-matrix circuitry is commonly achieved by forming thin-film transistors (TFTs) in a semiconductor layer formed on a display substrate and employing a separate TFT circuit to control each light-emitting pixel in the display. The semiconductor layer is typically amorphous silicon or polycrystalline silicon and is distributed over the entire flat-panel display substrate. The semiconductor layer is photolithographically processed to form electronic control elements, such as transistors and capacitors. Additional layers, such as insulating dielectric layers and conductive metal layers, are provided (e.g., often by evaporation or sputtering) and photolithographically patterned to form electrical interconnections, structures, or wires.

Surface-mount devices (SMDs) are an alternative way to provide electrical elements on a substrate or backplane. Such devices, as their name suggests, include electrical connections that are typically placed on the surface and in contact with a backplane rather than including that extend through vias in the backplane. Surface-mount technology (SMT) is widely used in the electronics industry to provide high-density printed-circuit boards (PCBs). In particular, a well-developed and inexpensive infrastructure exists for making and integrating two-terminal surface-mount devices, such as resistors or capacitors, into printed circuit boards. However, the smallest surface-mount device readily available is several hundred microns long and wide, precluding their use for applications requiring integrated circuits with circuit elements having a size of several microns or less.

There is a need, therefore, for devices and manufacturing methods that enable the use of two-terminal devices for complex circuits in electronic systems.

SUMMARY OF THE INVENTION

The present invention provides a two-terminal store-and-control circuit having modulated signal inputs that provide power and ground to the circuit as well as data or control signals. The store-and-control circuit can be a digital circuit and can provide a separate signal on each of the two terminals. One signal can have a timing, enabling, or selecting function relative to another signal that can be a data signal. Alternatively, a separate timing signal can be produced internally to the store-and-control circuit from a modulated signal input. Multiple signals can be provided serially on one or both of the two terminals. The store-and-control circuit can include one or more storage elements, such as flip-flops, to store received information. The signals can be used to drive light emitters or other indicators.

The circuit can also include sensors that receive sense attributes of the environment and produce sense signals or processors that process information to produce processed signals. The sense or processed signals can be output as output signals 48 on one or both of the two terminals, serially or in parallel by modulating the signal inputs to provide signal outputs. The sense signal can be a touch signal, for example a capacitive touch signal.

The two-terminal store-and-control circuit can be constructed by micro-transfer printing chiplets, for example including digital integrated control circuits or discrete components, on a two-terminal surface-mount device substrate and electrically connecting the chiplets, for example using photolithographic methods, to the two terminals of the surface-mount device. Micro light-emitting diodes can also be provided in the circuit using micro-transfer printing, as can other electronic circuit elements such as processors, sensor, resistors, or capacitors. Thus, the two-terminal store-and control circuit can include multiple devices having separate and independent substrates integrated on a common surface-mount device substrate.

An array of the surface-mount devices each including a two-terminal store- and control circuit with light emitters can be disposed on a backplane or display substrate to form a display. Each surface-mount device can provide a pixel, for example a full-color pixel, or multiple pixels, and can be independently tested. The surface-mount devices can be electrically connected to arrays of row and column conductors, for example using surface-mount soldering methods. The row and column conductors can be row-select lines and column-data lines connected to row drivers and column drivers under the control of a display controller to provide active-matrix control of the display. The column or row drivers can also be responsive to output signals provided from the two-terminal store-and-control circuit, for example touch signals, and provide the output signals to the display controller to enable a display with touch-sensing capability.

In a further embodiment of the present invention, the surface-mount devices incorporating the two-terminal store-and-control circuit are micro-transfer printed onto the display substrate or are disposed on the display substrate using surface-mount application techniques and devices. Pre-tested surface-mount devices can be disposed on the display substrate to improve manufacturing yields. Alternatively, or in addition, the display can be tested and any bad light emitters replaced, using rework methods. In other embodiments, the display substrate is processed to form row and column conductors that have multiple locations on the display substrate for additional surface-mount devices at each pixel that are electrically connected in parallel. An additional surface-mount device can be disposed at the location of each bad surface-mount device and connected in parallel with the bad surface-mount device. In another embodiment, a redundant additional surface-mount device is disposed and electrically connected in parallel with every surface-mount device. If both the surface-mount device and any corresponding additional surface-mount devices are all working, a calibration-control circuit can compensate for the additional light emitted from the surface-mount device and the additional surface-mount devices.

The present invention can be used in a wide variety of applications including information storage, manipulation, or presentation and a circuit responsive to the information and any use of the invention is not limited to the example applications disclosed herein. The circuit can be implemented in a surface-mount device. The surface-mount device can have a substrate that includes one or more of glass, resin, fiber glass, ceramic, plastic, polymer, a semiconductor, a silicon semiconductor, or a crystalline semiconductor. The surface-mount device can be processed using photolithographic techniques and can include circuitry formed directly on or in the surface-mount device substrate or circuits or devices having a substrate separate and independent from the surface-mount device substrate disposed on the surface-mount device, or both. A plurality of such two-terminal circuits or surface-mount devices can be incorporated into a system, such as a display system.

Thus, the disclosed technology, in certain embodiments, includes a display with an array of light emitters forming rows and columns on a display substrate, each light emitter controlled by the two-terminal store-and-control circuit.

In certain embodiments, the light emitter is a light-emitting diode with a width from 2 to 5 μm, 5 to 10 μm, 10 to 20 μm, or 20 to 50 μm, a length from 2 to 5 μm, 5 to 10 μm, 10 to 20 μm, or 20 to 50 μm, or a height from 2 to 5 μm, 4 to 10 μm, 10 to 20 μm, or 20 to 50 μm. In certain embodiments, the display substrate or surface-mount device substrate is a polymer, plastic, resin, polyimide, PEN, PET, metal, metal foil, glass, a semiconductor, or sapphire.

BRIEF DESCRIPTION OF THE DRAWINGS

The foregoing and other objects, aspects, features, and advantages of the present disclosure will become more apparent and better understood by referring to the following description taken in conjunction with the accompanying drawings, in which.

Figure 1A:
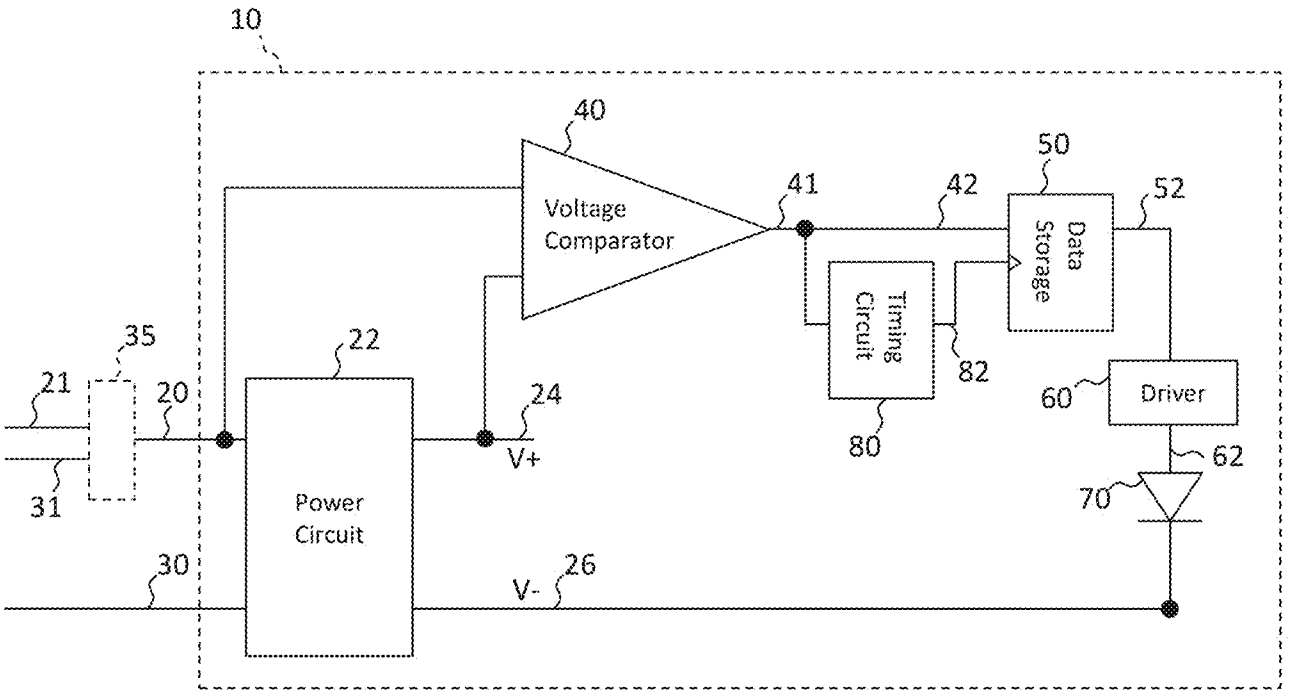
FIG. 1A is a schematic illustration of an embodiment of the present invention.

The features and advantages of the present disclosure will become more apparent from the detailed description set forth below when taken in conjunction with the drawings, in which like reference characters identify corresponding elements throughout. In the drawings, like reference numbers generally indicate identical, functionally similar, and/or structurally similar elements. The figures are not drawn to scale since the variation in size of various elements in the Figures is too great to permit depiction to scale.

DETAILED DESCRIPTION OF THE INVENTION

Referring to FIG. 1A, a two-terminal store-and-control circuit 10 includes a power circuit 22 for receiving a modulated first signal 20 (SIG1), for receiving a second signal 30 (SIG2), for providing a V+ signal 24, and for providing a V− signal 26. A voltage comparator 40 receives the modulated first signal 20 and receives the V+ signal 24 and provides a comparison signal 41 that is extracted from the modulated first signal 20 and the V+ signal 24 to produce a data signal 42. In this embodiment, the comparison signal 41 is the data signal 42. A data storage circuit 50 receives and stores the data signal 42 and provides a stored data signal 52. As used herein, a signal can include or be a value, for example a digital value or an analog value represented by a voltage or charge. The comparison signal 41 output by the voltage comparator 40 can be processed or modified by a circuit to produce the data signal 42. Alternatively, the voltage comparator 40 can include circuitry to process or modify the output of the voltage comparator circuit. According to embodiments of the present invention, the relative voltage difference between the V+ signal 24 and the V− signal 26 can be reversed, for example the signal 24 could have a relatively lower voltage than the signal 26. The appellation of V+ and V− is provided for convenience to describe one, non-limiting embodiment of the present invention.

In one embodiment of the present invention, a timing circuit 80 responsive to the data signal 42 provides a timing signal 82. The timing signal 82 can be used to control or operate various functional elements of the two-terminal store-and-control circuit 10, for example the data storage circuit 50.

The stored data signal 52 stored in the data storage circuit 50 can be used to provide or control a variety of functions according to a corresponding variety of applications of the two-terminal store-and-control circuit 10. In an embodiment, the stored data signal 52 is processed. In the embodiment of FIG. 1A, a drive circuit 60 receives the stored data signal 52 and provides a drive signal 62 that drives or controls a light emitter 70 to emit light. Thus, the two-terminal store-and-control circuit 10 of FIG. 1 can be used to control an indicator in an intelligent device or a pixel or sub-pixel in a display.

Figure 1B:
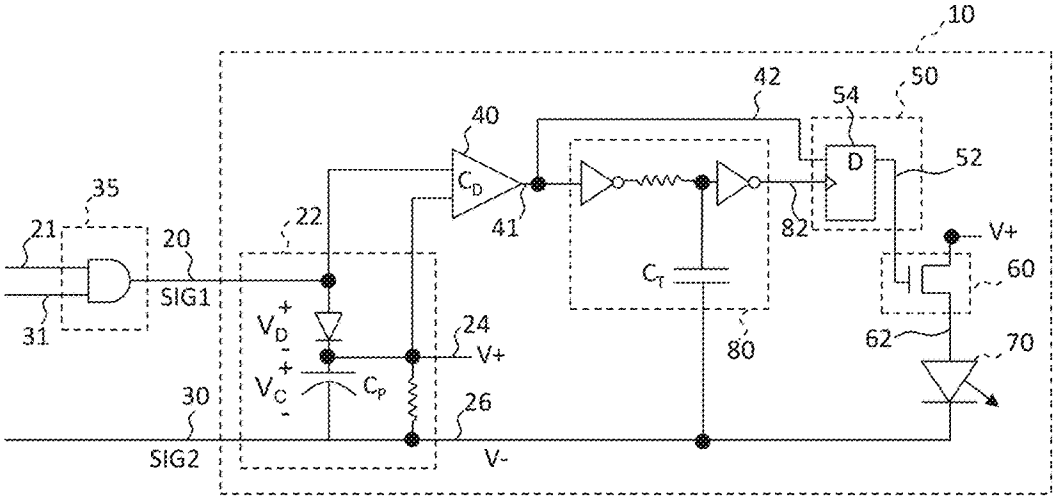
FIG. 1B is a circuit diagram of the FIG. 1A schematic illustration.

The various circuit elements of the present invention can be implemented in a variety of ways and the designs presented herein are exemplary and not limiting. In an embodiment of the present invention, the data signal 42 can be a digital signal. In another embodiment, not shown, the data signal 42 is an analog signal. Referring also to FIG. 1B, the power circuit 22 can include any of a variety of circuit elements, for example additional isolation and conditioning circuits or circuit elements applied to the modulated first signal 20 or the second signal 30, or both. In the embodiment illustrated in FIG. 1B, the power circuit 22 includes a diode and capacitor $C_P$ connected in series between the modulated first and second signals 20, 30. A resistor, which simulates a current load on V+ and V−, is connected in parallel with the capacitor $C_P$. The negative terminal of the capacitor $C_P$ is connected to the second signal 30, providing the V− signal 26 and the positive terminal of the capacitor $C_P$ provides the V+ signal 24. The capacitor $C_P$ preserves a relatively stable voltage differential between the V+ signal 24 and the V− signal 26 and supplies a relative power and ground to the two-terminal store-and-control circuit 10 even when one or both of the modulated first and second signals 20, 30 are modulated. In alternative embodiments, a simple linear regulator supplies a stable local voltage reference and a relatively smaller bypass capacitor $C_P$ reduces transient noise and stability issues. The V+ signal 24 can have a different value than the average value of the input modulated first signal 20 or the lowest value of the input modulated first signal 20, for example the V+ signal 24 can have a value of 3.3 volts and the modulated first signal 20 has a value of 5 volts compared to the second signal 30, or vice versa. In an embodiment, the power circuit 22 does not modify the second signal 30 and the second signal 30 simply passes through the power circuit 22 as illustrated in FIG. 1B.

The V+ signal 24 and the original modulated first signal 20 is compared by the voltage comparator 40 ($C_D$) to extract the difference and provide the comparison signal 41 or a data signal 42. The comparison signal 41 can be the data signal 42, as is the case in this embodiment. In an alternative embodiment, and as further discussed below, the comparison signal 41 is further processed or modified to provide the data signal 42. Any of a variety of voltage comparison circuits can be implemented, for example using operational amplifiers, and can employ hysteresis to reduce inadvertent triggering. The V+ signal 24 and V− signal 26 can provide a relatively stable voltage differential for other circuit elements, such as flip flops, drivers, and light emitters.

The two-terminal store-and-control circuit 10 of the present invention can be employed in a matrix-addressed system, such as a display or area sensor. In such a system, an array of two-terminal store-and-control circuits 10 is provided, for example on a substrate. An array of external column-data signals 21 corresponding to columns of two-terminal store-and-control circuits 10 and external row-select signals 31 corresponding to rows of two-terminal store-and-control circuits 10 are also provided. The external column-data signals 21 are external to the two-terminal store-and-control circuit 10. Separate power and ground lines can also be provided on the substrate. A row of two-terminal store-and-control circuits 10 is selected, the corresponding external row-select signal 31 is activated, and the column data corresponding to the row are provided on the external column-data signals 21. The column data value (pixel value) is combined with row-select signal in an active-matrix enable circuit 35 to provide the first modulated signal 20 and demonstrate how the embodiment of the two-terminal store-and-control circuit 10 in FIGS. 1A and 1B can be used in a matrix-addressed system. The active-matrix enable circuit 35 is external to the two-terminal store-and-control circuit 10 of the present invention as shown by the dashed box labeled 10 on FIGS. 1A and 1B.

(For clarity, the dashed box 10 is not included in FIGS. 2A, 2B, 3A, 3B, 4A, and 4B discussed below but, in all of these cases, the active-matrix enable circuit 35 is not part of the two-terminal store-and-control circuit 10.)

In the embodiment of FIG. 1B, the timing circuit 80 includes a pair of serially connected inverters connected to the data signal 42. However, the output of the first invertor is connected to a resistor and a capacitor $C_T$ that requires a pre-determined amount of time (depending on the values of the resistor and capacitor $C_T$) to switch its state, due to the RC time constant imposed by the resistor and capacitor $C_T$ and the finite current flow provided through the inverter. The values of the resistor and capacitor $C_T$ determine the delay and can be selected to provide a data rate suitable for a desired application of the two-terminal store-and-control circuit 10 and compatible with the chosen circuit components. Thus, in this embodiment, the timing circuit 80 provides an output timing signal 82 that is delayed by a pre-determined amount of time from the data signal 42. Multiple timing circuits 80 may be placed in series in order to achieve long delays relative to the input pulse width of data signal 42. The delayed timing signal 82 is applied as a timing signal 82 that serves as a clock signal to latch the data signal 42 into a data storage element 54 such as a D flip-flop. The delayed timing signal 82 allows the data signal 42 on the input of the D flip-flop to set up so that when the timing signal 82 transitions (e.g., from a zero state to a one state), the D flip-flop stores the data signal 42 in the flip-flop and provides the stored data as the stored data signal 52 after the D flip-flop latch time.

The stored data signal 52 is then received by the drive circuit 60 to provide a drive signal 62 that drives the light emitter 70. In this embodiment, the drive circuit 60 is a transistor whose source is connected to the V+ signal 24, whose gate is connected to the stored data signal 52, and whose drain is connected to a light emitter 70 such as a light emitting diode, for example a micro-light emitting diode. In an alternative embodiment, the source or drain of the transistor (or, more generally, a drive circuit 60) is connected directly to the modulated first signal 20 rather than the V+ signal 24. This direct connection avoids any voltage drop across a diode or resistor and any losses in the power circuit 22. In certain embodiments, the modulation of the first signal 20 does not affect the performance of the controlled circuit, such as the light emitters 70. The active-matrix enable circuit 35 is implemented with an AND gate and can include a power transistor with enough current-carrying capacity to drive an output device such as a light emitter. The active-matrix enable circuit 35 can also be implemented as a single transistor with the current path connected between terminals external column-data signal 21 and first signal 20 and with its control input on terminal external row-select signal 31, for example, a MOSFET with input external column-data signal 21 as the source, input external row-select signal 31 as the gate and output first signal 20 as the drain. The active-matrix circuit 35 can also be implemented as a single transistor with the current path connected between terminals external row-select signal 31 and first signal 20 and with its control input on terminal external column-data signal 21, for example, a MOSFET with input external row-select signal 31 as the source, input external column-data signal 21 as the gate and output first signal 20 as the drain.

The circuit of FIG. 1B can employ positive or negative logic and the drive circuit 60 and light emitter 70 can be arranged so that the source or drain of the transistor are connected to either the V+ signal 24 or V− signal 26 and the light emitter 70 is correspondingly connected to the transistor source or drain. A variety of such circuit configurations can be used and the circuit elements of FIG. 1B (or any of the circuits described herein) can be formed in discrete circuit components, integrated circuits, or a combination of discrete components and integrated circuit components. In various embodiments, alternative elements or circuit designs can be used to implement the two-terminal store-and-control circuit 10 functions, for example a digital latch can be used in place of a D flip-flop, various voltage comparators 40 can be used, or a variety of timing circuits 80 can be employed. T flip-flops and D flip-flops can include an output and inverted output together with clear or preset control signals to specify the state of the flip-flop.

Figure 5:
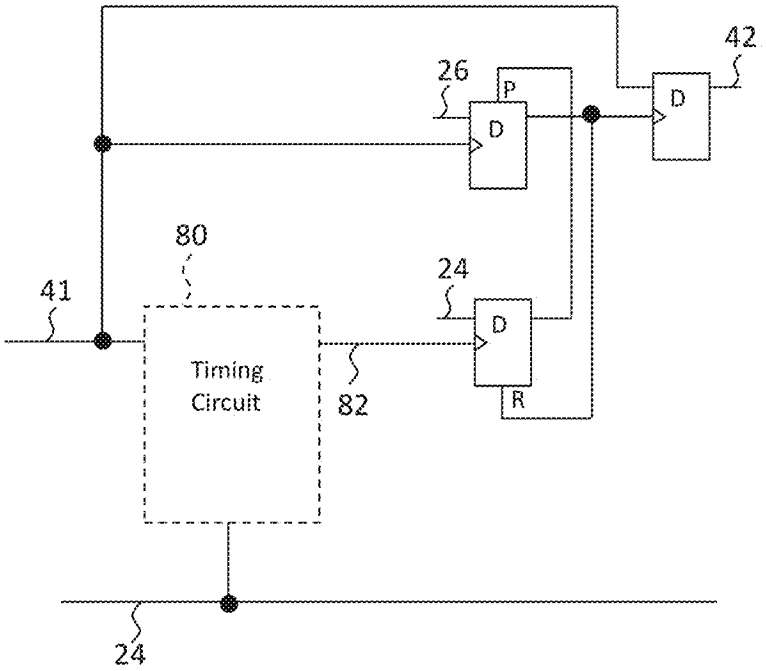
FIG. 5 is a schematic illustration of a delay circuit that is robust in the presence of circuit element variability according to an embodiment of the present invention.

This circuit can be dependent on the relative timing of the delay signals and the data signal 42, leading to variable behavior if strict control of component values is not provided. Referring to FIG. 5 (and as discussed below with respect to FIG. 2B), other embodiments can control glitches and timing variability to provide robust performance in the face of manufacturing variability in circuit components, such as resistors or capacitors. Referring to FIG. 5, three D flip-flops (with preset and clear inputs as indicated by P and R) are connected as shown to provide a data signal 42 with less dependence on the input pulse spacing of the comparison signal 41 resulting in a system that is less susceptible to circuit element and timing variability.

Figure 1C:
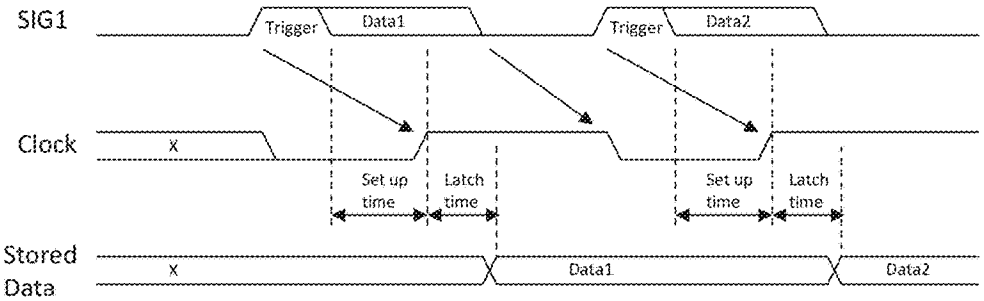
FIG. 1C is a timing diagram for the FIG. 1B circuit.

Referring to the timing diagram of FIG. 1C, in an embodiment of the present invention, a modulated first signal 20 is provided and a data signal 42 extracted. The positive-going edge of the data signal 42 is referred to as a trigger and drives the timing circuit 80. A pre-determined time after the trigger, the timing signal 82 likewise changes from a zero to a one state and acts as a clock signal to latch the data storage element 54 (e.g., a D flip-flop). The data storage element 54 stores the data signal 42 present at the time of the clock timing signal 82 transition. Thus, to store a one value, the data signal 42 stays high for the duration of the delay imposed by the timing circuit 80. To store a zero value, the data signal 42 transitions low before the clock timing signal 82 transitions high. The state of the data storage element 54 is unknown (unless a clear signal is applied to the data storage element 54 or the two-terminal store-and-control circuit 10 powers up into a known state, for example with an RF circuit electrically connected to a clear terminal of the D flip-flop or digital latch) until the clock timing signal 82 transition. Note that a second data signal 42 value cannot be stored until the data signal 42 settles back into its previous state (e.g., a low state). The RC-delay circuit can provide a delayed timing signal 82 for both the positive-going output transition and the negative-going output transition of the data signal 42 so that a second positive-going timing signal 82 cannot be generated until the timing signal 82 settles into its previous state, as indicated with the arrows in FIG. 1C.

Figure 2A:
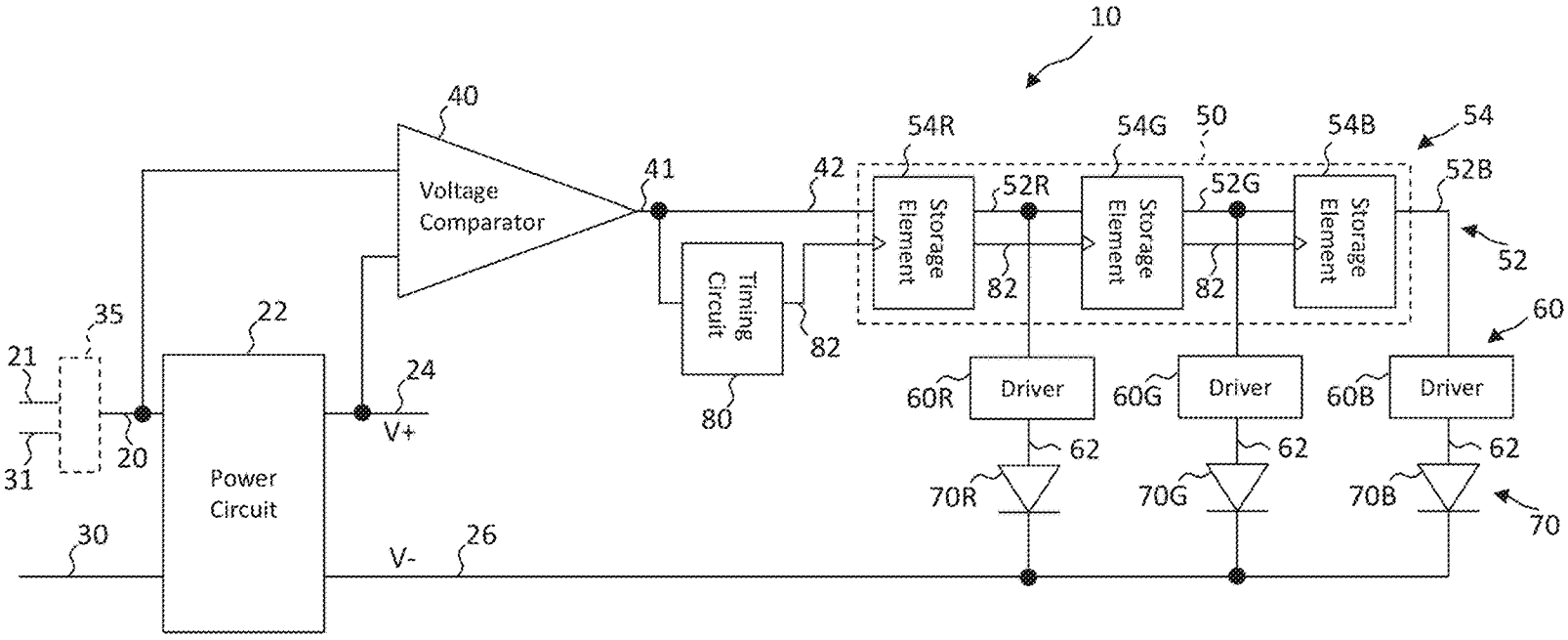
FIG. 2A is a schematic illustration of an embodiment of the present invention having multiple storage elements.

Referring to FIG. 2A, in an embodiment of the present invention the data storage circuit 50 comprises a plurality of data storage elements 54. In this embodiment, the data storage elements 54 are serially connected so that the first data storage element 54R receives the data signal 42 and both stores the data signal 42 and provides the stored data signal 52R in response to the timing signal 82. The subsequent data storage element 54G receives the stored data signal 52R from the previous data storage element 54R and both stores the received stored data signal 52R and provides the received stored data signal 52G in response to the timing signal 82. The subsequent data storage elements 54B receives the stored data signal 52G from the previous data storage element 54G and both stores the received stored data signal 52G and provides the received stored data signal 52B in response to the timing signal 82.

Thus, the serially connected data storage elements 54 form a daisy chain that sequentially transfers the first stored data signal 52 from the first data storage element 54R to each successive data storage elements 54G, 54B (i.e., in turn in the order in which they are connected within the data storage element 54) such that data is shifted from each data storage 54R, 54G to the next data storage element 54G, 54B, respectively, in response to successive timing signals 82. The clocks of each of the data storage elements 54 are connected in common to the timing signal 82 so that the serially connected data storage elements 54 form a serial shift register. In an embodiment of the present invention, each of the stored data signals 52 is connected to a drive circuit 60 to drive a light emitter 70. As noted in FIG. 2A, the data storage elements are labeled as 54R, 54G, 54B (collectively data storage elements 54) and output stored data signals 52R, 52G, 52B (collectively stored data signals 52) to drive circuits 60R, 60G, 60B (collectively drive circuits 60) to produce drive signals 62 and control red, green, and blue light emitters 70R, 70G, 70B that emit red, green, and blue light, respectively, (collectively light emitters 70) to emit red, green, and blue light respectively in response to the data signals 42.

Figure 2B:
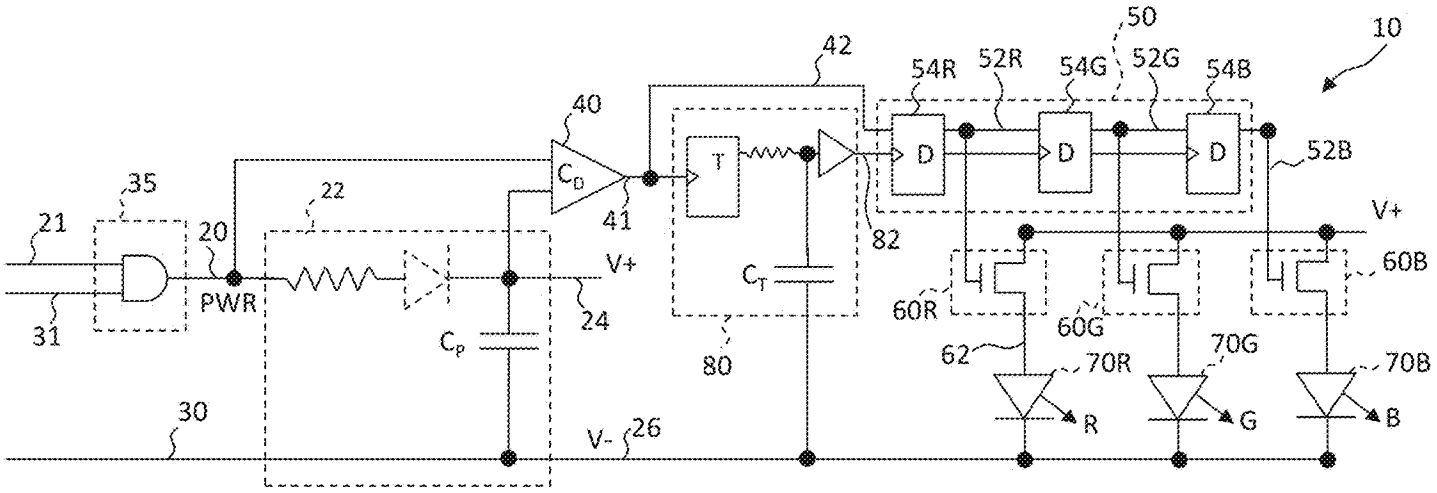
FIG. 2B is a circuit diagram of the FIG. 2A schematic illustration.

Referring also to FIG. 2B, an alternative power circuit 22 includes a resistor and optional diode. An alternative timing circuit 80 includes a T (toggle) flop-flop whose output changes states each time it receives the data signal 42. The output of the T flip-flop is connected to a resistor and a capacitor $C_T$ that requires a pre-determined amount of time (depending on the values of the resistor and capacitor $C_T$) to switch its state, due to the RC time constant imposed by the resistor and capacitor $C_T$ and the finite current flow provided through the T flip-flop. The values of the resistor and capacitor $C_T$ determine the delay and can be selected to provide a data rate suitable for a desired application of the two-terminal store-and-control circuit 10 and compatible with the chosen circuit components. The data storage elements 54R, 54G, and 54B comprise serially connected D flip-flops with commonly connected clock inputs. The input of the data storage element 54R is connected to the data signal 42, the input of data storage element 54G is connected to the output of data storage element 54R, and the input of data storage element 54B is connected to the output of data storage element 54G. Each of the drive circuits 60R, 60G, 60B and light emitters 70R, 70G, 70B are each connected and operate as described with respect to the drive circuit 60 and light emitter 70 of FIG. 1B.

Figure 2C:
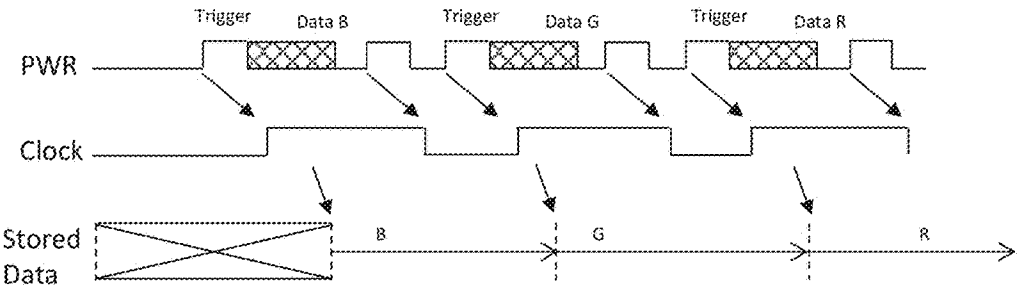
FIG. 2C is a timing diagram for the FIG. 2B circuit.

The timing diagram of FIG. 2C illustrates loading the two-terminal store-and-control circuit 10 of FIG. 2B and operates as also described with respect to FIG. 1C. The data storage elements 54R, 54G, 54B are initially in a power-up state. A modulated first signal 20 is applied to provide a trigger and a consequent timing signal 82 that subsequently latches the first data signal 42 (for example a value Data B) into the first data storage element 54R. A second trigger signal resets the timing circuit 80 in preparation for a second data signal 42 that is provided to the serial shift register of data storage elements 54. Thus, the alternative FIG. 2B embodiment of the timing circuit 80 uses a double clocking scheme compared to the single clock found in the FIG. 1B and FIG. 5 embodiments. The second data signal 42 (for example a value Data G) is latched into the first data storage element 54R and the stored data signal 52R (value Data B) in the first data storage element 54R is latched into the second data storage element 54G. Another trigger signal resets the timing circuit 80 in preparation for a third data signal 42 that is provided to the serial shift register of data storage elements 54. The third data signal 42 (for example a value Data R) is latched into the first data storage element 54R, the stored data signal 52R (value Data G) in the first data storage element 54R is latched into the second data storage element 54G, and the stored data signal 52G (value Data B) in the second data storage element 54G is latched into the third data storage element 54B, so that value Data B is stored in the third data storage element 54B, the value Data G is stored in the second data storage element 54G, and the value Data R is stored in the first data storage element 54R. The stored values 54R, 54G, 54B (corresponding to the values Data R, Data G, and Data B) are applied to the drive circuits 60R, 60G, 60B, respectively, to produce the drive signals 62 and control the light emitters 70R, 70G, and 70B to emit red, green, and blue light.

By employing a serially connected shift register of data storage elements 54, an increased number of data values are supplied to the two-terminal store-and-control circuit 10 of the present invention and more complex operations or functions are carried out. In the embodiment of FIGS. 2A-2C, the two-terminal store-and-control circuit 10 can implement a full-color pixel, for example for a display. Although illustrated with three data storage elements 54, the data storage circuit 50 can have any number of data storage elements 54 to store any number of data values within the capacity of the two-terminal store-and-control circuit 10 and its embodiment in hardware.

Figure 3A:
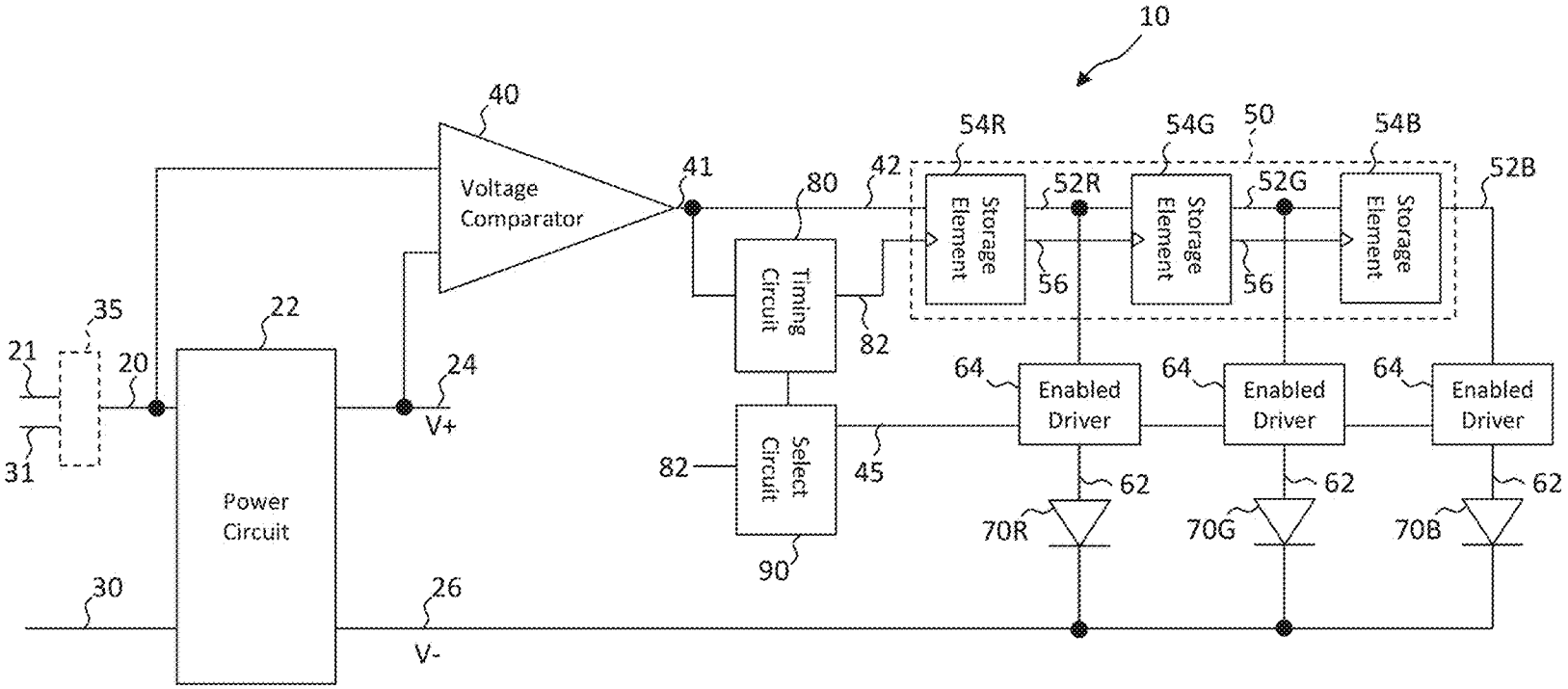
FIG. 3A is a schematic illustration of an embodiment of the present invention having an enable function.
Figure 3B:
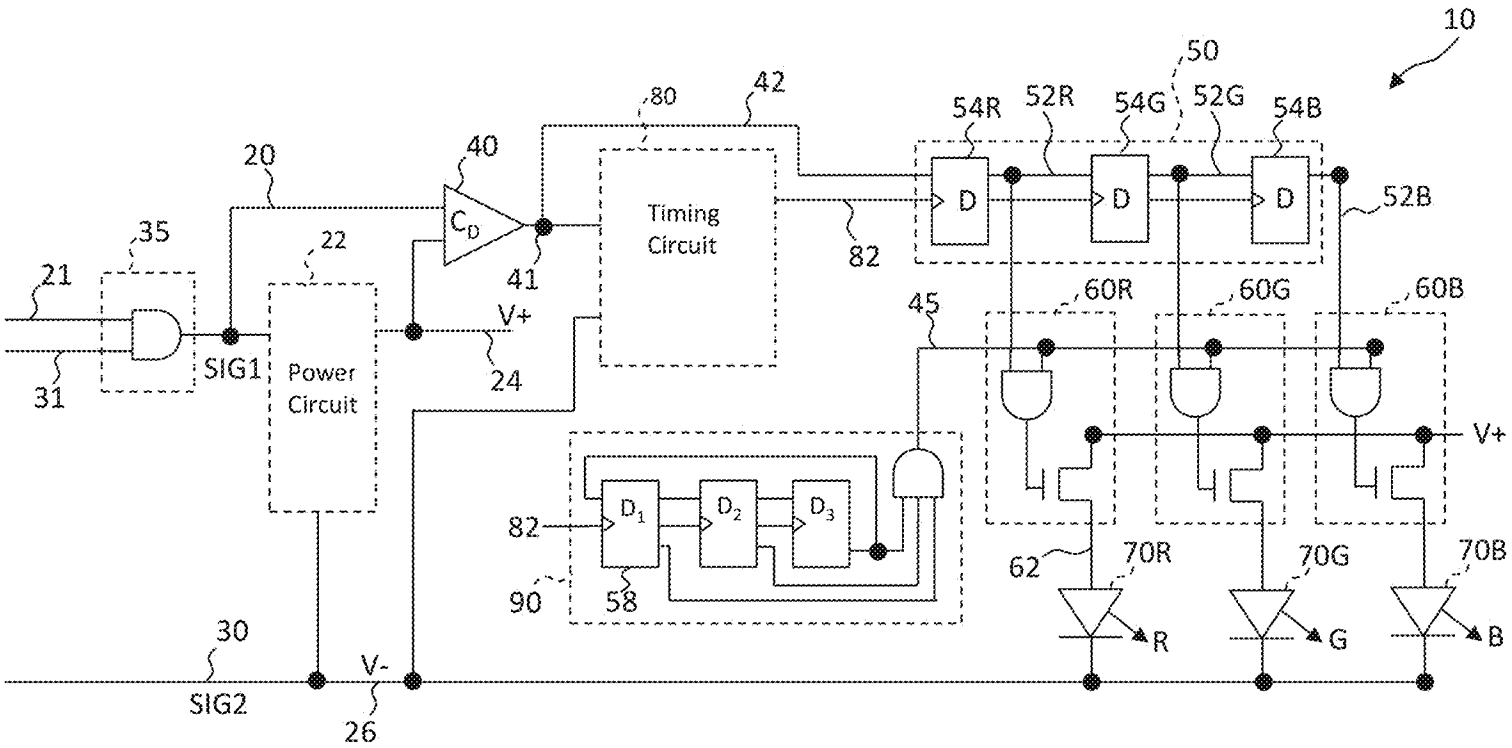
FIG. 3B is a circuit diagram of the FIG. 3A schematic illustration.

Referring next to FIGS. 3A and 3B, the circuit of FIG. 2A is extended with the addition of a select circuit 90 that produces an enable signal 45 for the enabled drive circuits 64. The power circuit 22, voltage comparator 40, and serially connected data storage elements 54 are all as described with respect to FIGS. 2A and 2B. The select circuit 90 is a state machine that selects a particular state that enables all of the enabled drive circuits 64 to produce the drive signals 62 that drive the light emitters 70R, 70G, 70B to emit light. The enabled drive circuits 64 only drive the light emitters 70 when enabled. The select circuit 90 receives the data signal 42 or the timing signal 82 (or both) and provides one or more enable signals 45. Each enable signal 45 is combined with the stored data signal 52 of one or more of the plurality of data storage elements 54 to enable the enabled drive circuit 64.

As shown in FIG. 3B, the select circuit 90 includes a serially connected set of select storage elements 58 such as flip-flops or latches, for example D flip-flops or digital latches, forming a serial shift register whose outputs are combined to provide the enable signal 45. All of the select storage elements 58 are latched in common by the timing signal 82 (a trigger). The first select storage element 58 receives the inverse of the stored value of the last select storage element 58 in the series of select storage elements 58 (a feedback signal) and both stores the received feedback signal value and provides the stored received feedback signal value in response to the trigger. The subsequent select storage elements 58 receive the stored value from the previous select storage element 58 and both store the received stored value and provides the received stored value in response to the trigger. An AND gate (or equivalent circuit) selects a combination of the stored values or the inverse of the stored values in the select storage elements 58. The enable signal 45 is combined with the stored data signals 52 in the enabled drivers 64, for example with an AND gate (or equivalent circuit) receiving the inverted outputs of the select storage elements 58, to control the driver (a transistor) to produce the drive signal 62.

Figure 3C:
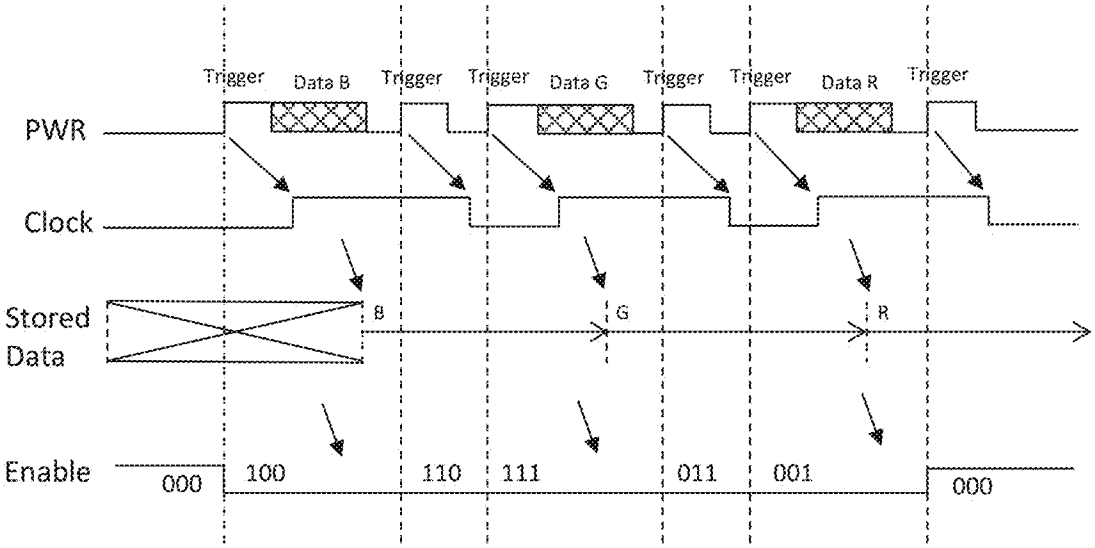
FIG. 3C is a timing diagram for the FIG. 3B circuit.

Referring to FIG. 3C, the timing circuit 80 and data storage circuit 50 are controlled as described with respect to FIG. 2C. The select circuit 90 is only active when all of the three select storage elements 58 store a zero value (low). In an initial state (e.g., a power-up or clear state), all of the select storage elements 58 are set at zero (low state). In that state, the feedback signal connecting the output of the last select storage element 58 in the series of select storage elements 58 is high so that the first trigger will shift a high value into the first select storage element 58. This is illustrated in FIG. 3C by indicating the stored values of the select storage elements 58 transitioning from 000 (the only state in which the enable signal 45 is high) to 100 (for which the enable signal 45 is low). The feedback signal is still high, so the next trigger changes the state of the serial shift register to 110. Again, the feedback signal is still high, so the next trigger changes the state of the serial shift register to 111. At the next trigger, the feedback signal is low, so the next trigger enters a 011 state, followed by a 001, and then a 000, to complete the cycle and bringing the enable signal 45 high again. Thus, the enable signal 45 is low (not enabled) during the time in which the data signals 42 are loaded into the data storage elements 54. This prevents the light emitters 70 from emitting light during the load process and prevents the stored data signals 52 from driving the light emitters 70 to emit the wrong color of light. Otherwise, the first data value (e.g., blue) is output from the red emitter after the first load cycle and the first and second data values (e.g., blue and green) are output from the green and red light emitters 70 after the second load cycle. It is only after the third load cycle that the stored data signals 52 are stored in the appropriate data storage elements 54 and drive the enabled drive circuits 64 to emit light of the appropriate color from the light emitters 70. Hence, the select circuit 90 and enabled drive circuits 64 prevent erroneous light emission (at the cost of a blanking interval).

Figure 4A:
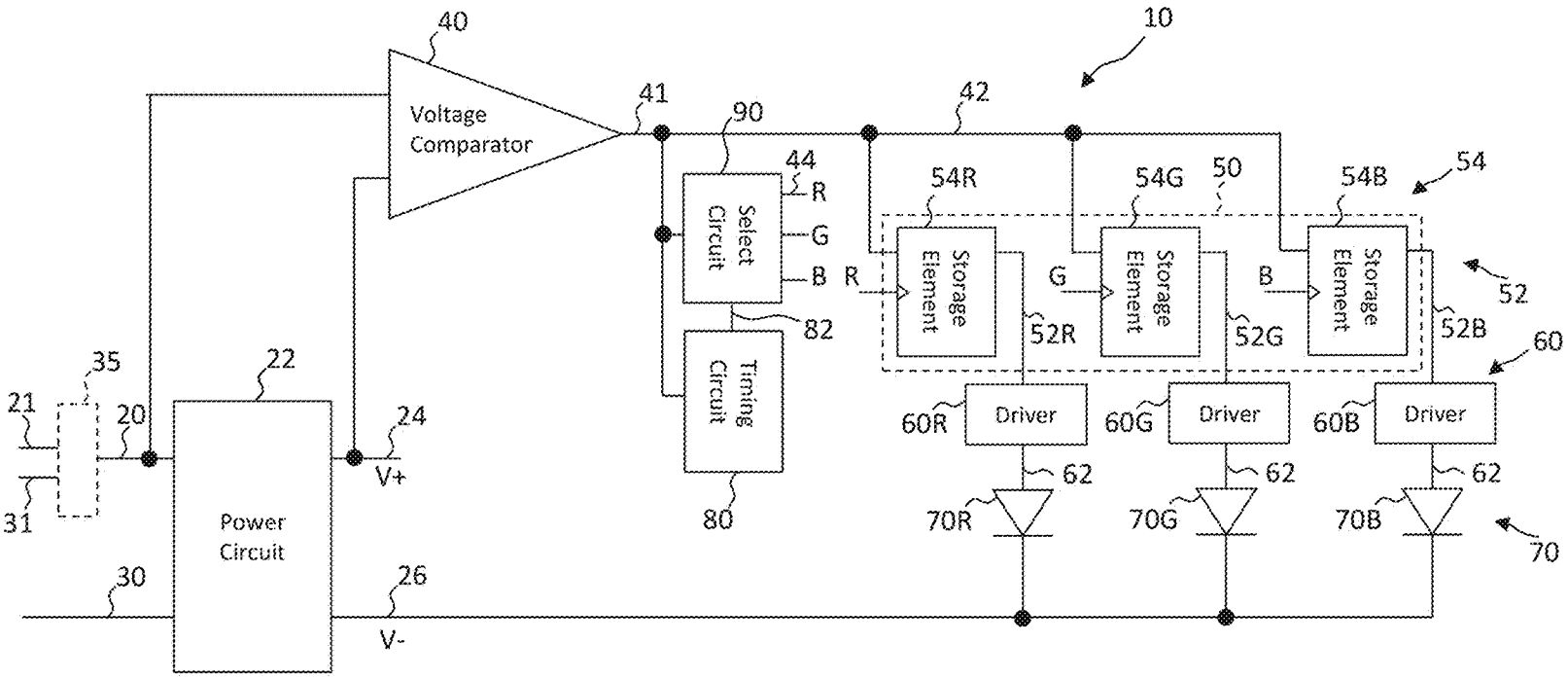
FIG. 4A is a schematic illustration of an embodiment of the present invention having a select function.
Figure 4B:
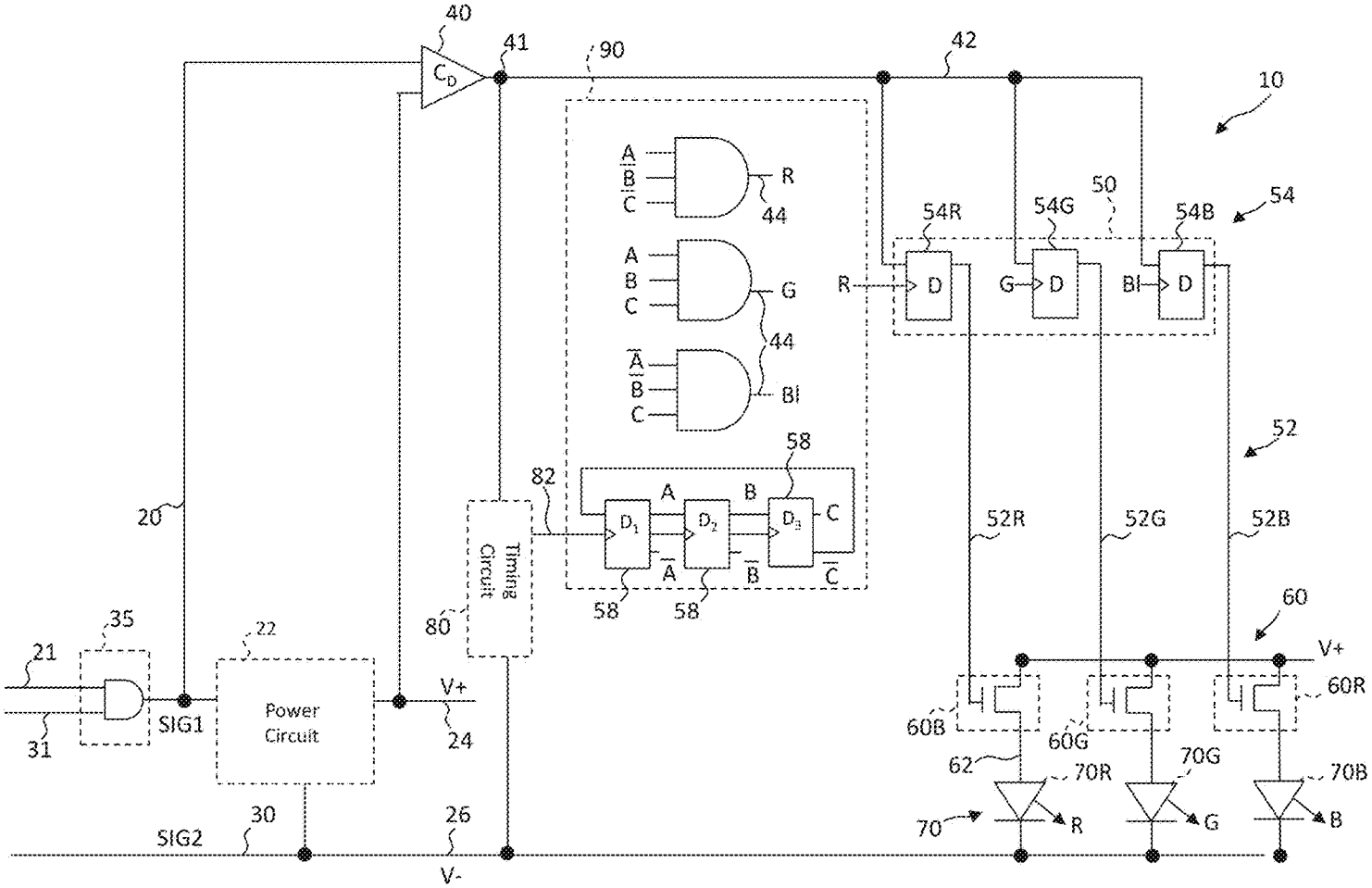
FIG. 4B is a circuit diagram of the FIG. 4A schematic illustration.

FIGS. 4A and 4B illustrate an alternative approach to preventing erroneous light emission. As shown in FIGS. 4A and 4B, the select circuit 90 is driven by both the data signal 42 (trigger) and the timing circuit 80 to produce a plurality of select signals 44, i.e., R, G, and B, that each act as a clock to latch the corresponding data storage element 54R, 54G, and 54B. The inputs of the data storage elements 54 are all connected in common to the data signal 42. When the data signal 42 is applied to the inputs of the data storage elements 54, the corresponding select signal 44 is activated to latch the data storage element 54 corresponding to the data signal 42. The appropriately stored data signal 52 is then applied to the corresponding drive circuit 60 and light emitter 70. The remaining circuit elements are the same as described for FIGS. 3A and 3B.

Referring to FIG. 4B, the select storage elements 58 are connected as described with respect to FIG. 3B or FIG. 2B. However, the output of the select storage elements 58 (designated A, B, C) are combined in different combinations with an AND gate (or equivalent circuit) for each combination, each combination specific to one of the data storage elements 54R, 54G, and 54B. The inputs to the AND gates are designated as letter A, B, or C or A, B, or C with a bar above the letter to indicate the inverse value. The output of the AND gates are select signals 44 that serve as clock signals to latch the data signal 42 into the corresponding data storage element 54.

Figure 4C:
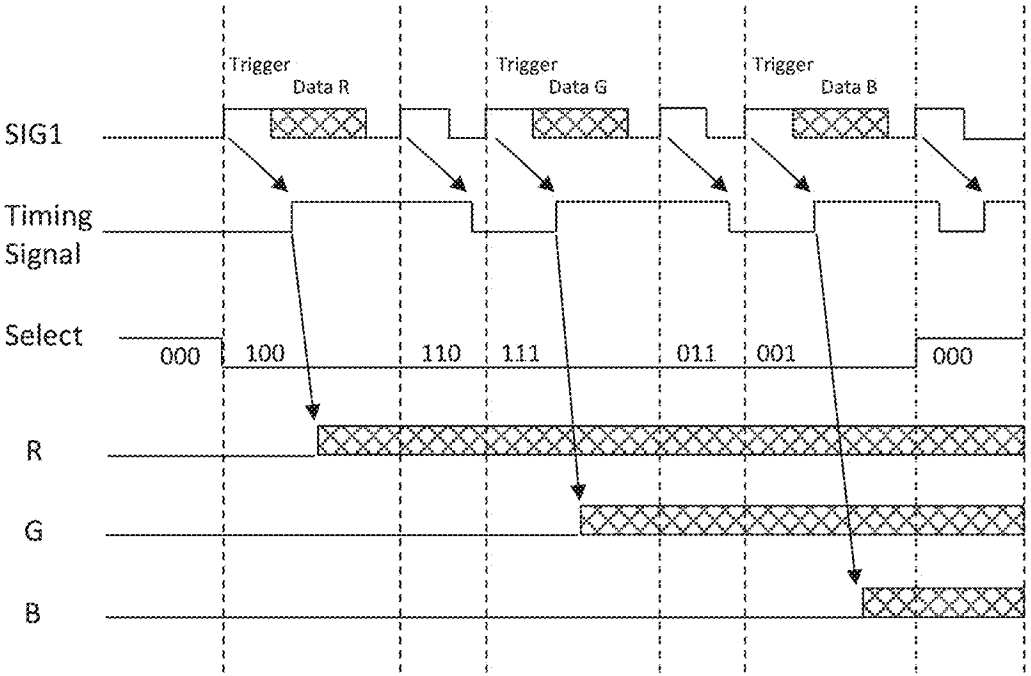
FIG. 4C is a timing diagram for the FIG. 4B circuit.

Referring also to FIG. 4C, the timing signal 82 is provided as described with respect to FIGS. 2B and 3B. Similarly, the select storage elements 58 are connected and provide a state machine as described with respect to FIG. 3B. However, rather than providing a single enable signal 45 with an AND gate corresponding to a single 000 state as illustrated in FIG. 3B, an AND gate (or equivalent circuit) for each of the data storage elements 54 provides a select signal 44 that is a clock for each of the data storage elements 54. The select (clock) signal 44 for the red data storage element 54R transitions high when the select storage elements 58 are in the state 100 and the delayed timing signal 82 transitions high. The select (clock) signal 44 for the green data storage element 54G transitions high when the select storage elements 58 are in the state 111 and the delayed timing signal 82 transitions high. The select (clock) signal 44 for the blue data storage element 54B transitions high when the select storage elements 58 are in the state 001 and the delayed timing signal 82 transitions high. Thus, the correct data signal 42 is loaded into only the correct data storage element 54 so that there is no need for a blanking interval as provided by the enable signal 45 of FIG. 3B, improving the overall light output of the two-terminal store-and-control circuit 10.

The circuit designs of FIGS. 1A-4B employ a single modulated first signal 20 to provide a data signal 42 and a timing signal 82 derived from the data signal 42. In an alternative embodiment of the two-terminal store-and-control circuit 10, both the first signal 20 and the second signal 30 are modulated to provide data signals on both the power and ground connections. In this embodiment, the V− signal 26 is modulated but the voltage differential between the V+ signal 24 and the V− signal 26 remains relatively constant, providing a relatively stable voltage differential and control or data signals for the two-terminal store-and-control circuit 10. Thus, in this embodiment, the second signal 30 is a modulated second signal 30. Note that although the data signal 42 and the select signal 44 are provided with particular names, the data and select signals 42, 44 can be used for purposes other than those suggested by their names.

Figure 6A:
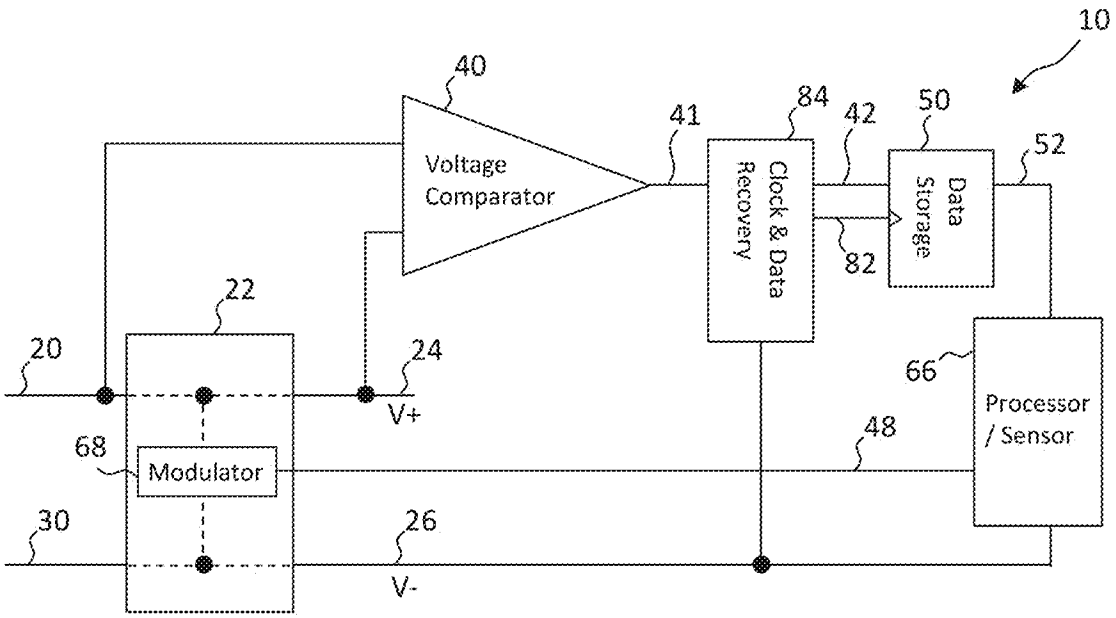
FIG. 6A is a schematic illustration of an embodiment of the present invention having output signals.

The two-terminal store-and-control circuit 10 can be used to control the drive circuit 60 and light emitters 70 as indicated in FIGS. 2A, 2B, 3A, 3B, 4A, and 4B. In an alternative embodiment and as illustrated in FIG. 6A, a processor or sensor circuit 66 (for example a digital processing circuit provided in an integrated circuit chiplet 14 such as a state machine or stored program machine) is connected to the stored data signal 52 and processes the stored data signal 52 to provide a processed output signal 48 that can be a drive signal used to control an indicator. The indicator can be an optical indicator or other output modality, such as a magnetic or electrical field, or a thermal device. In an alternative embodiment, the two-terminal store-and-control circuit 10 includes a sensor for sensing an environmental attribute to provide the output signal 48, or a touch sensor for sensing a touch to provide the output signal 48. In certain embodiments, the sensor receives stored data signals 52, for example for controlling the sensor.

Figure 6B:
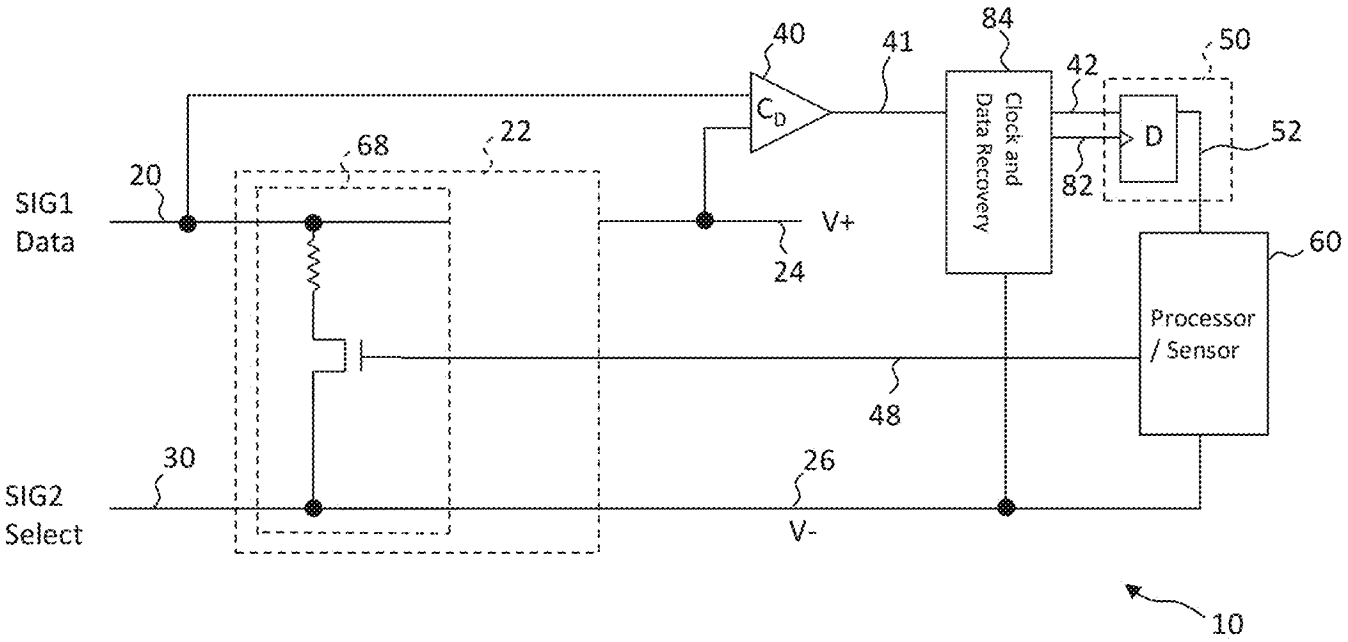
FIG. 6B is a circuit diagram of the FIG. 6A schematic illustration.

As shown in FIGS. 6A and 6B, in an alternative embodiment of the present invention, a clock and data recovery circuit 84 provides the timing signal 82 and provides an improved, noise-reduced data signal 42. In this embodiment, the clock and data recovery circuit 84 can be a timing circuit 80 or a part of the voltage comparator 40 circuit, or both. In this embodiment, the voltage comparator 40 produces the comparison signal 41 and the clock and data recovery circuit 84 further processes the comparison signal 41 in combination with the modulated second signal 30 to provide the data signal 42. In one embodiment, an RC oscillator provides an oversampled clock signal operating at a high frequency (for example 3-20 times the frequency of the data signal 42). A counter is used to determine the bit length and a digital comparator (for example a register and optionally part of a counter) is set to the number of clock signals necessary to sample the data signal 42 at the approximate center of the data signal 42 duration. Several samples can be taken and averaged to reduce the likelihood of an error.

In the embodiment of the present invention illustrated in FIGS. 6A and 6B, the clock and data recovery circuit 84 is used to provide the data signal 42 from the comparison signal 41 and produce the timing signal 82 from the modulated first signal 20 and modulated second signal 30. This circuit has the advantage of providing good common-mode rejection when both the first and second signals 20, 30 are modulated simultaneously. In a variety of different embodiments, a variety of different clock and data recovery circuits 84 are incorporated into the two-terminal store-and-control circuit 10 of the present invention.

Figure 16A:
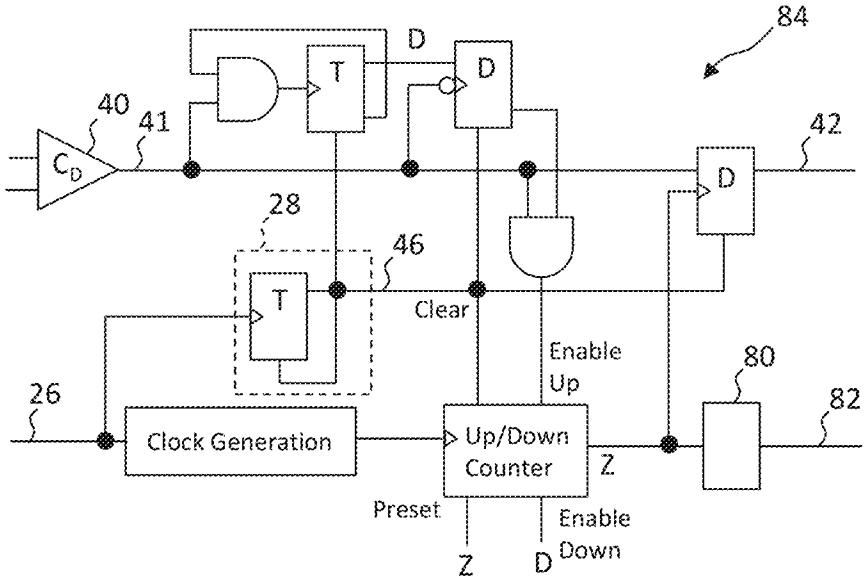
FIG. 16A is a schematic illustration of a clock and data recovery functional diagram and FIG. 16B is corresponding timing diagram according to an embodiment of the present invention.
Figure 16B:
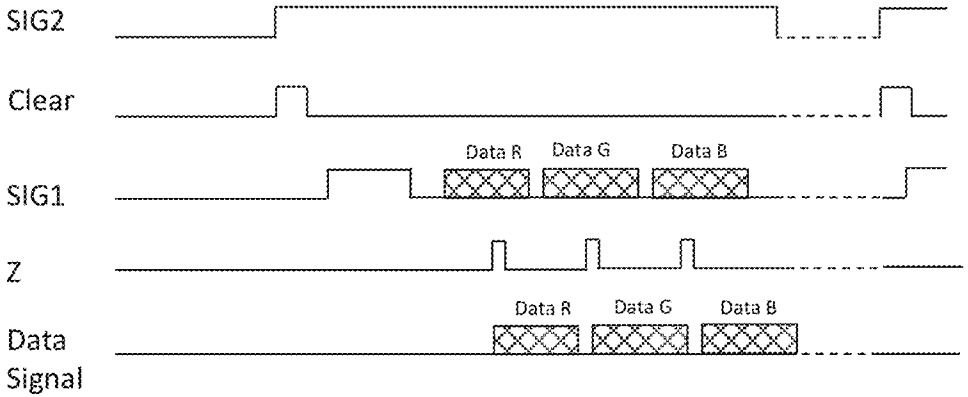

Referring to the circuit diagram of FIG. 16A and the timing diagram of FIG. 16B, an embodiment of a clock and data recovery circuit 84 is functionally illustrated. As shown in FIG. 16A, the modulated second signal 30 is used as an enable signal that enables a clock generation circuit, for example an oscillator. The modulated second signal 30 also drives a T flip-flop to provide a clear signal pulse. The output of the T flip-flop switches high and then clears the T-flip-flop and returns low. The clear signal pulse clears an up/down counter, a T-flip-flop and two D Flip-flops. The clear signal pulse can also clear the data storage circuit 50 and any select storage elements 58, or any other storage element desired in the two-terminal store-and-control circuit 10 of the present invention. An up/down counter has a clear input that sets the internal counting register to zero, an enable up input That enables the up/down counter to count up, an enable down input that enables the counter to count down, and a preset input that sets the up/down counter back to the originally loaded data value. Thus, counting down the up/down counter does not lose the loaded value. The up/down counter can include multiple counters, registers, and logic circuits to enable the functionality described and can be designed using digital logic circuits.

After clearing the T flip-flop, the D output is low and the inverted output is high and is combined with the comparison signal from the voltage comparator 40. When the voltage comparator 40 produces a high comparison signal 41, it is combined with the inverted T flip-flop output to toggle the T flip-flop. The associated D flip-flop has an inverted output high that is combined with the voltage comparator 40 output to enable up counting. The up/down counter responds to the clock from the clock generation circuit to count up as long as the voltage comparator 40 value remains high. When the voltage comparator 40 comparison value 41 goes low, the associated D flip-flop loads the T flip-flop value D, a one, responding to the inverted comparison signal 41 transition. This disables the up counting of the up/down counter so that the up/down counter has a loaded count value that corresponds to the number of clock cycles in the comparison signal 41 period. The high signal D enables down counting and the up/down counter begins counting down. When it reaches zero, the Z signal latches the comparison signal 41 into the data flip-flop producing the data signal 42. The Z signal also activates the preset signal to reset the up/down counter to the loaded count value and the up/down counter begins counting down again. The Z signal can also be used as an input to a circuit such as the timer circuit 80 to produce the delayed timing signal 82. Thus, the simplified clock and data recovery circuit 84 samples the data stream from the voltage comparator 40 at a specified frequency determined by the period of the initial comparison signal 41 from the voltage comparator 40. Subsequent comparison signals 41 can provide a data bit stream. In an embodiment, the first bit value in the bit stream is delayed or the period of the first bit value in the stream is longer than the periods of the following bits so that the bit values are sampled at the center of the period. Other, more complex circuits can be used to combine multiple samples, find average values, and reduce the influence of the second signal modulations on the V− signal 26.

Figure 16C:
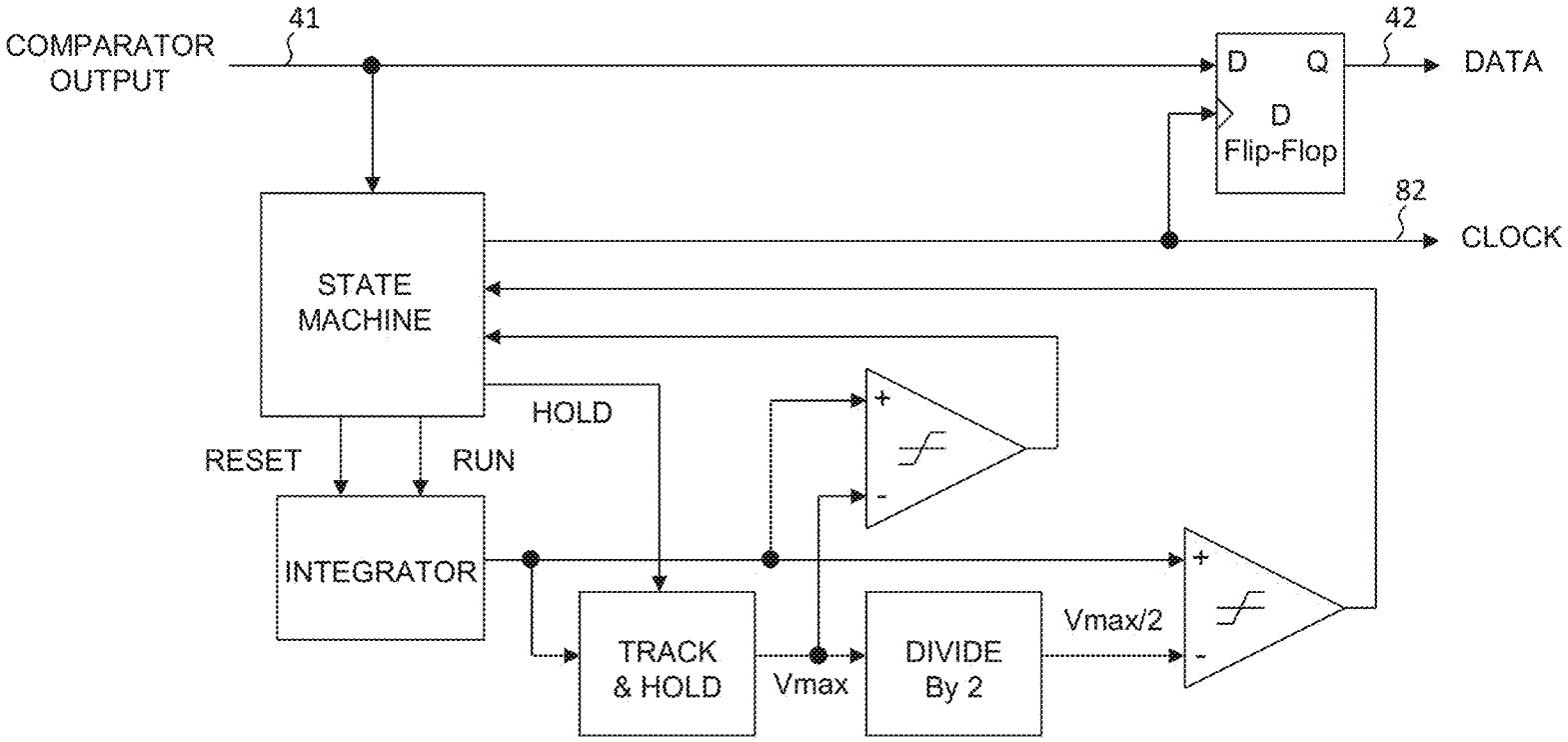
FIG. 16C is a schematic illustration of an alternative clock and data recovery functional diagram and FIG. 16D is corresponding timing diagram according to an embodiment of the present invention.
Figure 16D:
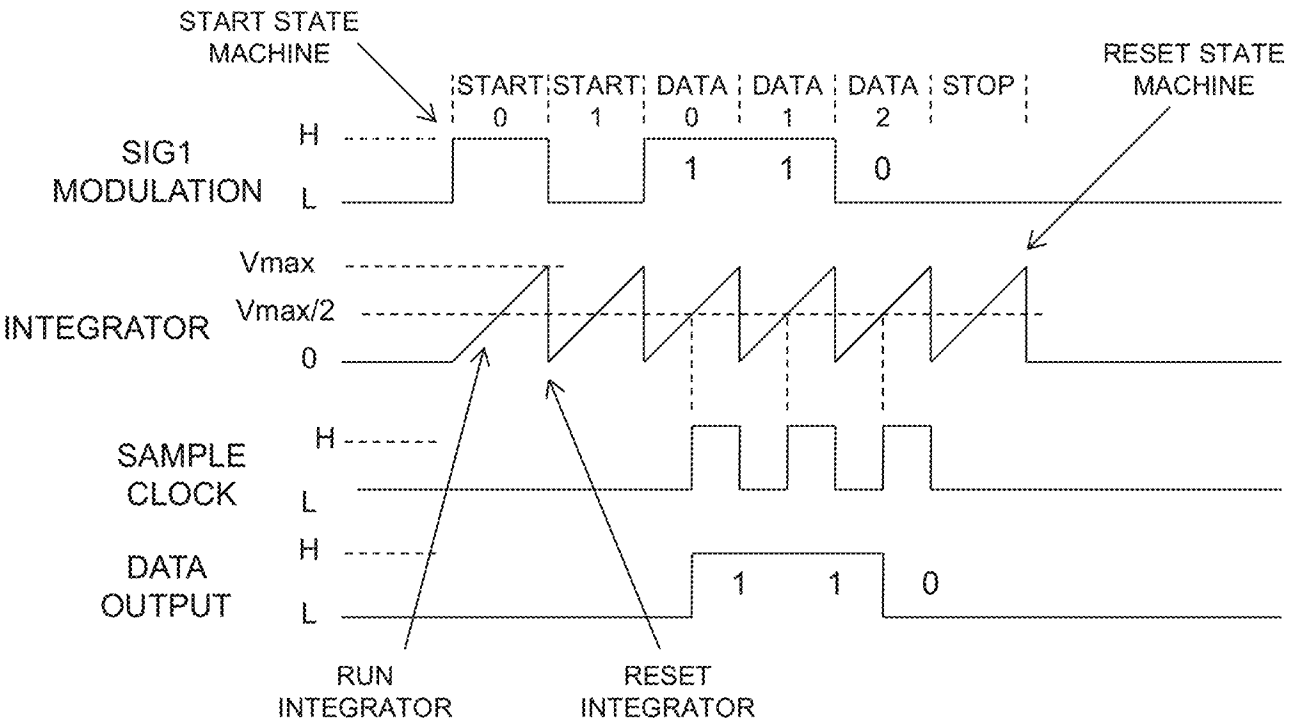

The circuit of FIG. 16C and the timing diagram of FIG. 16D show another embodiment of a clock and data recovery circuit 84. The voltage comparator 40 comparison signal 41 output connects to a state machine and to a D flip-flop. The state machine drives a reset and run input of an integrator. The integrator drives a track & hold circuit which is put into hold mode by the HOLD signal from the state machine. The track & hold output is defined as Vmax or the maximum voltage at the integrator output. Vmax is fed into a voltage divide-by-two circuit to generate the signal Vmax/2. Both the integrator output and Vmax/2 feed the second comparator. The second comparator output is used by the state machine to generate the recovered data clock which is also used to drive the D flip-flop to sample the comparator output data 41 at the recovered clock rising edge. The integrator output and Vmax are fed as inputs to a third comparator used to sense when the integrator output has reached the Vmax level and acts to clear the clock. The third comparator output feeds back to the state machine. The system recovers data from a data stream that starts with two start bits with a logic 1 followed by a logic 0 sequence, a known number of data bits and a stop bit defined as a logic 0.

Referring to FIG. 16D, assuming that the state machine is reset which also resets the integrator to its zero level, the operating cycle starts when input data switches from a low, logic 0, to high, logic 1, state. At this time the state machine puts the integrator into its run condition and its output voltage starts to ramp up and the HOLD signal is low causing the track & hold to track the integrator output. When the falling edge of the start bit occurs, the state machine sets the HOLD signal causing the track & hold to hold the maximum level of the integrator. The integrator is reset at this time, the RUN signal is set, and the integrator starts a new ramp that terminates when the integrator output has reached Vmax as detected by the third comparator. The ramp sequence repeats until the stop bit has been executed. All timing after the first start bit is completely defined by the integrator and the start-bit-defined Vmax level. After the second start bit ramp is complete, the first data bit is expected. When the integrator voltage reaches Vmax/2, the second comparator output switches high and the state machine sets the output clock high. The D flip-flop then acquires the first voltage comparator comparison signal 41 output data and presents it as the recovered data 42 to other circuits. The ramp continues and when the integrator voltage reaches Vmax, the third comparator output switches high and the clock signal is cleared. The operation repeats for each data bit. After the last data bit, the state machine holds the clock in its low state and starts the ramp for the stop bit. When the integrator output reaches the Vmax level the third comparator switches high and indicates to the state machine that the stop bit is complete and causes the state machine to be reset and await a new start bit. In this way, the circuit is self-resetting after a sequence of data has expired and does not require an explicit reset input. Placing the data sampling point in the center of the expected bit minimizes data errors due to limitations in timing accuracy for long bit sequences.

Implementation of this circuit in mixed-signal integrated form results in very low current consumption and small circuit area.

The circuit of FIGS. 6A and 6B drive an output modulated first, or second signal 20, 30 rather than an indicator. Rather than controlling an indicator such as an LED, the two-terminal store-and-control circuit 10 of FIGS. 6A and 6B output information using a modulator circuit 68. The modulator circuit 68 can be a part of the power circuit 22 (as shown) or separate from the power circuit 22. The output information is provided across the modulated first signal 20 and the second signal 30 by connecting the output signal 48 to the gate of a transistor such as an NMOS transistor in series with an optional resistor. Thus, in an embodiment, the two-terminal store-and-control circuit 10 further includes a modulator circuit 68 for modulating the second signal 30 responsive to the output signal 48 to provide a modulated output second signal 30, for modulating the first modulated signal 20 responsive to the output signal 48 to provide a modulated output first signal 20, or for modulating the first modulated signal 20 and the second signal 30 responsive to the output signal 48 to provide a modulated output first signal 20 and a modulated output second signal 30. The signal can be detected either as a voltage signal or a current signal.

Figure 6C:
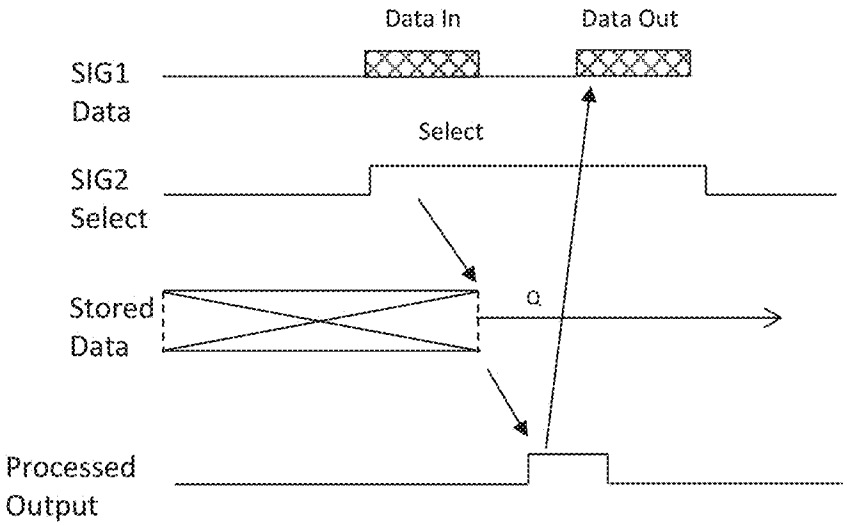
FIG. 6C is a timing diagram for the FIG. 6B circuit.

Since the modulated first and second signals 20, 30 are also externally modulated to provide input signals to the two-terminal store-and-control circuit 10, the modulated first and second signals 20, 30 provided by the two-terminal store-and-control circuit 10 are provided for example at a different delayed time to avoid interference between input and output signals. Referring to FIG. 6C, a data signal 42 is provided and a select signal 44 provided after the data storage circuit 50 setup time to latch the data signal 42 into the data storage circuit 50 and then provide the stored data signal 52 after the latch time. The stored data signal 52 is provided to the processor circuit 66 and then, after the first and second signal 20, 30 modulation is no longer present (i.e., the first and second signals 20, 30 are no longer externally modulated), the processor/sensor circuit 66 provides one or more processed output signals 48 that drives the modulator circuit 68 to modulate the first or second (or first and second) signals 20, 30.

As illustrated in FIGS. 6B and 6C, the processor circuit 66 provides a processed output signal 48. The processed output signals 48 is provided to the modulator circuit 68 to modulate the first and second signals 20, 30. In the embodiment of FIG. 6C, the processed output signal 48 can be a select or an enable signal for an external circuit that latches the processed output signal 48 modulating the first signal 20 (just as does the two-terminal store-and-control circuit 10). Hence, the external circuit providing signals to the two-terminal store-and-control circuit 10 can have a circuit complementary or similar to that of the two-terminal store-and-control circuit 10.

A variety of modulator circuits 68 can be employed in the present invention. As shown in FIG. 6B, a transistor controlled by the processed output signal 48 and a resistor connected in series between the modulated first signal 20 and the V− signal 26 can modulate the first signal 20, the second signal 30, or both the first signal 20 and the second signal 30 simultaneously. The size of the transistor, the value of the resistor, and the duration of the processed output signal 48 are predetermined to provide the desired modulation. In an alternative arrangement, the circuits illustrated in FIG. 12 and discussed further below can be used to provide modulation.

Figure 7A:
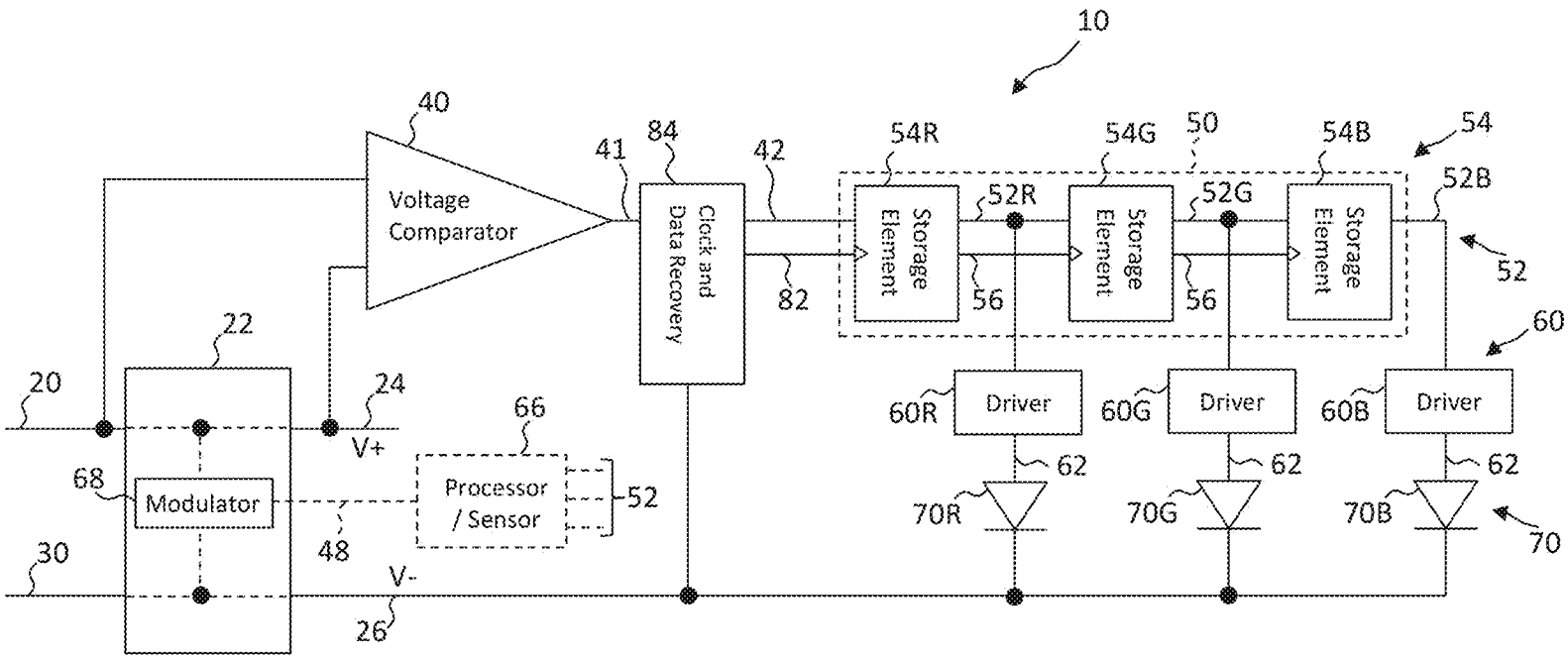
FIG. 7A is a schematic illustration of an embodiment of the present invention having a select input signal.

In another embodiment of the present invention, the two-terminal store-and-control circuit 10 of FIG. 7A includes both first and second modulated signals 20, 30 as in FIG. 6A and the data storage device 50 includes a plurality of data storage elements 54, together with the drive circuits 60 and light emitters 70 of FIGS. 2A and 2B. The data storage elements 54 are serially connected so that the first data storage element 54 receives the data signal 42 and both stores the data signal 42 and provides the stored data signal 52 in response to the timing signal 82 (acting as a clock). The subsequent data storage elements 54 receive the stored data signal 52 from the previous data storage element 54 in the serial sequence and both store the received stored data signal 52 and provide the received stored data signal 52 in response to the select signal 44.

Figure 7B:
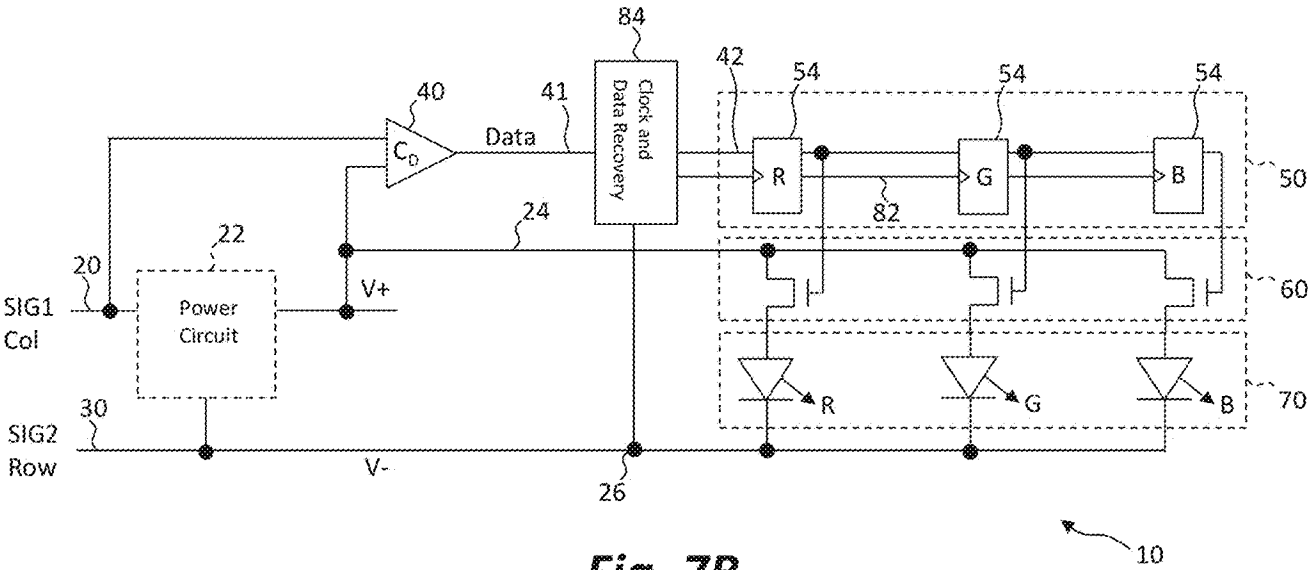
FIG. 7B is a circuit diagram of portions of the FIG. 7A schematic illustration.
Figure 7C:
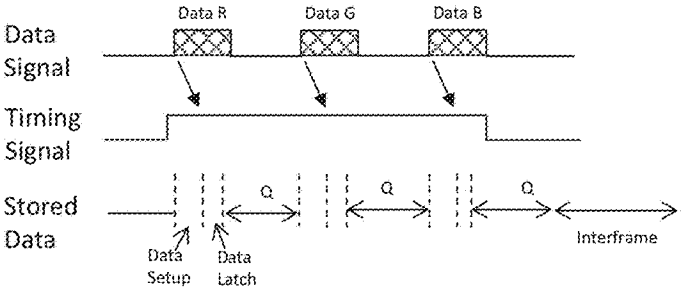
FIGS. 7C and 7D are timing diagrams for the FIG. 7B circuit.
Figure 7D:
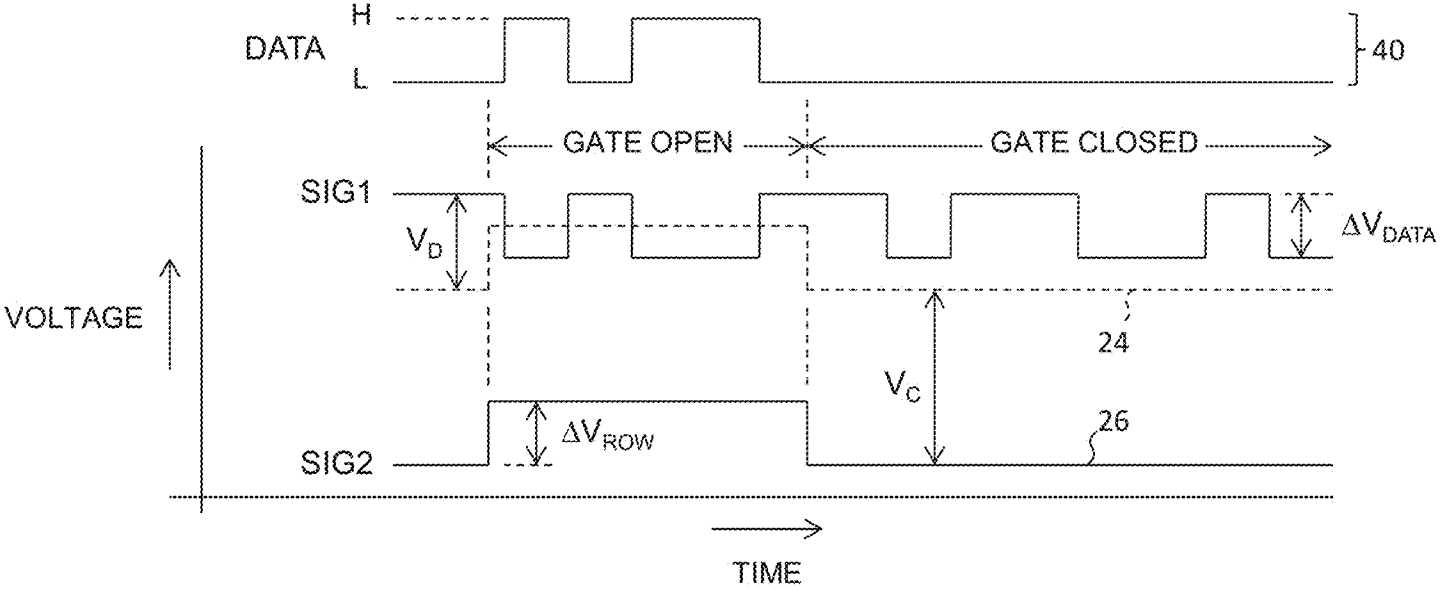

All of the clock inputs of the data storage elements 54 are connected in common to the timing signal 82 so that the serially connected data storage elements 54 form a serial shift register that shifts the data signals 42 through the serially connected data storage elements 54 in response to repeated timing signals 82 as illustrated in FIG. 7C. The timing signal 82 is applied after the data setup time and the data signal 42 is available as a stored data signal 52 Q after the data latch time. Note that this design does not require the double clocking used to control the T flip-flop in the timing circuit 80 of FIG. 2B. Referring to FIG. 7D, the relative voltages of the modulated first and second signals 20, 30, the data signal 42, the V− signal 26, and the V+ signal 24 are illustrated.

FIG. 7A also illustrates a processor or sensor circuit 66 that provides a processed output signal 48 to the modulator circuit 68 in response to the stored data signals 52. The sensor circuit 66 can optionally receive stored data signals 52, for example to provide control. FIG. 7B does not include the processor circuit/sensor circuit 66 or the modulator circuit 68. In this embodiment, the data storage elements 54 can be D flip-flops with a clear control input controlled by the clock and data recovery circuit 84. As with FIG. 1B, the drive circuit 60 can be provided with power directly from the modulated first signal 20 to avoid losses in the power circuit 22.

Figure 8A:
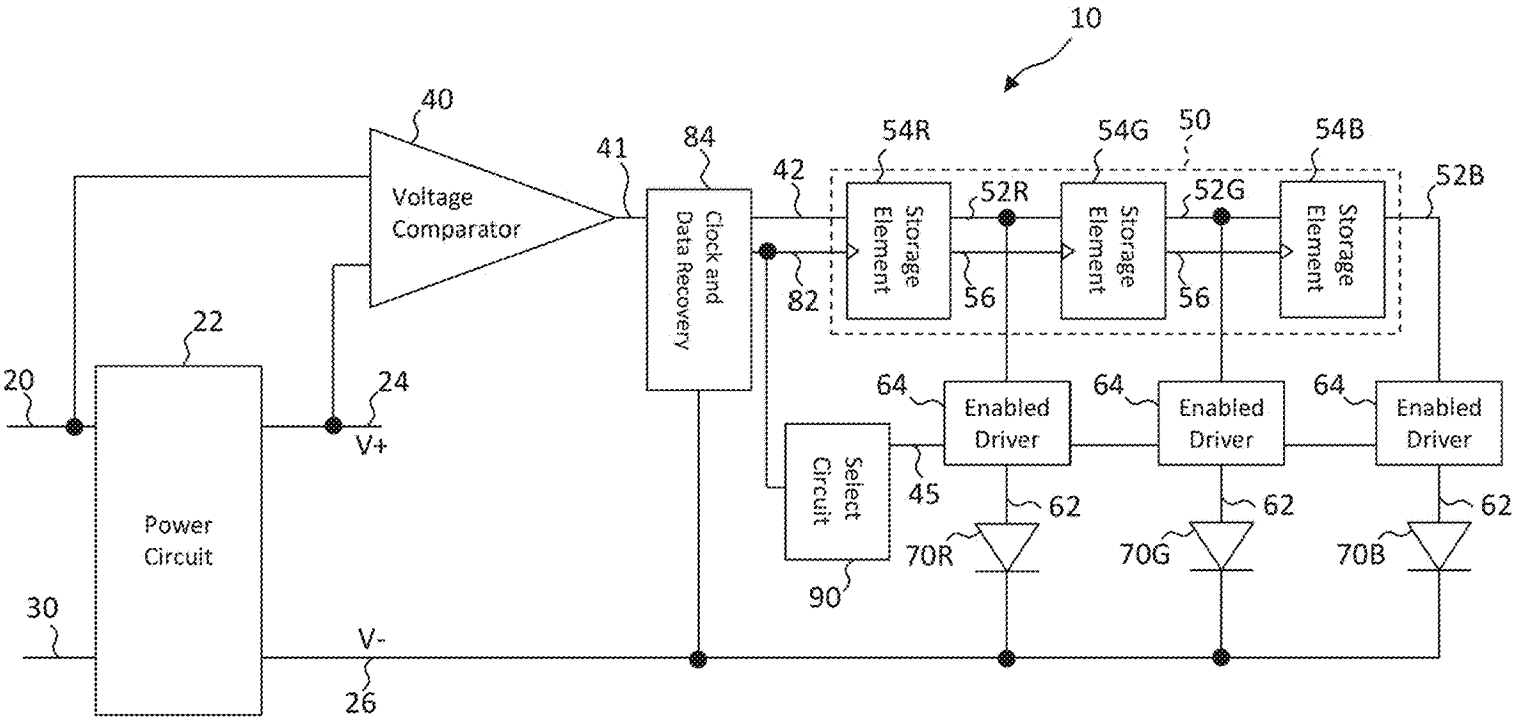
FIG. 8A is a schematic illustration of an embodiment of the present invention having a select input signal and an output enable signal.
Figure 8B:
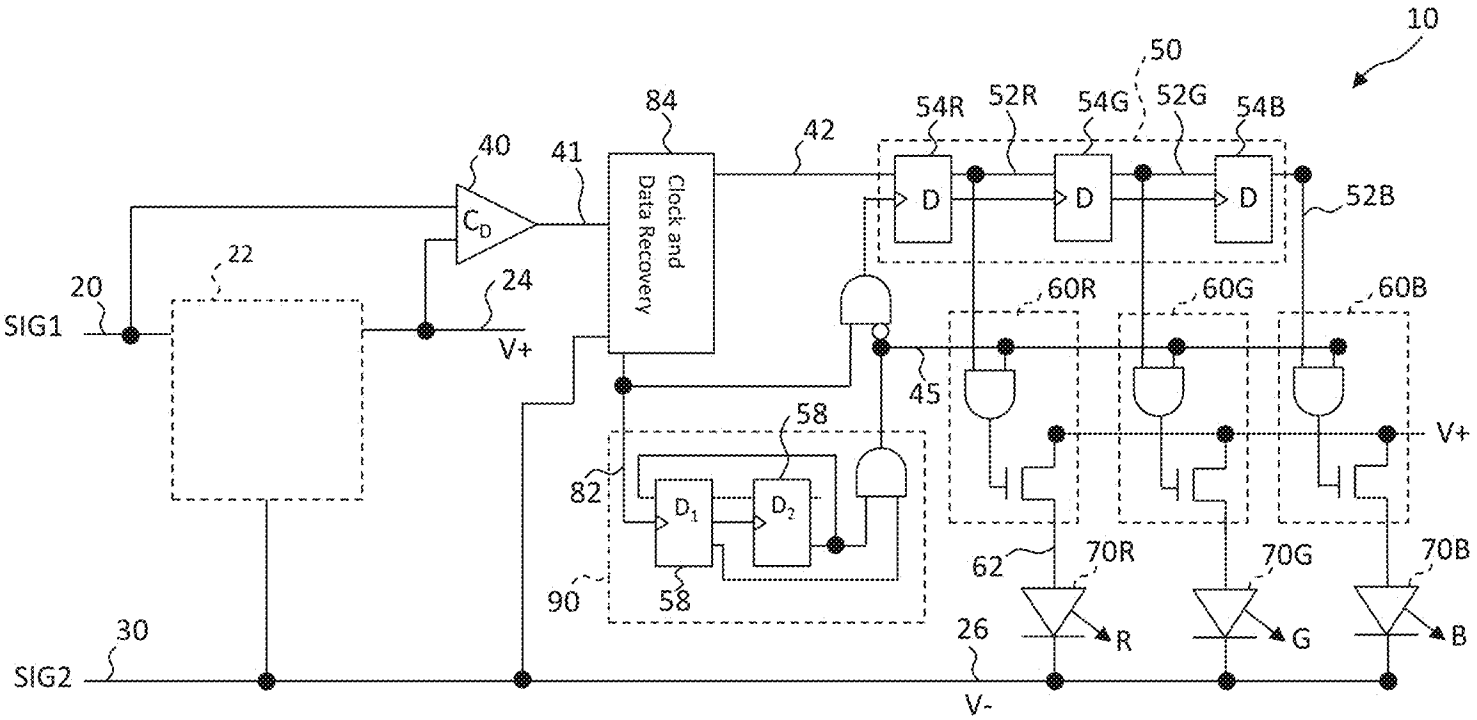
FIG. 8B is a circuit diagram of the FIG. 8A schematic illustration.

The embodiment of FIGS. 8A and 8B includes the clocking circuitry of FIGS. 7A and 7B and a modified version of the enable circuits of FIG. 3B. As shown in FIG. 8A, a select circuit 90 is used to control the light output of the light emitters 70 driven by the enabled drive circuits 64 that produce the drive signal 62. The enabled drive circuits 64 in FIGS. 8A and 8B are the same as the enabled drive circuits 64 of FIG. 3B. As in FIG. 3B, the select circuit 90 of FIG. 8A provides an enable signal 45 connected to the enabled drive circuits 64. However, in FIG. 8B, the state machine forming the select circuit 90 includes only two serially connected select storage elements 58 with the inverted output of the second select storage element 58 connected to the input of the first select storage element 58 and common clocks connected to the timing signal 82. Thus, the select circuit 90 comprises a plurality of serially connected select storage elements 58 for storing a value, the first select storage element 58 for receiving the inverse of the stored value of the last select storage element 58 in the series and for both storing the received value and providing the stored received value in response to the data signal 42. The subsequent select storage elements 58 receive the stored value from the previous select storage element 58 and both store the received stored value and provide the received stored value in response to the data signal 42. Thus, each enable signal 45 (in this case only one) is combined with the stored data signal 52 of one or more of the plurality of data storage elements 54 in the enabled drive circuits 64.

Figure 8C:
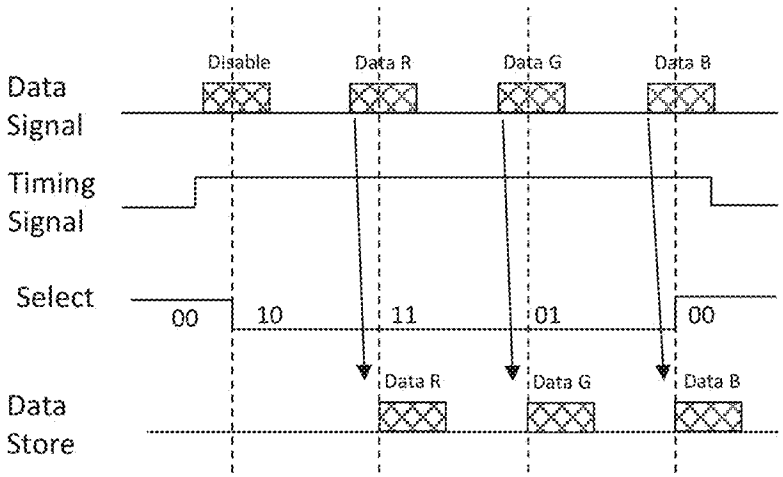
FIG. 8C is a timing diagram for the FIG. 8B circuit.

The enable signal 45 is active when both of the select storage elements 58 store a zero value. The select storage elements 58 can be D flip-flops or digital latches and can be placed in an initial state using the clear control circuit illustrated in FIG. 7B. As successive data signals trigger the select storage elements 58, the select storage elements 58 cycle through the states illustrated in FIG. 8C: 00, 10, 11, 01, 00, 10, etc. Data signals 42 are shifted into and through the data storage elements 54 in response to the enable signal 45 as the select circuit 90 cycles through the 10, 11, 01 states and the enable signal 45 is not active, providing a blanking interval similar to that of FIG. 3B. An initial data signal 42 shifts the select circuit 90 out of the 00 state and inactivates the enable signal 45 without shifting additional data into the data storage elements 54, thus preventing inappropriate light output, for example when a blue value is stored in a red or green data storage element 54R, 54G as subsequent data signals 42 are loaded in response to the timing signals 82. The duration of the timing signal 82 must be matched to the characteristics of the select circuit 90 in this simple example. More complex select circuits 90 can be less dependent on the relative timing of circuit signals. As with FIG. 1B, the enabled drive circuit 64 can be provided with power directly from the modulated first signal 20 to avoid losses in the power circuit 22.

Figure 9A:
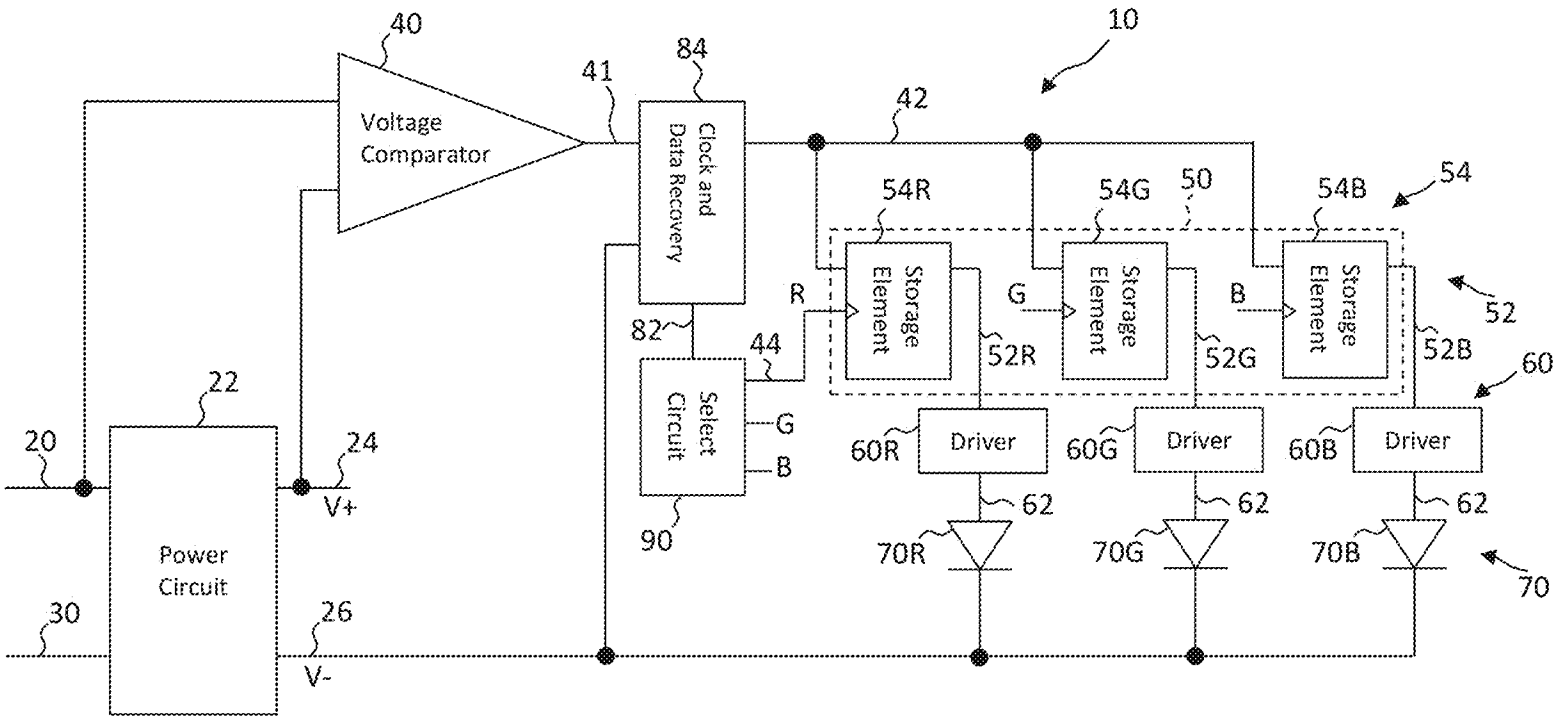
FIG. 9A is a schematic illustration of an embodiment of the present invention having a select input signal and storage element clocks.
Figure 9B:
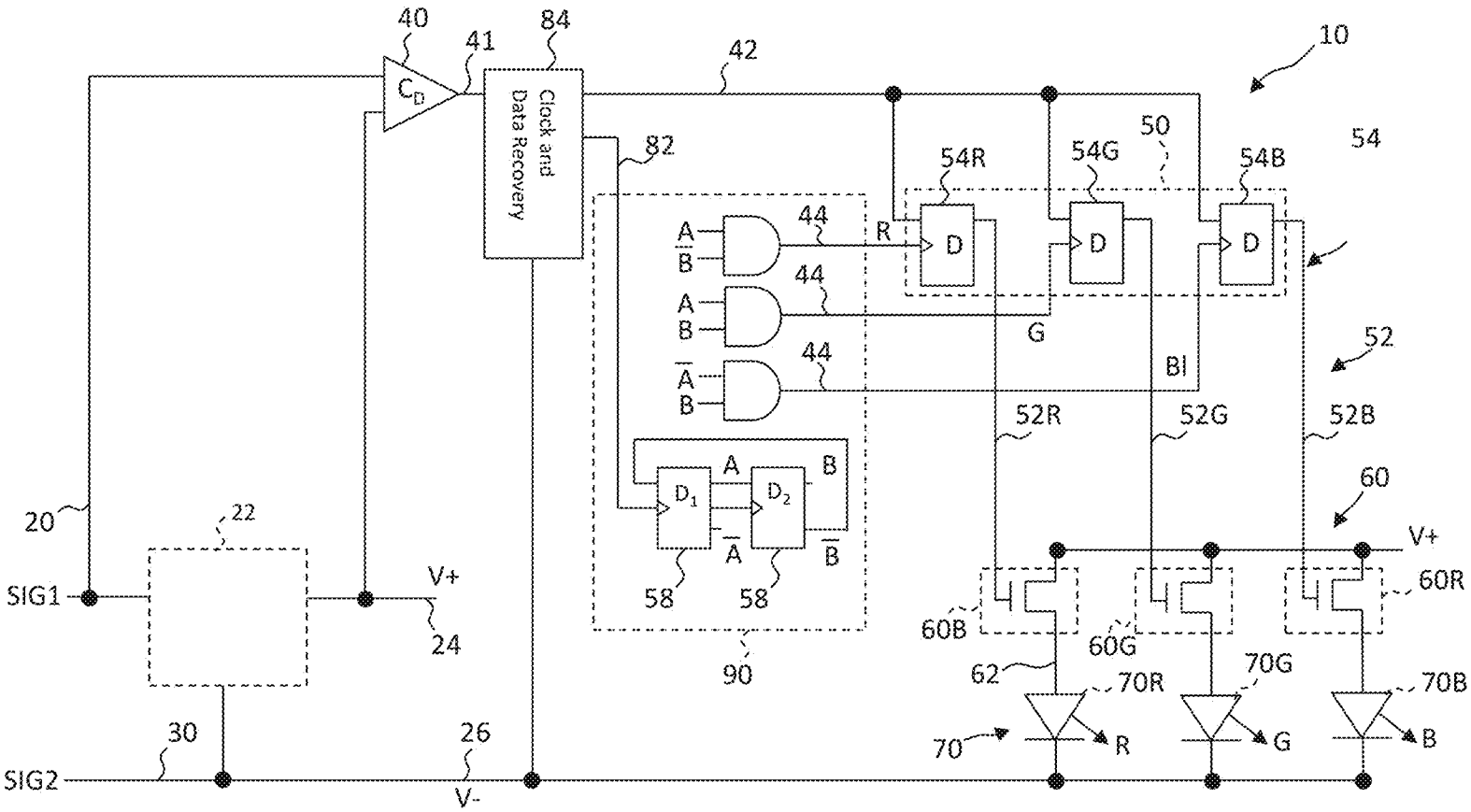
FIG. 9B is circuit diagram of the FIG. 9A schematic illustration.

Referring next to FIGS. 9A and 9B, the data signals 42 can be directly loaded into the appropriate data storage element 54 just as in FIGS. 4A and 4B. As in FIGS. 4A and 4B, the inputs of the data storage elements 54 are connected in common to the data signal 42. A select circuit 90 responsive to the timing signal 82 provides select signals 44 that serve as clock signal to latch the data storage elements 54 corresponding to the particular data signal 42. Each select signal 44 corresponds to one or more of the plurality of data storage elements 54 and each select signal 44 is responsive to a different combination of the select circuit 90 states (either a positive or negative signal corresponding to the state such as a D flip-flop output or inverted output). Thus, in this embodiment, the data storage elements 54 are connected in parallel so that each of the data storage elements 54 receives the data signal 42 in common and both stores the data signal 42 and provides the stored data signal 52 in response to the corresponding select signal 44.

Figure 9C:
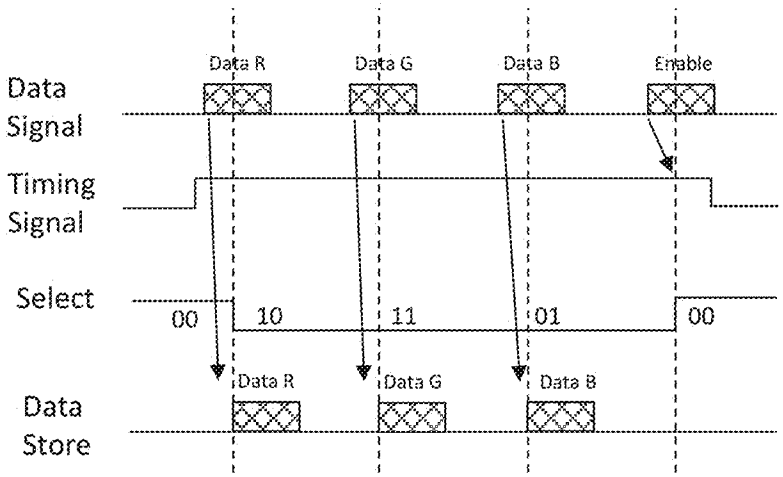
FIG. 9C is a timing diagram for the FIG. 9B circuit.

In FIG. 9B, the AND gates select the appropriate positive or negative stored value of each of the two select storage elements 58 and the select signal 44 to latch the data signal 42 into the corresponding data storage element 54. The control circuit 28 can provide a clear control signal 46 to the select storage elements 58 (and a clear control, not shown to the data storage elements 54). As with FIG. 1B, the drive circuits 60 can be provided with power directly from the modulated first signal 20 to avoid losses in the power circuit 22. FIG. 9C illustrates the same time sequence as in FIG. 8C, except that the select circuit 90 provides a select signal 44 and clock signal that latches the data signal 42 into the data storage elements 54. The select storage elements 58 operate as described with respect to FIG. 8B.

The two-terminal store- and control circuit 10 can further include a control circuit 28 for receiving the data signal 42, for receiving the second signal 30, or for receiving a combination of the first and second signals 20, 30, and for providing a control signal 46 that is temporally delayed from the first and second signals 20, 30 and is received by the select storage elements 58 to clear the select storage elements 58.

More generally, a two-terminal store-and-control circuit 10 of the present invention can include a control circuit 28 for receiving the data signal 42, the second signal 20, or a combination of the data and second signals 42, 20, and can provide a control signal 46.

In yet another embodiment, the data signal 42 is a first data signal, the select signal 44 is a second data signal, and the data storage circuit 50 is a first data storage circuit and the two-terminal store-and-control circuit 10 further comprises a second data storage circuit 50 (not shown) for receiving and storing the second data signal that provides a second stored data signal output (not shown). In this embodiment, the data storage circuit 50 is duplicated to store the data communicated with the modulated second signal 30 (the select signal 44).

The designs illustrated in any one of FIGS. 1A-9C can employ positive or negative logic, and can be constructed with one or more discrete electronic components, one or more integrated circuits, or both. The various elements of the various illustrated designs can be divided in various ways between one or more discrete or one or more integrated circuits, including micro-transfer printable chiplets 14 or micro-transfer printable discrete components. For example, the resistor and capacitors illustrated can be provided with discrete components while the active elements, such as the transistors or logic circuits are implemented with one or more integrated circuit components.

Figure 21A:
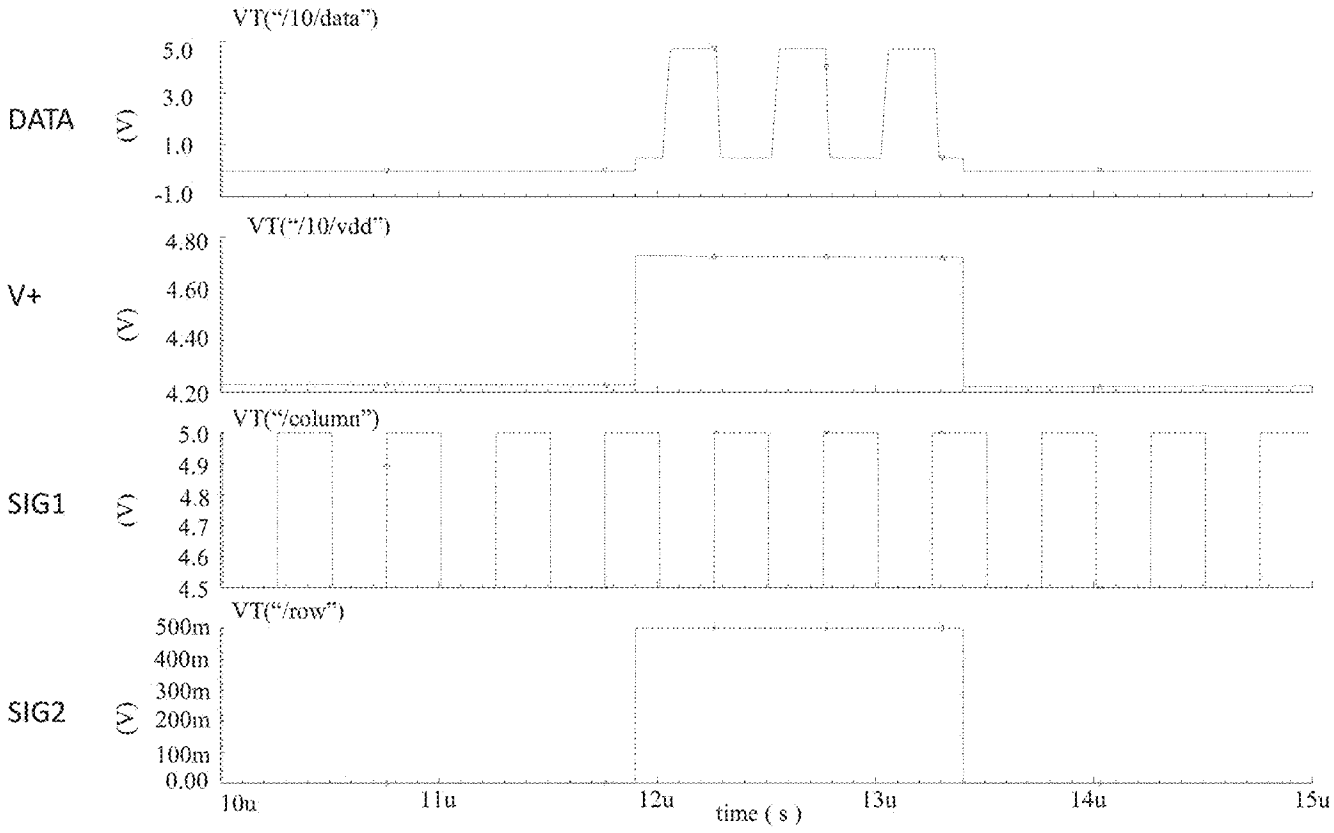
FIGS. 21A, 21B, 22A, and 22B are graphics illustrating simulation results for embodiments of the present invention.
Figure 21B:
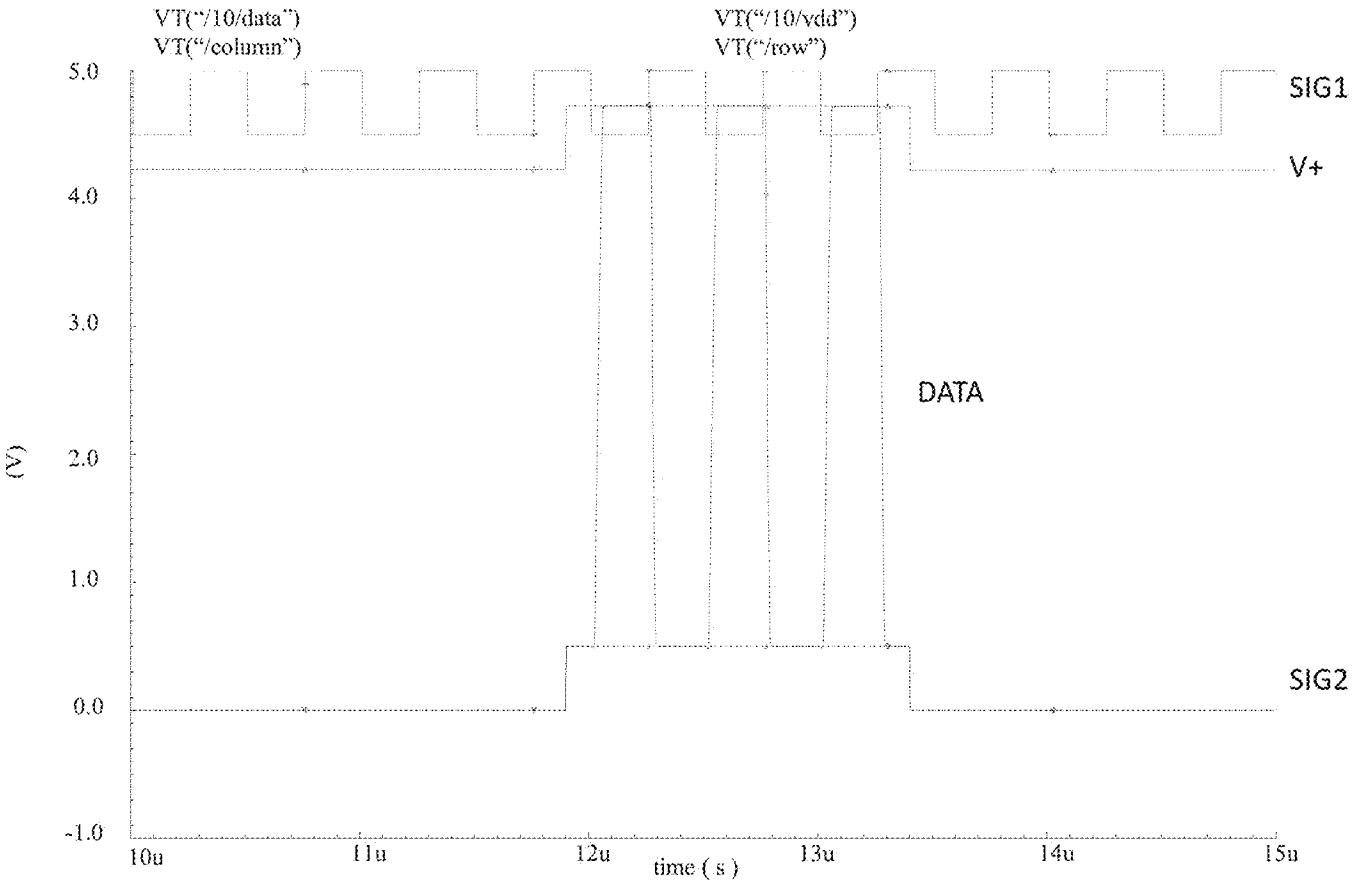
Figure 22A:
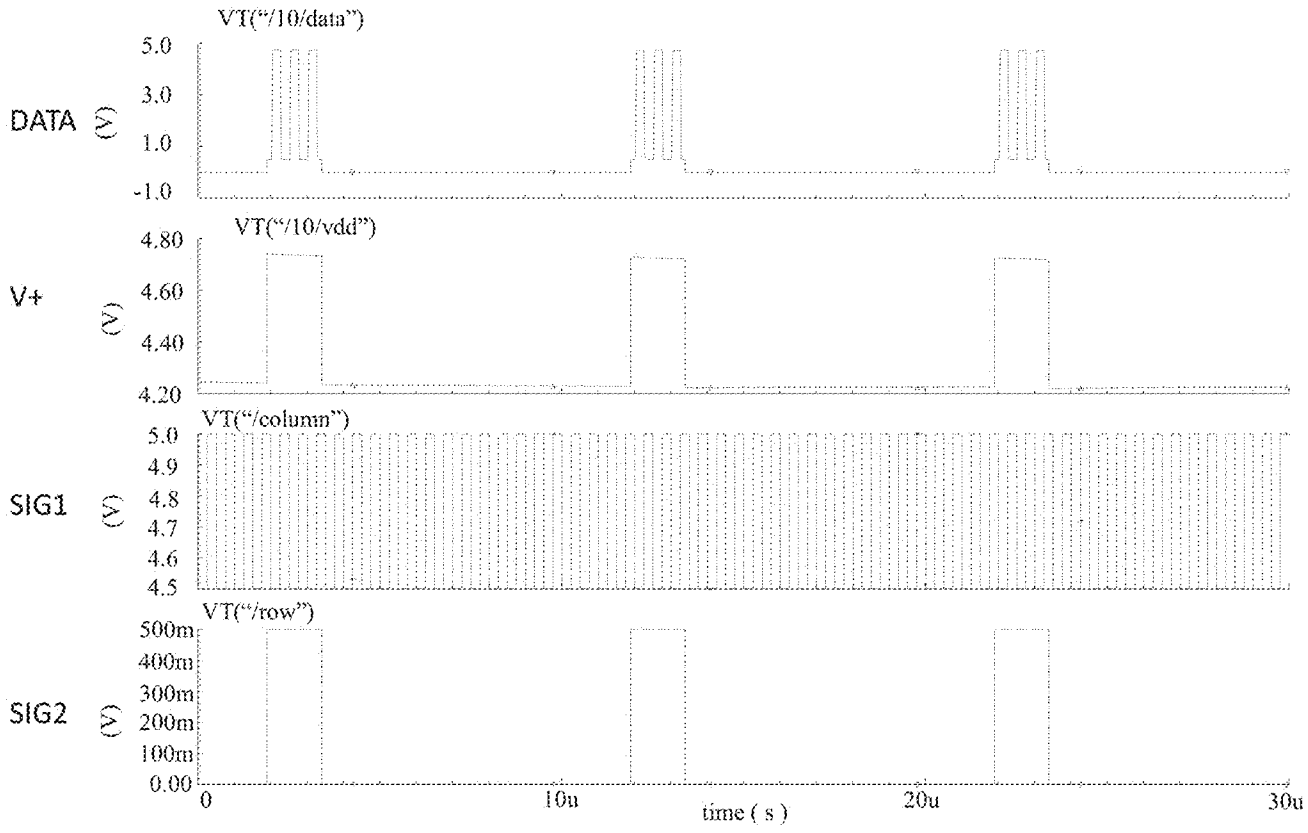
Figure 22B:
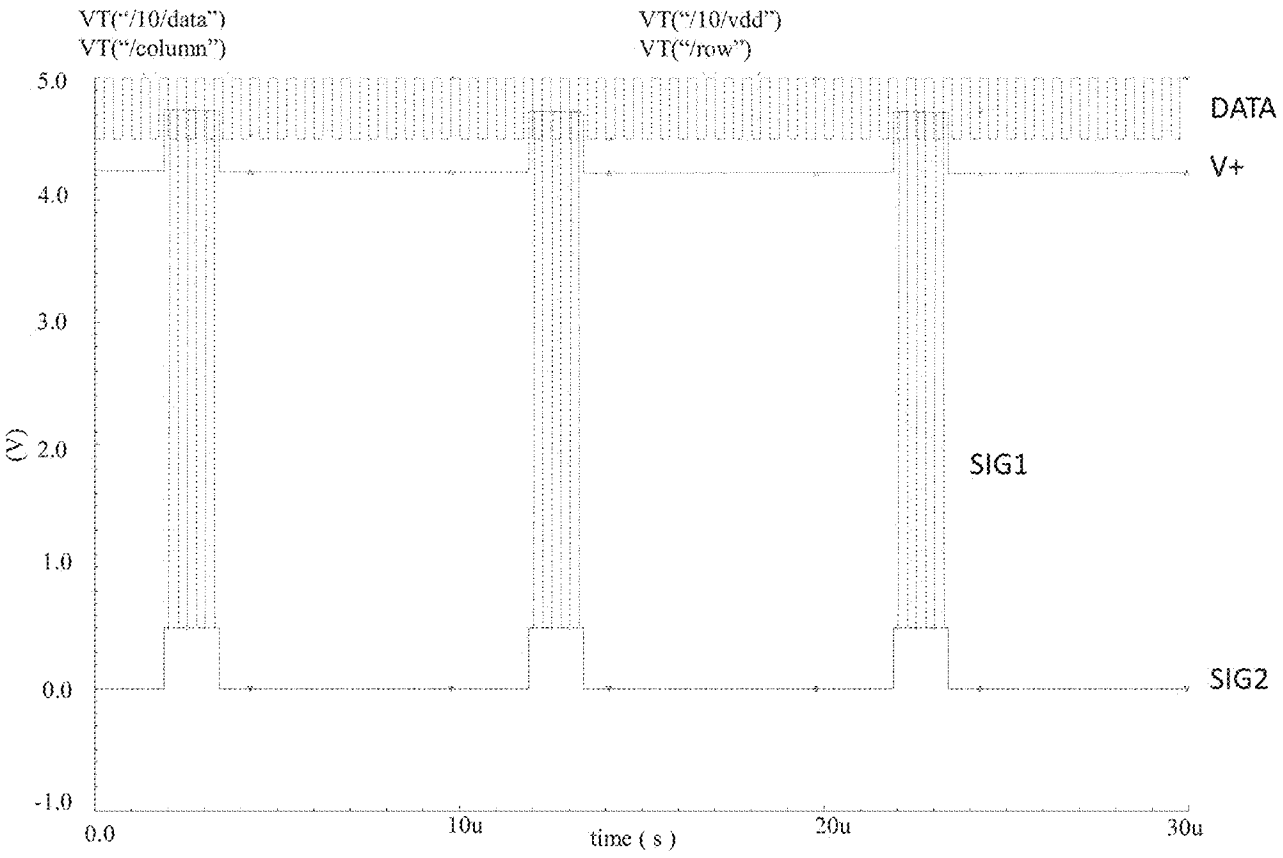

An embodiment of the present invention was simulated to demonstrate its performance using SPICE tools. Referring to FIGS. 21A, 21B, 22A, and 22B, the power circuit 22 and voltage comparator 40 of FIG. 7B were driven with the voltages and at the frequencies indicated in the illustrated simulation results. Data was successfully and reliably extracted from the modulated first signal 20 when the second signal 30 was modulated and the circuit elements were successfully operated with the extracted V+ signal 24 and V− signal 26. As shown, 5 v logic circuits were operated at frequencies greater than 2 MHz. FIG. 21A illustrates a more detailed timing diagram with the different signals separately illustrated. Referring to FIG. 21A, at the beginning of the simulation SIG2 signal 30 is at 0 volts and SIG1 is switching between 5 volts and 4.5 volts. Due to the 0.75 volt voltage drop of the diode in power circuit 22, the voltage on V+ signal 24 begins at 5 volts minus 0.75 volt or 4.25 volts. During this time, the reference input to the voltage comparator 40 is below the minimum voltage on SIG1 first signal 20 and no switching occurs in the voltage comparator 40. Selection of the two-terminal store-and-control circuit 10 is performed by switching the input voltage on SIG2 or input second signal 30 from 0 to 0.5V. The capacitor in the power circuit 22 acts as a voltage source for instantaneous switching and causes the V+ signal 24 to also increase by 0.5 volt from 4.25 volts to 4.75 volts. Now the voltage comparator 40 reference is at 4.75 volts which is within the modulation range of 4.5 volts to 5.0 volts of the input first signal 20. Thus, the comparator will detect the modulation and provide a data signal 42 output which is shown as DATA in the simulation plot. FIG. 21B illustrates the signals of FIG. 21A overlapped on a common voltage axis. The comparator output DATA is apparent during the 0.5 volt select level on SIG2, but there is no activity on DATA when SIG2 is at 0 volts. The DATA output is inverted from the SIG1 input. FIG. 22A illustrates a less detailed timing diagram with the different signals separately illustrated. FIG. 22B illustrates the signals of FIG. 22A overlapped on a common voltage axis.

Although FIGS. 2A-4C and 7A-9C illustrate two-terminal store-and-control circuit 10 having three data storage elements 54 for red, green, and blue sub-pixel values in a display application, embodiments of the two-terminal store-and-control circuit 10 of the present invention can have an arbitrary number of data storage elements 54 in the data storage circuit 50. In those embodiments employing select circuits 90, the number of serially connected select storage elements 58 in the select state machine can be modified to match the number of data storage elements 54. For example, in an alternative display embodiment multiple red, green, and blue sub-pixel values for each of a plurality of full-color pixels are stored in a single two-terminal store-and-control circuit 10. In combination with the process/sense circuit 66 and processed output signal 48, the present invention can provide a two-terminal store-and-control circuit 10 that implements a pixel output and touch input circuit or multiple pixel outputs and one or more touch input circuits.

The two-terminal store-and-control circuit 10 can include or be connected to light emitters 70 such as micro-light-emitting diodes (micro-LEDs). In various embodiments, each micro-LED has a width from 2 to 5 μm, 5 to 10 μm, 10 to 20 μm, or 20 to 50 μm, each micro-LED has a length from 2 to 5 μm, 5 to 10 μm, 10 to 20 μm, or 20 to 50 μm, or each micro-LED has a height from 2 to 5 μm, 4 to 10 μm, 10 to 20 μm, or 20 to 50 μm. In another embodiment, the display substrate has a contiguous display substrate area that includes the micro-LEDs, each micro-LED has a light-emissive area, and the combined light-emissive areas of the micro-LEDs is less than or equal to one-quarter of the contiguous display substrate area or wherein the combined light-emissive areas of the micro-LEDs is less than or equal to one eighth, one tenth, one twentieth, one fiftieth, one hundredth, one five-hundredth, one thousandth, one two-thousandth, or one ten-thousandth of the contiguous display substrate area. In yet another embodiment, each micro-LED has an anode and a cathode disposed on a same side of the respective micro-LED and, optionally, the anode and cathode of a respective light emitter 70 are horizontally separated by a horizontal distance, wherein the horizontal distance is from 100 nm to 500 nm, 500 nm to 1 micron, 1 micron to 20 microns, 20 microns to 50 microns, or 50 microns to 100 microns.

Figure 10:
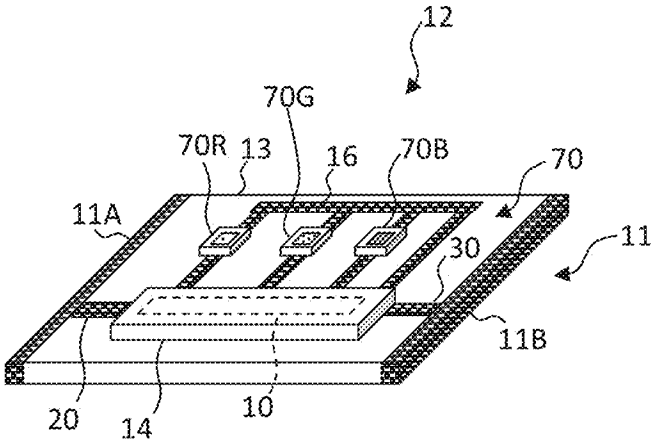
FIG. 10 is a perspective of a two-terminal surface-mount device according to an embodiment of the present invention.

Referring to FIG. 10, in an embodiment any one of the two-terminal store-and-control circuits 10 described above is incorporated into a two-terminal surface-mount device 12 having first and second electrical connections 11A, 11B corresponding to the two terminals 11. The first electrical connection 11A can be electrically connected to the modulated first signal 20 and the second electrical connection 11B is electrically connected to the second signal 30. The two-terminal surface-mount device 12 can be a two-terminal surface-mount structure that includes a surface-mount device substrate 13 and a chiplet 14 including the two-terminal store-and-control circuit 10 having a data storage circuit 50 (not separately shown in FIG. 10) disposed on the surface mount structure, for example the surface-mount device substrate 13, the data storage circuit 50 for receiving and storing data transmitted through the first or second electrical connections 11A, 11B. The two-terminal surface-mount device 12 can also include one or more light emitters 70, for example red, green, and blue light emitters 70R, 70G, 70B such as micro-light-emitting diodes, electrically connected to the chiplet 14 with conductors 16, such as metal wires. In another embodiment, the two-terminal surface-mount device 12 can include a plurality of first and second electrical connections 11A, 11B and a corresponding plurality of two-terminal store-and-control circuits 10, wherein the modulated first signals 20 are electrically connected to the first electrical connections 11A and the second signals 30 are electrically connected to the second electrical connections 11B. The chiplets 14 and light emitters 70 can be made using photolithographic integrated circuit processes and can be micro-transfer printed on the surface-mount device substrate 13 and electrically connected using photolithographic materials and processes. The two-terminal surface-mount device 12 can be disposed on a substrate or backplane using micro-transfer printing or conventional surface-mount deposition and interconnected using conventional interconnection methods.

In the embodiment illustrated in FIG. 10, the terminals 11 are located on two opposing edges of the surface-mount device substrate 13. In this arrangement, the red, green, and blue light emitters 70R, 70G, 70B (collectively light emitters 70) can be top emitters that emit light in a direction opposite to the surface-mount device substrate 13. Alternatively, the light emitters 70 can be bottom emitters that emit light through the surface-mount device substrate 13 and the surface-mount device substrate 13 is at least partially transparent to the light emitted from the light emitters 70 (for example the surface-mount device substrate 13 is made of glass or polymer and can be rigid or flexible). In other embodiments, the terminals 11 are located on a side of the surface-mount device substrate 13 rather than an edge (not shown). In one embodiment, the terminals 11 are located on the same side of the surface-mount device substrate 13 as the light emitters 70. In another embodiment, the terminals 11 are located on an opposite side of the surface-mount device substrate 13 as the light emitters 70.

Figure 11:
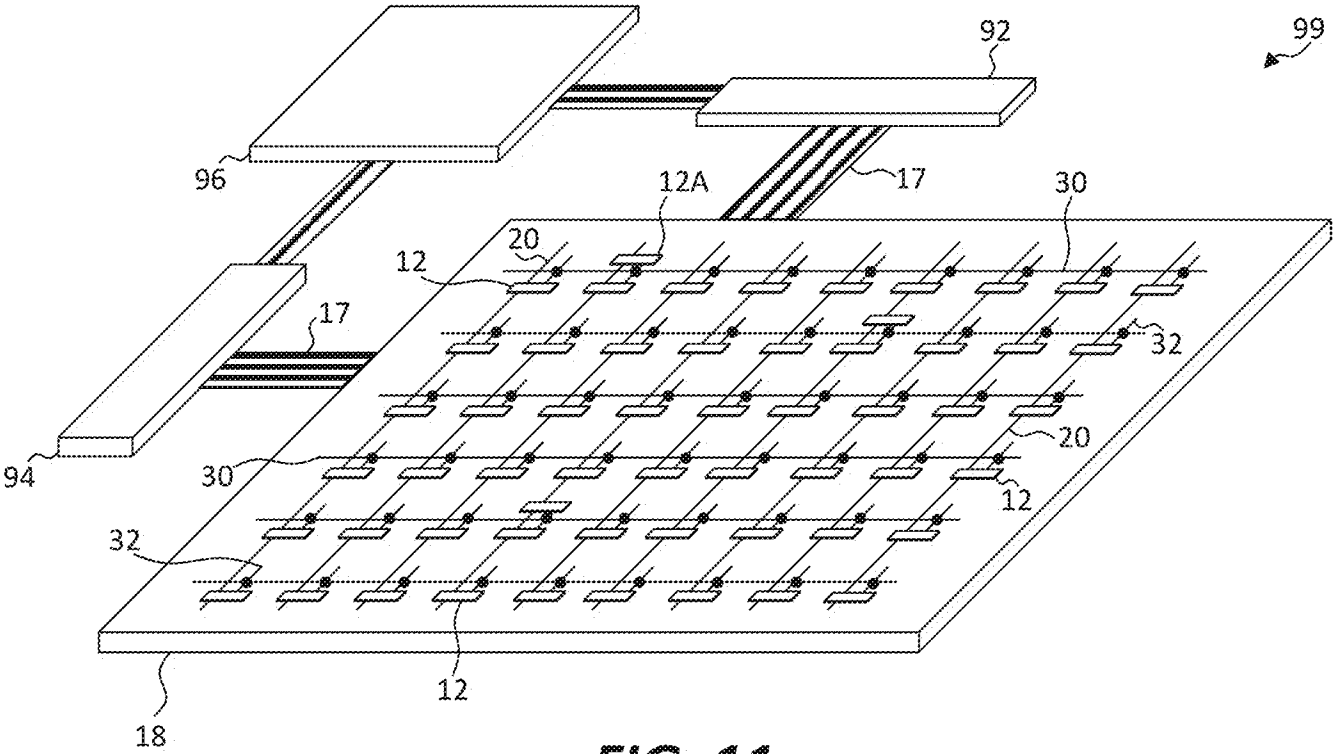
FIG. 11 is a perspective of a display incorporating an array of the two-terminal surface-mount devices of FIG. 10 according to an embodiment of the present invention having additional two-terminal surface-mount devices.

Likewise, referring also to the embodiment of FIG. 11, the backplane 18 can be opaque or at least partially transparent to the light emitted by the light emitters 70. In the latter case, for example, the backplane 18 is made of glass or polymer and can be rigid or flexible. If the backplane 18 is at least partially transparent to light emitted from the light emitters 70, the surface-mount device 12 can be mounted so that the light emitters 70 emit light through the backplane 18. In this case, if the surface-mount device 12 is a bottom emitter, the surface-mount device 12 can be disposed with the surface-mount device substrate 13 between the light emitters 70 and the backplane 18. If the surface-mount device 12 is a top emitter, the surface-mount device 12 can be disposed with the light emitters 70 between the surface-mount device substrate 13 and the backplane 18. In the case in which the backplane is opaque, if the surface-mount device 12 is a bottom emitter, the surface-mount device 12 can be disposed with the light emitters 70 between the surface-mount device substrate 13 and the backplane 18. If the surface-mount device 12 is a top emitter, the surface-mount device 12 can be disposed with the surface-mount device substrate 13 between the light emitters 70 and the backplane 18.

In any case, if at least a portion of the terminals 11 are exposed after the surface-mount device 12 is disposed on the backplane 18, the terminals 11 can be electrically connected, for example, using photolithographic methods of depositing a metal layer and patterning it to form electrical connections to the terminals 11 from the backplane 18. If at least a portion of the terminals 11 are between the surface-mount device 12 and the backplane 18, the terminals 11 can be electrically connected using solder methods (e.g., wave solder, heating pre-disposed solder material) to form electrical connections to the terminals 11 on the surface-mount device 12 from the backplane 18. Once the surface-mount device 12 is electrically connected to the backplane 18, the surface-mount devices 12 can be potted (encapsulated for example with a polymer to provide mechanical stability).

Although the two-terminal store-and-control circuit 10 and two-terminal surface-mount devices 12 can be used in a variety of applications, referring to the embodiment of FIG. 11, the two-terminal store-and-control circuit 10 and two-terminal surface-mount devices 12 are employed in a display 99. The display 99 includes a display substrate 18 or backplane having an array of two-terminal surface-mount devices 12 of the present invention disposed thereon. One terminal 11 of each of the two-terminal surface-mount devices 12 in a row is electrically connected to a row-select line 30 (corresponding to the second signal 30 of the two-terminal store-and-control circuit 10) and the other terminal 11 of each of the two-terminal surface-mount devices 12 in a column is electrically connected to a column-data line 20 (corresponding to the first signal 20 of the two-terminal store-and-control circuit 10). The column-data lines 20 are electrically connected through a bus 17 to a column controller 92 and the row-select lines 30 are connected through another bus 17 to a row controller 94. A display controller 96 controls and provides data, such as pixel data, to the column controller 92 and the row controller 94. The column-data lines 20 and row-select lines 30 are electrical conductors such as wires. In an embodiment, the column controller 92 is responsive to output signals 48 from the two-terminal store-and-control circuits 10 and two-terminal surface-mount devices 12. The column controller 92, the row controller 94 and the display controller 96 can each be an integrated circuit. Alternatively, one or more integrated circuits can include one or more portions of each of the row, column, or display controllers 92, 94, 96.

Figure 12:
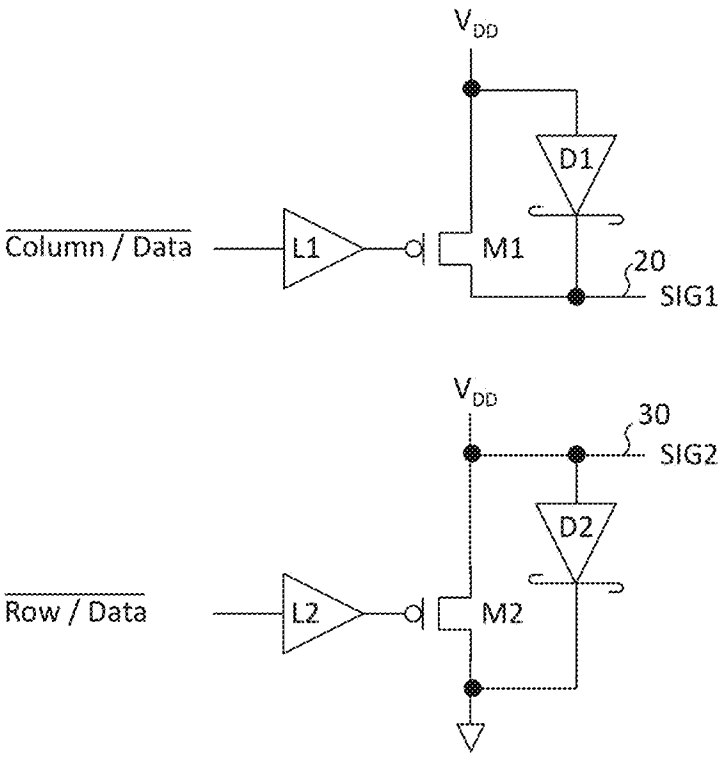
FIG. 12 is a circuit diagram of column and row driver circuits according to an embodiment of the present invention.

Referring also to FIG. 12, each output line of the column controller 92 can include a column/data driver circuit and each output line of the row controller 94 can include a row/select driver circuit to modulate the first signal 20 or the second signal 30. Although a variety of circuit designs can be used and a variety of methods (e.g., capacitive, inductive, or with a switched transistor, as shown) used to modulate the first and second signals 20, 30, in an embodiment, L1 and L2 can be 3.3 v to 5 v level translators (for example, such as the TSC0101 from Texas Instruments), M1 and M2 can each be one half of a complementary pair of MOSFETs (for example, such as the DMC2400UV from Texas Instruments), and D1 and D2 can each be Schottky diodes (for example one quarter of the UC3611 from Texas Instruments). Alternative Schottky diodes can be used to change the current available, if desired. In operation, the level translator can convert low-voltage 3.3 V data signals to 5 V which drives pull-up transistor M1 for the column-data lines 20 and drives pull-down transistor M2 for the row-select lines 30. When the transistors are off, a 400 mV voltage drop is supplied by the Schottky diodes D1 and D2. Thus, when both transistors are turned on the column-data lines 20 and the row-select lines 30 are at their nominal values of 5V and 0V, respectively. When column-data is low the column-data line 20 is at $V_{DD}$=5 V and when column-data 20 is high the column-data output is at $V_{DD}$−0.4 V=4.6 V. When row data is high the row-select line 30 is at GND=0 V and when row-data is low the row-select line 30 is at GND+0.4 V=0.4 V. Thus the modulated first and second signals 20, 30 have a 400 mV swing. As noted above, the circuits of FIG. 12 can be employed in the modulator circuit 68 to modulate the first and second signals 20, 30 when the row or column controllers 94, 92 are at their nominal values.

In one embodiment of the present invention, a single two-terminal store-and-control circuit 10 is electrically connected to each combination of column-data lines (modulated first signals) 20 and row-select lines (second signals) 30 in the display 99. If the column-data lines 20 are distributed in an array over the display substrate 18 in a first direction and the row-select lines 30 are distributed in an array over the display substrate 18 in a second direction different from the first direction, then the single two-terminal store-and-control circuits 10 are electrically connected at each location where the column-data lines 20 and row-select lines 30 overlap. The two-terminal store-and-control circuits 10 can then be driven by an active-matrix control scheme through the column-data lines 20 and row-select lines 30 without requiring an external active-matrix enable (selection) circuit 35, for example as needed in FIG. 1. This arrangement is illustrated in FIG. 11 with the column-data lines 20, the row-select lines 30 and the single two-terminal surface-mount devices 12 (that each incorporate a two-terminal store-and-control circuit 10 and light emitters 70 as shown in FIG. 10). In the case in which the two-terminal surface-mount devices 12 incorporate red, green, and blue micro-LEDs that emit red, green, and blue light respectively, each two-terminal surface-mount device 12 implements a full-color pixel. Thus, in an embodiment of the present invention, a two-terminal active-matrix controller includes a circuit having a first terminal 11A for receiving the modulated first signal 20 that includes both an information signal (e.g., first data signal 42) and a V+ signal 24. The circuit also includes a second terminal 11B for receiving a second signal 30. In a further embodiment, the information signal is a first information signal and the second signal 30 also includes a second information signal (e.g., select signal 44).

In an embodiment of the present invention, the two-terminal surface-mount devices 12 are tested before they are disposed on the display substrate 18. However, in a further embodiment of the present invention, if one or more of the two-terminal surface-mount devices 12 is faulty or improperly connected, it can be removed from the backplane 18 and replaced with another two-terminal surface-mount device 12 and electrically connected in the place of the faulty two-terminal surface-mount device 12 using rework methods. In an alternative embodiment, the faulty two-terminal surface-mount device 12 is not necessarily removed and an additional two-terminal surface-mount device 12A is electrically connected in parallel to the same column-data lines 20 and row-select lines 30 as the faulty two-terminal surface-mount device 12. As illustrated in FIG. 11, small electrical conductor stubs 32 extend from either the column-data lines 20 or the row-select lines 30 to facilitate the electrical connection of the additional two-terminal surface-mount device 12A in parallel with the faulty two-terminal surface-mount device 12. The additional two-terminal surface-mount device 12A operates in the place of the faulty two-terminal surface-mount device 12.

Figure 13:
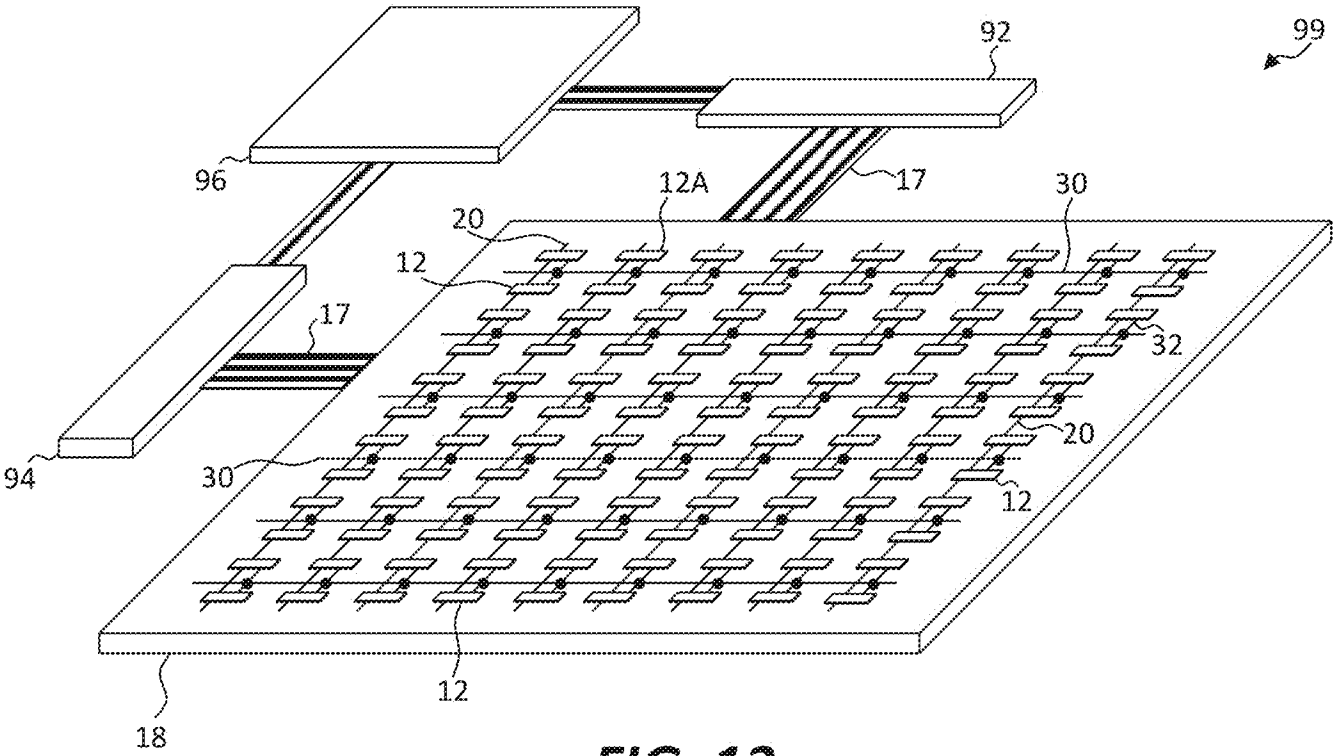
FIG. 13 is a perspective of a display incorporating an array of the two-terminal surface-mount devices of FIG. 10 according to an embodiment of the present invention having redundant two-terminal surface-mount devices.

Referring to FIG. 13, in yet another embodiment of the present invention, a redundant two-terminal surface-mount device 12A is provided and electrically connected in parallel with each two-terminal surface-mount device 12, regardless of whether the two-terminal surface-mount device 12 is faulty or not. If it is faulty, the redundant two-terminal surface-mount device 12A operates in its place. If it is not faulty, the redundant two-terminal surface-mount device 12A and the two-terminal surface-mount device 12 both operate and can be driven to each emit one half the desired brightness, so that the total luminance is the same as would be output by a single two-terminal surface-mount device 12 operated normally.

Figure 14:
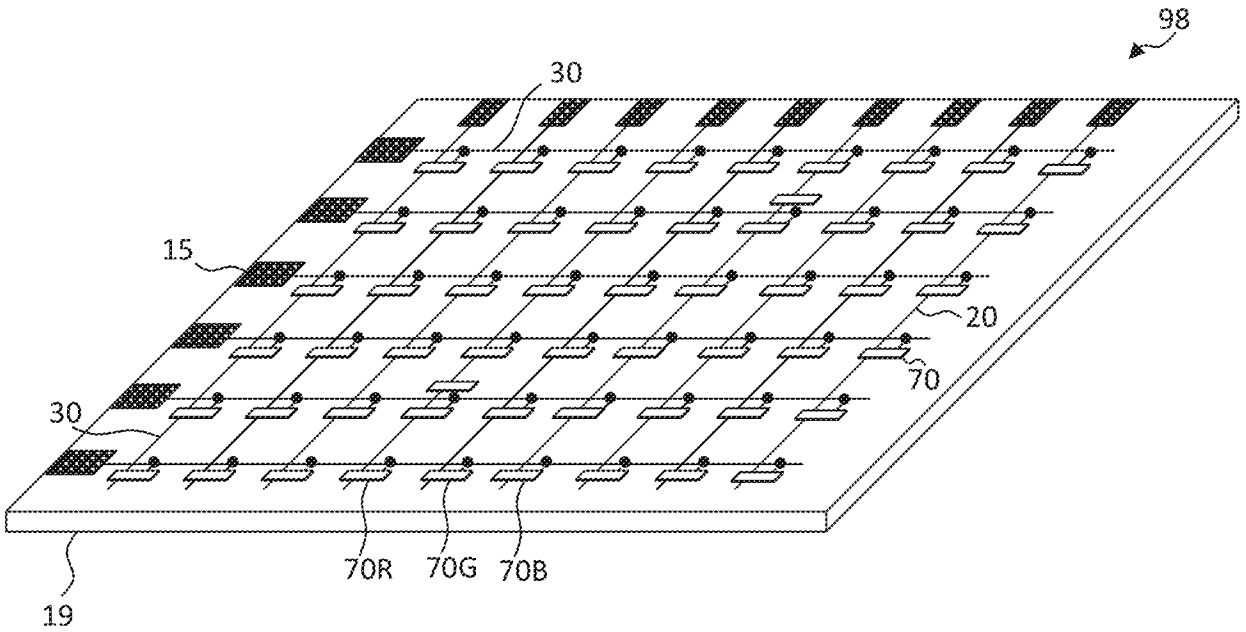
FIG. 14 is a perspective of a display tile incorporating an array of light emitters according to an embodiment of the present invention.
Figure 15:
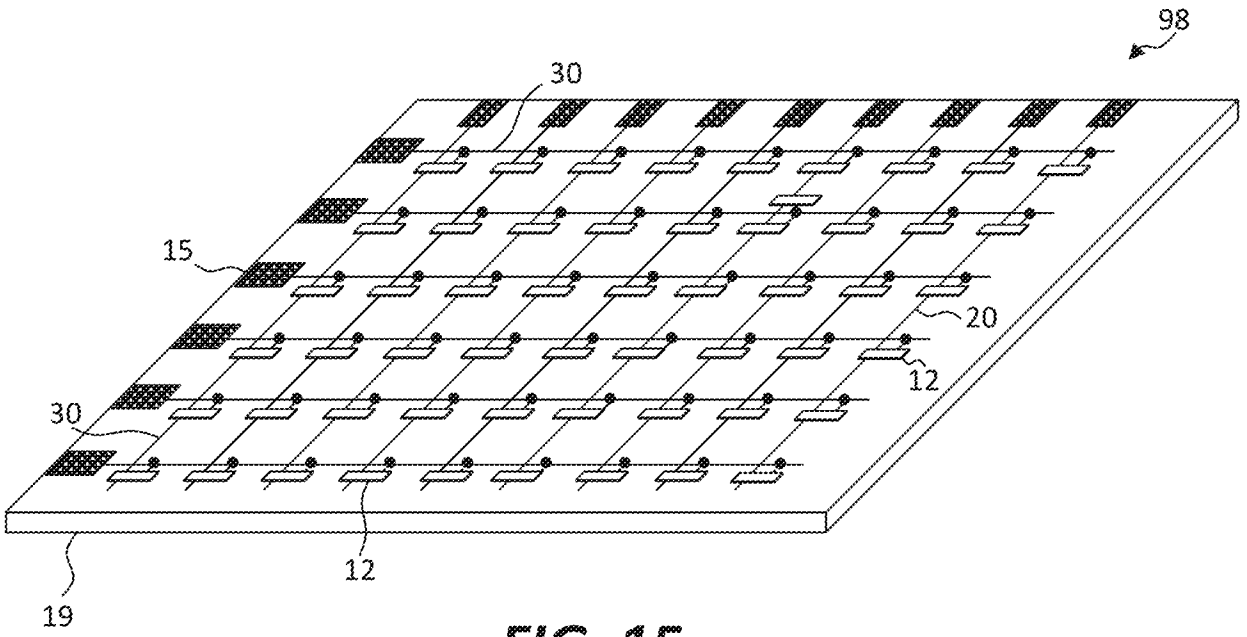
FIG. 15 is a perspective of a display tile incorporating an array of the two-terminal surface-mount devices of FIG. 10 according to an embodiment of the present invention.

In some embodiments, a display 99 comprises a plurality of display tiles 98 (illustrated in FIGS. 14 and 15) disposed on a backplane 18. Each display tile 98 includes a portion of the light emitters 70 in the array of light emitters 70 in the display 99. In one design, each of the two-terminal surface-mount devices 12 is considered a tile because it has a surface-mount device substrate 13 distinct and independent from the display substrate 18 (FIGS. 12 and 13). More conventionally, however, a display tile 98 includes an array of full-color pixels, as shown in FIGS. 14 and 15 disposed on a tile substrate 19. In FIG. 14, an array of red, green, and blue light emitters 70R, 70G, 70B (collectively light emitters 70) are disposed on a substrate 19 and electrically connected to unique pairs orthogonal arrays of column-data lines 20 and row-select lines 30 to form a display tile 98. As illustrated in FIG. 14, the display tile 98 includes six rows of three full-color pixels each. The full-color pixels each include one of each: a red, a green, and a blue light emitter 70R, 70G, 70B. Each column-data line 20 and row-select line 30 are electrically connected to a connection pad 15. The display tile 98 can be a surface-mount device 12 and can be micro-transfer printed or disposed using surface mount technology onto the backplane 18. As illustrated in FIG. 14, the light emitters 70 are driven in a passive-matrix configuration since there is no pixel value storage at each pixel location on the display tile 98 or on the backplane 18.

Thus, a display tile 98 can include a tile substrate 19 and an array of light emitters 70 disposed in an array on the tile substrate 19, the array of light emitters 70 having tile rows and tile columns of light emitters 70. An array of tile row-select lines 30 is disposed on the tile substrate 19 and each tile row-select line 30 is connected in common to a different tile row of light emitters 70. An array of tile column-data lines 20 is disposed on the tile substrate 19 and each tile column-data line 20 is connected in common to a different tile column of light emitters 70.

In an embodiment, the display tiles 98 are disposed in an array on a display substrate 18 so that the light emitters 70 are disposed in display rows and display columns to make a display 99. An array of row-select lines 30 is disposed on the display substrate 18 and each row-select line 30 connected in common to the tile row-select lines 30 of a display row of light emitters 70. An array of column-data lines 20 is disposed on the display substrate 18 and each column-data line 20 is connected in common to the tile column-data lines 20 of a display column of light emitters 70. A row controller 94 is connected to the array of row-select lines 30 and a column controller 92 is connected to the array of column-data lines 20 to provide passive-matrix control to the display 99.

According to an embodiment of the present invention, referring to FIG. 15, a two-terminal surface-mount device 12 including a two-terminal store-and-control circuit 10 (FIG. 10) is connected to each unique pair of column-data lines 20 and row-select lines 30 on the tile substrate 19. Since each two-terminal store-and-control circuit 10 stores at least one data value in the data storage circuit 50, this configuration employs active-matrix control. As illustrated, each two-terminal surface-mount device 12 includes three micro-light-emitting diodes (FIG. 10) and thus, the display tile 98 of FIG. 15 includes a six-by-nine array of full-color pixels. As noted with respect to FIG. 14, the embodiment of the display tile 98 of FIG. 15 can be a surface-mount device 12 and can be micro-transfer printed or disposed using surface mount technology onto the backplane 18.

In a further embodiment, each two-terminal surface-mount devices 12 can include multiple full-color pixels by increasing the number of serially connected data storage elements 54 in the data storage circuit 50 and corresponding drive circuits 60 and light emitters 70. However, in this embodiment, the physical spacing between the full-color pixels on the display tile 98 must match the spacing of the full-color pixels in the display 99, so that the two-terminal surface-mount devices 12 are effectively multi-pixel display tiles 98 (not shown).

Two-terminal store-and-control circuits 10 of the present invention (FIGS. 1A-4C) can be operated by providing one or more sequential data values on the modulated first signal 20 to load the data values into the data storage circuit 50 while the second signal is held to a voltage (e.g., a ground). In the alternative embodiments of FIGS. 5A-9C, the two-terminal store-and-control circuits 10 can be operated by sequentially providing a data value on the modulated first signal 20 followed by a select value modulated onto the second signal 30 to load the data values into the data storage circuit 50.

The two-terminal store-and-control circuits 10 of the present invention can be arranged in arrays each uniquely electrically connected to one row of an array of row-select lines 30 and one column of an array of column-data lines 20 to form a display 99. The display 99 is operated by providing rows of image pixel data to the display controller 96. The display controller 96 transfers sequential rows of the pixel data to the column controller 92 and controls the row controller 94 to select the row of two-terminal store-and-control circuits 10 corresponding to the provided row of image pixel data.

In the embodiment of FIGS. 1A-4C, each row of two-terminal store-and-control circuits 10 is enabled on the display substrate 18 with the row-select line 30 (e.g., using an AND gate to combine the row-select line 30 and the column-data line 20 before applying the column-data values to the modulated first signal 20 while the second signal 30 is held at a ground voltage. The column-data line 20 is triggered and then the row of pixel data corresponding to the enabled row-select line 30 is presented on the column-data lines 20 by the column controller 92 for a pre-determined time.

In the embodiment of FIGS. 5A-9C, the column controller 92 applies the column-data values to the modulated first signal 20 and the second signal 30 is modulated after the data storage circuit 50 set up time to select and store the applied data in the data storage circuit 50. The process is then repeated for each data storage element 54 in the data storage circuit 50 and for every row in the array of two-terminal store-and-control circuits 10. Note that a first data value can be stored in all of the rows before a second data value is stored into a row or all of the data values in a row can be loaded before data is stored into a different row. Indeed, the order in which rows of data are loaded is arbitrary and storing data in one row can be intermixed with storing data in another row, for example a first row can store a first data value, a second row can store a first data value, the first row can store a second data value, a third row can store a first data value, the first row can store a third data value, the second row can store a second data value, and so forth.

In another embodiment of the present invention, after each row of pixels is supplied, an output signal 48 is received from the two-terminal store- and control circuit 10 on the column-data lines 20 by the column controller 92 or on the row-select lines 30 by the row controller 94. In an embodiment, the output signal 48 is a touch signal and the two-terminal store- and control circuit 10 includes a touch sensor. The touch signal can be reported to the display control 96 by the column controller 92 or the row controller 94, or both, depending on which of the first or second signals 20, 30 is modulated to provide the output signal 48.

The two-terminal store-and-control circuit 10 illustrated in the figures that employ digital data values and light emitters 70 can provide a binary output. In a gray-scale output embodiment, bit-planes corresponding to different bits in a multi-bit pixel value can be sequentially stored in the data storage circuit 50 for different periods of time to provide a pulse-width modulation control scheme, as described in U.S. patent application Ser. No. 14/835,282 filed Aug. 25, 2015 and entitled Bit-Plane Pulse-Width Modulated Display System. In alternative embodiments, multi-bit values are communicated and stored in the data storage circuit 50 and used to control the light output, for example using a local pulse-width control scheme or digital-to-analog converters. In another embodiment, analog values are stored in the data storage circuit 50 and used to drive the light emitters 70 or other output devices.

Figure 17:
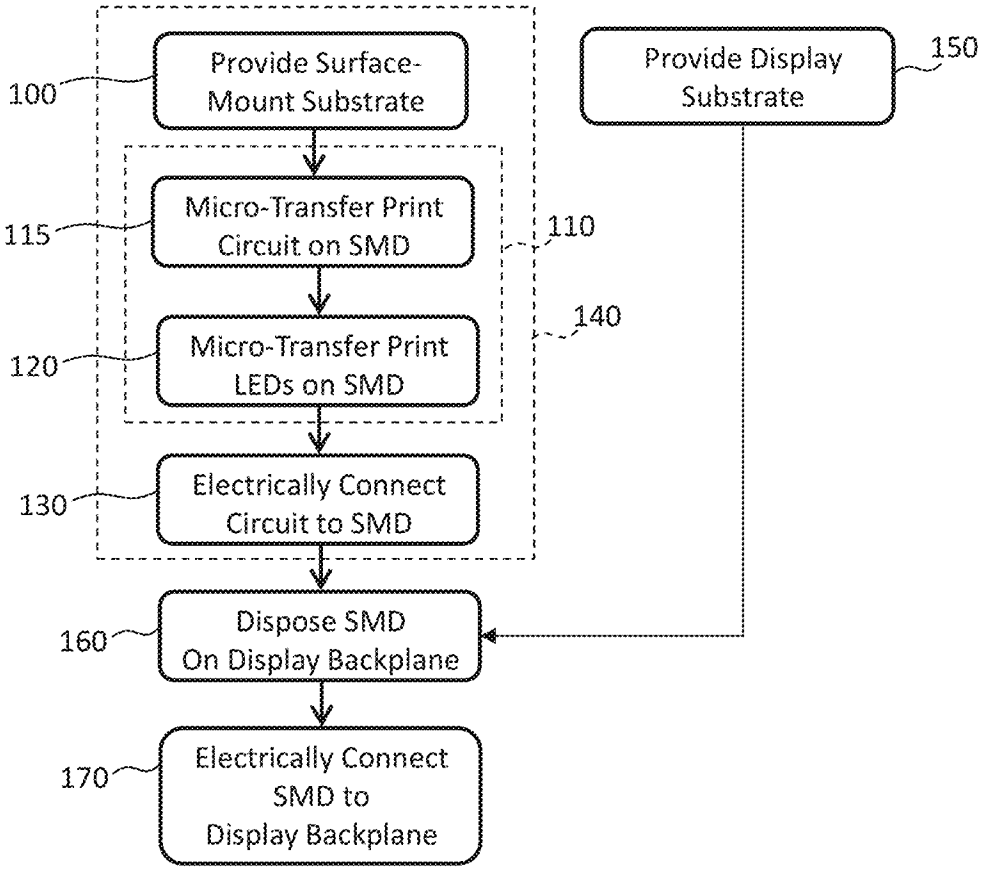
FIGS. 17-20 are flow charts illustrating methods of the present invention.

Embodiments of the present invention can be made in a variety of ways, including using micro-transfer printing and surface mount technology. Referring to FIG. 17, in one method a two-terminal store-and-control device is made by providing a two-terminal surface-mount device substrate 13 having first and second electrical connections 11A, 11B in step 100. In step 110, any one of the two-terminal store-and-control circuits 10 described above is disposed on the two-terminal surface-mount device substrate 13, for example by micro-transfer printing circuit elements such as discrete elements or integrated circuits such as chiplets 14 in step 115 and micro-transfer printing LEDs on the surface-mount device substrate 13 in step 120. In step 130, the circuit elements are electrically connected, for example using photolithographic methods to dispose and pattern conductive material on the surface-mount device substrate 13. The steps of providing the surface-mount device substrate 13 (step 100) and disposing the two-terminal store-and-control circuit 10 on the surface-mount device substrate 13 (step 110) and electrically connecting the circuit elements (step 130) provide the surface-mount device step 140. One or more light emitters 70, for example micro-LEDs, can be disposed, for example by micro-transfer printing, onto the two-terminal surface-mount device 12 and electrically connected to the two-terminal store-and-control circuit 10 to drive the light emitters 70 to emit light.

A display substrate (backplane) 18 is provided in step 150 and the two-terminal surface-mount devices 12 are disposed on the display substrate 18 in step 160 and electrically connected in step 170 by electrically connecting the first electrical connections 11A to the modulated first signals 20 and electrically connecting the second electrical connections 11B to the second signal 30 to form the display 99. The column, row, and display controllers 92, 94, 96 can be electrically connected to the display substrate 18.

According to an embodiment of the present invention, an electrical system can be made by providing a backplane 18 having a plurality of first and second electrical connections 11A, 11B, providing a plurality of the two-terminal surface-mount devices 12, and electrically connecting the modulated first signals 20 to the first electrical connections 11A and electrically connecting the second signals 30 to the second electrical connections 11B.

Figure 18:
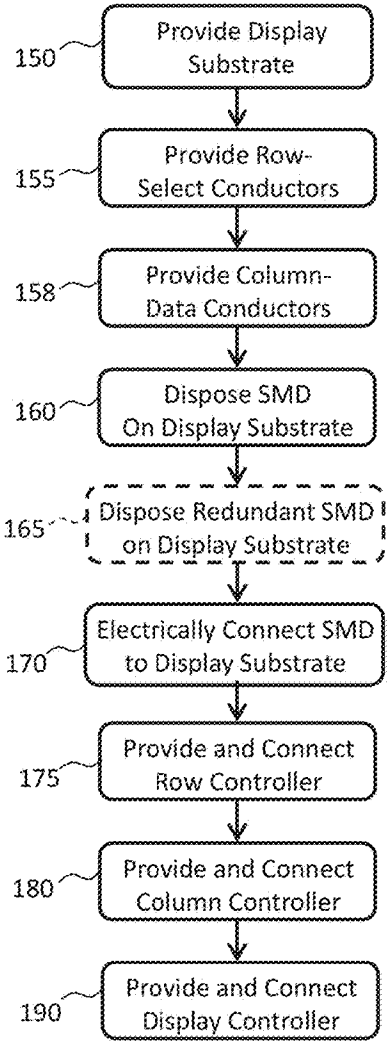

Referring to FIG. 18 in another embodiment of the present invention, a method of making a display 99 includes providing a display substrate 18 in step 150, providing an array of row-select lines 30 on the display substrate 18 in step 155, and providing an array of column-data lines 20 on the display substrate 18 in step 158. An array of any one of the two-terminal store-and-control circuit 10 or two-terminal surface-mount devices 12 is disposed, for example by micro-transfer printing, in step 160 in rows and columns on the display substrate 18, each row in the array corresponding to a row-select line 30 and each column in the array corresponding to a column-data line 20. Optionally, redundant two-terminal store-and-control circuit 10 or two-terminal surface-mount devices 12 are disposed on the display substrate 18 in step 165. In an embodiment, the two-terminal store-and-control circuits 10 or two-terminal surface-mount devices 12 are disposed and electrically connected on tile substrates 19 and the display tiles 98 are disposed and electrically connected on the display substrate 18.

The modulated first signal 20 of each device in an array row is electrically connected to the corresponding column-data line 20 and the modulated second signal 30 of each device in an array column is electrically connected to the corresponding row-select line 30 in step 170. In a further embodiment, a row controller 94 is provided and connected to the row-select lines 30 in step 175, a column controller 92 is provided and connected to the column-data lines 20 in step 180, and in step 190 a display controller 96 is provided and connected to the column controller 92 for providing data to the column controller 92 and is connected to the row controller 94 for providing row-control signals to the row controller 94.

Figure 19:
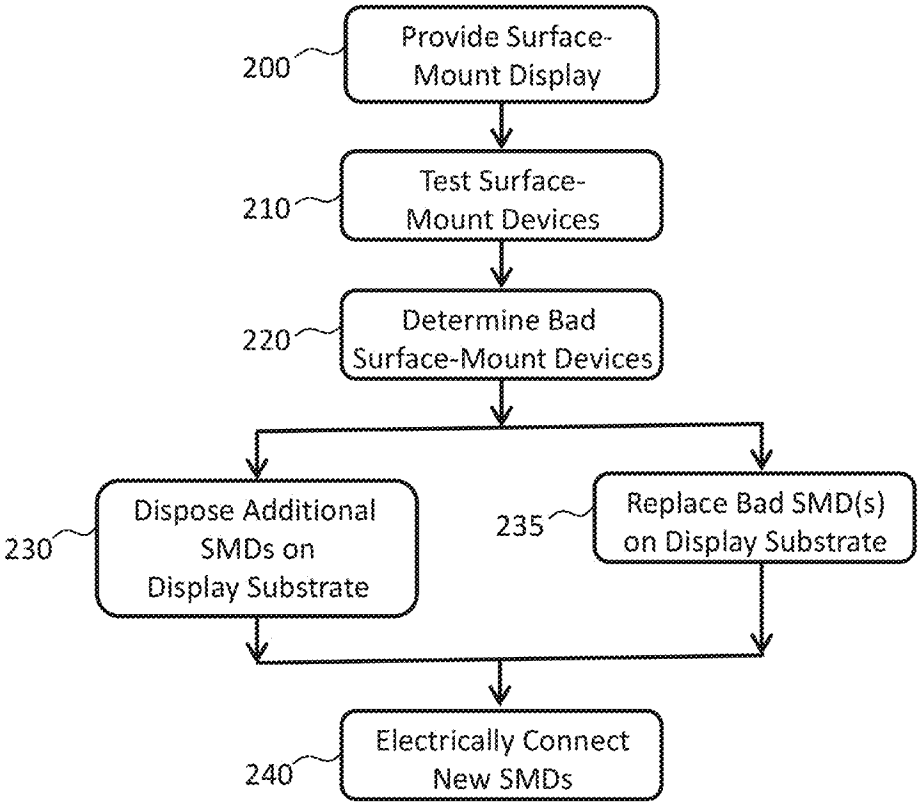

Referring to FIG. 19, in another embodiment, the two-terminal store-and-control circuit 10 or two-terminal surface-mount devices 12 are provided in step 200 and tested in step 210. Bad (defective) two-terminal store-and-control circuits 10 or two-terminal surface-mount devices 12 are determined in step 220 and either replaced in step 235 or an additional two-terminal store-and-control circuit 10 or two-terminal surface-mount devices 12 disposed on the display substrate 18 in step 230. The modulated first signal 20 of each additional device is electrically connected to the column-data line 20 of the corresponding bad device and the modulated second signal 30 of each additional device is electrically connected to the row-select line 30 of the corresponding bad device in step 240.

Figure 20:
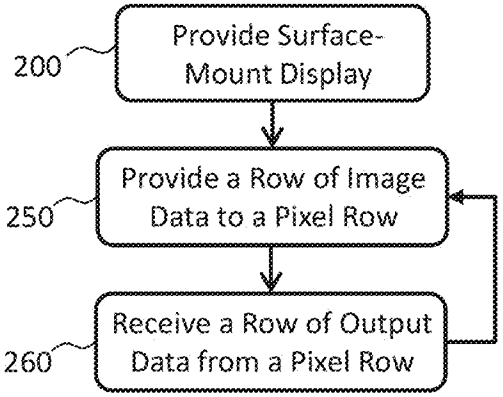

Referring to FIG. 20, a method of operating a display includes providing a display in step 200, the display controller 96 responsive to an image stored in a framestore to provide successive rows of pixels to the column-data lines 20 and corresponding row-select signals to the row-select lines 30. After each row of pixels is supplied in step 250, an output signal 48 is received in step 260 from the two-terminal store- and control devices on the column-data lines 20 or by the column controller 92 or on the row-select lines 30 by the row controller 94. In an embodiment, output signal 48 is a touch signal.

In an embodiment of the present invention, the light emitters 70 are inorganic light-emitters such as inorganic light-emitting diodes.

A discussion of utilizing display tiles 98 in a display can be found in commonly assigned co-pending U.S. patent application Ser. No. 14/822,868, filed Aug. 10, 2015, entitled Compound Micro-Assembly Strategies and Devices, the contents of which are incorporated by reference herein in its entirety.

The two-terminal store-and-control circuits 10 of the present invention can be constructed using circuit design tools and integrated circuit manufacturing methods known in the art. LEDs and micro-LEDs are also known, as are circuit layout and construction methods. The displays 99 of the present invention can be constructed using display and thin-film manufacturing method independently of or in combination with micro-transfer printing methods, for example as are taught in commonly assigned co-pending U.S. patent application Ser. No. 14/743,981, filed Jun. 18, 2015, entitled Micro Assembled Micro LED Displays and Lighting Elements, the contents of which is hereby incorporated by reference.

The display substrate 18, tile substrate 19, or surface-mount device substrates 13 can be any conventional substrate such as glass, plastic, or metal or include such materials. Tile substrates 19 or surface-mount device substrates 13 can be semiconductor substrates. The display substrate 18 or the tile substrate 19 can be transparent, for example having a transmissivity greater than or equal to 50%, 80%, 90%, or 95% for visible light. The display substrate 18 or the tile substrate 19 has two opposing smooth sides suitable for material deposition, photolithographic processing, or micro-transfer printing of micro-LEDs or chiplets 14. The display substrate 18 can have a size of a conventional display, for example a rectangle with a diagonal length of a few centimeters to one or more meters and a thickness of 0.1 mm, 0.5 mm, 1 mm, 5 mm, 10 mm, or 20 mm. Such substrates are commercially available. In an embodiment of the present invention, the display substrate 18 is flexible.

Before, after, or at the same time the display substrate 18 is provided in step 150, the light emitters 70 (e.g. micro-LEDs) can be provided using conventional photolithographic, integrated-circuit processes on semiconductor substrates. The micro-LED semiconductor substrates are much smaller than and separate and distinct from the display substrate 18 or tile substrate 19 and can include different materials. Methods, tools, and materials for making LEDs are well known in the lighting and LCD backlight industries. In one method, the two-terminal store-and-control circuit 10 is made in an integrated circuit semiconductor chiplet 14 and, optionally, is not packaged. In an alternative method, the two-terminal store-and-control circuit 10 is made in a semiconductor coating formed on the display substrate 18 using conventional substrate processing methods, for example employing low- or high-temperature polysilicon processed, for example with excimer lasers, to form localized crystalline silicon crystals (e.g. LTPS) as is known in the display art.

In steps 130 and 170 conductive wires, for example electrical interconnections, are formed on the surface-mount device substrate 13, tile substrate 19, or display substrate 18 using conventional photolithographic and display substrate processing techniques known in the art, for example photolithographic processes employing metal or metal oxide deposition using evaporation or sputtering, curable resin coatings (e.g. SU8), positive or negative photo-resist coating, radiation (e.g. ultraviolet radiation) exposure through a patterned mask, and etching methods to form patterned metal structures, vias, insulating layers, and electrical interconnections. Inkjet and screen-printing deposition processes and materials can be used to form the patterned conductive wires or other electrical elements.

In an embodiment, the light emitters 70 (e.g. micro-LEDs) are transfer printed to the surface-mount device substrate 13, tile substrate 19, or display substrate 18 in one or more transfers. The two-terminal store-and-control circuit 10 can also be formed in a separate substrate such as a crystalline semiconductor substrate and transferred to the surface-mount device substrate 13, tile substrate 19, or display substrate 18. Micro-transfer printing methods are known in the art and are referenced above. The transferred light emitters 70 and circuit elements are then interconnected in steps 130 and 170, for example with conductive wires and optionally including connection pads 15 and other electrical connection structures, to enable a display controller 96 to electrically interact with the light emitters 70 to emit light in the display 99. In alternative processes, the transfer or construction of the light emitters 70 and the two-terminal store-and-control circuit 10 is done before or after all of the conductive wires (e.g. conductors 16) are in place.

The surface-mount device substrate 13 or tile substrate 19 can, for example, be similar to the display substrate 18 (e.g. made of glass or plastic) but in a much smaller size, for example having an area of 50 square microns, 100 square microns, 500 square microns, or 1 square mm and can be only a few microns thick, for example 5 microns, 10 microns, 20 microns, or 50 microns. Any desired circuits or wiring patterns are formed on the surface-mount device substrate 13 or tile substrate 19 before the light emitters 70 or the two-terminal store-and-control circuit 10 are provided on the surface-mount device substrate 13 or tile substrate 19. Alternatively, circuitry and wiring are formed on the surface-mount device substrate 13 or tile substrate 19 after the light emitters 70 and the two-terminal store-and-control circuit 10 are provided on the surface-mount device substrate 13 or tile substrate 19.

In an embodiment, the light emitters 70 (e.g. micro-LEDs) and the two-terminal store-and-control circuit 10 are transfer printed onto the surface-mount device substrate 13 or tile substrate 19 using one or more transfers from one or more semiconductor wafers. In an alternative embodiment, not shown, the surface-mount device substrate 13 or tile substrate 19 includes a semiconductor and any of the light emitters 70 and the two-terminal store-and-control circuit 10 and, optionally, some electrical interconnections (e.g., conductors 16), are formed in the surface-mount device substrate 13 or tile substrate 19. By employing the multi-step transfer or assembly process, increased yields are achieved and thus reduced costs for a display 99 of the present invention.

As is understood by those skilled in the art, the terms "over" and "under" are relative terms and can be interchanged in reference to different orientations of the layers, elements, and substrates included in the present invention. For example, a first layer on a second layer, in some implementations means a first layer directly on and in contact with a second layer. In other implementations a first layer on a second layer includes a first layer and a second layer with another layer there between.

As will also be understood by those knowledgeable in the art, binary logic signals indicated as high or low, as a one or as a zero, can be implemented with positive or negative voltage signals. The present invention is not limited by a positive or negative logic or voltage description or implementation and both positive and negative logic or voltages or relative voltage differences can be employed.

Having described certain implementations of embodiments, it will now become apparent to one of skill in the art that other implementations incorporating the concepts of the disclosure may be used. Therefore, the invention should not be limited to the described embodiment, but rather should be limited only by the spirit and scope of the following claims.

Throughout the description, where apparatus and systems are described as having, including, or comprising specific components, or where processes and methods are described as having, including, or comprising specific steps, it is contemplated that, additionally, there are apparatus, and systems of the disclosed technology that consist essentially of, or consist of, the recited components, and that there are processes and methods according to the disclosed technology that consist essentially of, or consist of, the recited processing steps.

It should be understood that the order of steps or order for performing certain action is immaterial so long as the disclosed technology remains operable. Moreover, two or more steps or actions in some circumstances can be conducted simultaneously. The invention has been described in detail with particular reference to certain embodiments thereof, but it will be understood that variations and modifications can be effected within the spirit and scope of the invention.

PARTS LIST

A, B, C select storage element states
L1, L2 level translators
M1, M2 transistors
D1, D2 zener diodes
R red clock signal/red select signal
G green clock signal/green select signal
Bl blue clock signal/blue select signal
10 two-terminal store-and-control circuit
11 terminal/electrical connection
11A first electrical connection
11B second electrical connection
12 surface-mount device
12A additional/redundant surface-mount device
13 surface-mount device substrate
14 chiplet
15 connection pad
16 conductor
17 bus
18 display substrate/backplane
19 tile substrate
20 first signal/modulated first signal/column-data line
21 external column-data signal
22 power circuit
24 V+ signal
26 V− signal
28 optional control circuit
30 second signal/modulated second signal/row-select line
31 external row-select signal
32 electrical conductor stub
35 active-matrix enable circuit
40 voltage comparator
41 comparison signal
42 data signal
44 select signal/clock signal
45 enable signal
46 control signal
48 output signal
50 data storage circuit
52 stored data signal
52R red stored data signal
52G green stored data signal
52B blue stored data signal
54 data storage element
54R red storage element
54G green storage element
54B blue storage element
58 select storage element
60 drive circuit
60R red drive circuit
60G green drive circuit
60B blue drive circuit
62 drive signal
64 enabled drive circuit
66 processor circuit/sensor circuit
68 modulator circuit
70 light emitter
70R red light emitter
70G green light emitter
70B blue light emitter
80 timing circuit
82 timing signal/clock signal
84 clock and data recovery circuit
90 select circuit
92 column controller
94 row controller
96 display controller
98 display tiles
99 display
100 provide surface-mount substrate step
110 dispose circuit on surface-mount substrate step
115 micro-transfer print circuit on surface-mount substrate step
120 micro-transfer print LEDs on surface-mount substrate step
130 electrically connect circuit to surface-mount substrate step
140 provide surface-mount device step
150 provide display substrate step
155 provide row-select conductors step
158 provide column-data conductors step
160 dispose SMD on display substrate step
165 optional dispose redundant SMD on display substrate step
170 electrically connect SMD to display substrate step
175 provide and connect row controller step
180 provide and connect column controller step
190 provide and connect display controller step
200 provide surface-mount display step
210 test surface-mount devices step
220 determine bad surface-mount devices step
230 dispose additional SMD(s) on display substrate step
235 replace bad SMD(s)s on display substrate step
240 electrically connect new SMDs step
250 provide a row of image data to a pixel row step
260 receive a row of output data from a pixel row step

The invention claimed is:

1. A two-terminal store-and-control circuit, comprising:

a power circuit comprising only two input electrical connections, a first electrical connection for receiving a modulated first signal and a second electrical connection for receiving a second signal, wherein the power circuit provides a V+ signal and a V− signal responsive to the modulated first signal and the second signal and the modulated first signal is a variable signal with variable periods;

a single voltage comparator for extracting a comparison signal from the modulated first signal received at the first electrical connection and the V+ signal provided by the power circuit, to produce a data signal; and a data storage circuit connected to the V+ and V− signals of the power circuit for receiving and storing the data signal and providing a stored data signal.

2. The circuit of claim 1, comprising a drive circuit for receiving the stored data signal and for providing a drive signal to drive a light emitter.

3. The circuit of claim 1, wherein the data signal is a digital signal.

4. The circuit of claim 3, wherein the data storage circuit includes one or more digital latches or flip-flops.

5. The circuit of claim 1, wherein the modulated first signal includes a trigger signal followed by a data signal and comprising a timing circuit for receiving the data signal and providing a timing signal in response to the data signal, wherein the timing signal is a temporally delayed signal responsive to the trigger signal.

6. The circuit of claim 5, wherein the data storage circuit stores and provides the stored data signal in response to receiving the timing signal.

7. The circuit of claim 1, wherein the data storage circuit comprises a plurality of data storage elements.

8. The circuit of claim 7, wherein the modulated first signal includes a trigger signal followed by a data signal and comprising:

a timing circuit for receiving the trigger signal and data signal and providing a timing signal in response to the received trigger signal, wherein the data storage elements are serially connected to shift data serially through the data storage elements in response to the timing signal.

9. The circuit of claim 1, comprising a processor or sensor circuit for processing the stored data signal to provide an output signal, a sensor for sensing an environmental attribute to provide the output signal, or a touch sensor for sensing a touch to provide the output signal.

10. The circuit of claim 1, comprising a drive circuit that, responsive to the stored data signal, provides a drive signal for driving one or more of a light emitter, a magnetic field, an electrical field, or a thermal device.

11. The circuit of claim 1, wherein the second signal is a modulated second signal independent of and present at the same time as the first modulated signal and the circuit comprises a clock and data recovery circuit responsive to the output of the first voltage comparator and the modulated second signal to produce the data signal and optionally a timing signal and optionally wherein the modulated second signal is a select or enable signal.

12. The circuit of claim 11, wherein, in response to the select signal, the enable signal, or a timing signal, the data storage circuit receives and stores the data signal and provides the stored data signal.

13. The circuit of claim 12, wherein the data storage circuit comprises a plurality of data storage elements.

14. The circuit of claim 1, wherein the circuit is a two-terminal surface-mount device having first and second electrical connections corresponding to the two terminals, and wherein the modulated first signal is electrically connected to the first electrical connection and the second signal is electrically connected to the second electrical connection.

15. The circuit of claim 14, comprising a substrate having a plurality of first and second electrical connections and a corresponding plurality of circuits, and wherein the modulated first signals are electrically connected to the first electrical connections and the second signals are electrically connected to the second electrical connections.

16. A method of making a two-terminal store-and-control device, the method comprising:

providing a surface-mount substrate having first and second electrical connections;

disposing a two-terminal store-and-control circuit on the surface-mount substrate, wherein the two-terminal store-and-control circuit comprises:

a power circuit comprising only two input electrical connections, a first electrical connection for receiving a modulated first signal and a second electrical connection for receiving a second signal, wherein the power circuit provides a V+ signal and a V− signal responsive to the modulated first signal and the second signal and the modulated first signal is a variable signal with variable periods;

a single voltage comparator for extracting a comparison signal from the modulated first signal received at the first electrical connection and the V+ signal provided by the power circuit, to produce a data signal; and a data storage circuit connected to the V+ and V− signals of the power circuit for receiving and storing the data signal and providing a stored data signal; and connecting the circuit to the first and second electrical connections.

17. The method of claim 16, comprising micro-transfer printing the circuit on the surface-mount substrate to dispose the circuit on the surface-mount substrate.

18. The method of claim 16, comprising providing one or more light emitters, disposing the one or more light emitters on the surface-mount substrate, and electrically connecting the light emitters to the circuit to drive the light emitters to emit light.

19. The method of claim 18, wherein the light emitters are micro-LEDs and comprising micro-transfer printing the micro-LEDs onto the surface-mount substrate.

20. A two-terminal store-and-control circuit, comprising:

a power circuit comprising a first electrical connection for receiving a modulated first signal and a second electrical connection for receiving a second signal, wherein the power circuit provides a V+ signal and a V− signal responsive to the modulated first signal and the second signal;

a voltage comparator for extracting a comparison signal from the modulated first signal received at the first electrical connection and the V+ signal provided by the power circuit, to produce a data signal;

a data storage circuit for receiving and storing the data signal and providing a stored data signal;

a processor or sensor circuit for processing the stored data signal to provide an output signal, a sensor for sensing an environmental attribute to provide the output signal, or a touch sensor for sensing a touch to provide the output signal; and a modulator circuit for modulating the second signal responsive to the output signal to provide a modulated output second signal, for modulating the first modulated signal responsive to the output signal to provide a modulated output first signal, or for modulating the first modulated signal and the second signal responsive to the output signal to provide a modulated output first signal and a modulated output second signal.

* * * * *